US005932409A

United States Patent [19]

Taniguchi et al.

[11] Patent Number: 5,932,409

[45] Date of Patent: Aug. 3, 1999

[54] SILVER HALIDE PHOTOGRAPHIC MATERIAL

[75] Inventors: Masato Taniguchi; Takashi Hoshimiya; Sinichi Ichikawa; Mamoru Sakurazawa; Junichiro Hosokawa, all of Kanagawa, Japan

[73] Assignee: Fuji Photo Film Co., Ltd., Minami Ashigara, Japan

[21] Appl. No.: 08/898,401

[22] Filed: Jul. 22, 1997

[30] Foreign Application Priority Data

Jul. 23, 1996 [JP] Japan ..... 8-193750
Jun. 13, 1997 [JP] Japan ..... 9-157100

[51] Int. Cl.[6] ..... G03C 1/34
[52] U.S. Cl. ..... 430/607; 430/264
[58] Field of Search ..... 430/607, 264

[56] References Cited

U.S. PATENT DOCUMENTS 5,064,751 11/1991 Ohki et al. ..... 430/464
5,158,856 10/1992 Usagawa et al. ..... 430/264
5,563,025 10/1996 Ishii et al. ..... 430/503
5,719,007 2/1998 Sakurazawa et al. ..... 430/264

FOREIGN PATENT DOCUMENTS 165171 6/1993 Japan ..... G03C 7/36

*Primary Examiner*—Mark F. Huff
*Attorney, Agent, or Firm*—Burns, Doane, Swecker & Mathis, LLP

[57] ABSTRACT

A silver halide photographic material is described, which contains at least one compound represented by the following formula (S1):

(S1)

wherein $R_{11}$ represents an alkyl group, an acyl group, an alkoxycarbonyl group, a carbamoyl group, a sulfonyl group, or a sulfamoyl group; $R_{12}$ represents a hydrogen atom, an alkyl group or an acyl group, provided that when $R_{11}$ represents an alkyl group, $R_{12}$ represents an alkyl group, $R_{11}$ and $R_{12}$ may be linked with each other to form a 5- to 7-membered ring; $R_{13}$ represents a hydrogen atom, an alkyl group, an aryl group, or a heterocyclic group; $R_{14}$ represents a hydrogen atom, an alkyl group, an aryl group, or a heterocyclic group; and L represents —CO—, —$SO_2$— or —SO—.

9 Claims, No Drawings

SILVER HALIDE PHOTOGRAPHIC MATERIAL

FIELD OF THE INVENTION

The present invention relates to a silver halide photographic material which provides excellent raw stock storage stability and latent image storage stability by the incorporation of a specific organic compound without causing a harmful influence such as development hindrance, and which has high stability against conditions of the production.

BACKGROUND OF THE INVENTION

In a silver halide photographic material, not only high sensitivity is required, but also it is desired that the fluctuations in photographic properties being dependent on the storage periods after the production of a photographic material until photographing and after photographing until the photographic material is development processed be as small as possible.

Further, a film unit equipped with a lens, "Utsurundesu" produced by Fuji Photo Film Co., Ltd., has widely prevailed in recent years. In keeping with the permeation of such a film unit equipped with a lens, silver halide photographic materials have increasingly become to be stored in higher temperature and higher humidity conditions. Accordingly, a photographic material the photographic properties of which fluctuate little when stored in high temperature and high humidity conditions irrespective of before and after photographing has been strongly desired.

As a means to inhibit the increase of fog in a photographic material during storage, it has been disclosed in JP-A-7-239540 (corresponding to U.S. Pat. No. 5,563,025) (the term "JP-A" as used herein means an "unexamined published Japanese patent application") that the increase of fog due to the storage for a long period of time can be prevented by the addition of a certain kind of compounds having a hydroxylamino group as a substituent to a photographic material. The present inventors have found that the compounds disclosed in said publication could effectively prevent the fluctuation in photographic properties in high temperature and high humidity conditions. However, a new problem has arisen by the addition of such compounds.

An emulsion for use in a photographic material is not coated on a support immediately after being prepared but is stored in the state after preparation as it is for a certain period of time for various reasons of preparation time. The emulsion in this state is called a finished emulsion. The time of aging of a finished emulsion until coating varies with every batch, accordingly, it is a big load and not preferred for the production of photographic materials that photographic properties after coating fluctuate according to difference in aging time. The present inventors have found from the examination that the above-described compounds for inhibiting the photographic fluctuation in high temperature and high humidity conditions function effectively in a photographic material but fog in a finished emulsion is increased conversely with the increase of aging time. The details of the reason why completely converse phenomena are generated with a photographic material and a finished emulsion are unknown but the inhibition of the fluctuation-in photographic properties of a finished emulsion with the lapse of time has been strongly desired.

The present inventors have found as a result of eager investigations that, of the compounds having a hydroxylamino group as a substituent, a certain kind of compounds recited in the claims of JP-A-2-841 (corresponding to U.S. Pat. No. 5,158,856) and JP-A-5-165171 are effective as compounds which show little fluctuation in photographic properties of a finished emulsion with the lapse of time. However, it has also been found that these compounds bring about harmful effect such as development hindrance, that is, the reduction of color density is caused by the addition of any of these compounds. The compound for inhibiting the fluctuation in photographic properties during storage is primarily desired to suppress the influence to such and other photographic capabilities as small as possible.

SUMMARY OF THE INVENTION

The present invention has been realized in the light of the above circumstances. One object of the present invention is to provide a photographic material which shows little fluctuation in photographic properties and does not cause development hindrance when stored in high temperature and high humidity conditions, and another object is to make the influence of the change of the production condition exerted on photographic properties at the time of the production of the photographic material as small as possible.

The above objects of the present invention can be achieved by a silver halide photographic material comprising a support having provided thereon a silver halide light-sensitive layer, which silver halide photographic material comprises at least one compound represented by the following formula (S1):

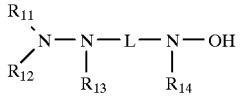

(S1)

wherein $R_{11}$ represents an alkyl group, an acyl group, an alkoxycarbonyl group, a carbamoyl group, a sulfonyl group, or a sulfamoyl group; $R_{12}$ represents a hydrogen atom, an alkyl group or an acyl group, provided that when $R_{11}$ represents an alkyl group, $R_{12}$ represents an alkyl group, $R_{11}$ and $R_{12}$ may be linked with each other to form a 5- to 7-membered ring; $R_{13}$ represents a hydrogen atom, an alkyl group, an aryl group, or a heterocyclic group; $R_{14}$ represents a hydrogen atom, an alkyl group, an aryl group, or a heterocyclic group; and L represents —CO—, —$SO_2$— or —SO—.

DETAILED DESCRIPTION OF THE INVENTION

The present invention is described in detail below.

A compound represented by formula (S1) is described in more detail below.

In formula (S1), $R_{11}$ represents an alkyl group, an acyl group, an alkoxycarbonyl group, a carbamoyl group, a sulfonyl group, or a sulfamoyl group. Examples of $R_{11}$ are described in more detail below. The alkyl group is a straight chain, branched or cyclic alkyl group having from 1 to 60, preferably from 1 to 40, carbon atoms, which may be substituted with an alkenyl group, an alkynyl group, an aryl group, a hydroxyl group, a nitro group, a cyano group, a halogen atom, or other substituent consisting of an oxygen atom, a nitrogen atom, a sulfur atom or a carbon atom, e.g., methyl, ethyl, n-butyl, n-hexyl, n-dodecyl, 2-hexyldecyl, benzyl, phenethyl, 2-ethylhexyl, neopentyl, isopropyl, isobutyl, sec-butyl, 1-methyldodecyl, t-butyl, 1,1-dimethylpropyl, 2-ethyl-1,1-dimethylhexyl, 1-ethyl-1-methylpropyl, 1,1-diethylpropyl, 1-methyl-1-(4-methylcyclohexyl)ethyl, cyclopropyl, cyclobutyl, cyclopentyl, cyclohexyl, 4-methyl-2,6-di-t-butylcyclohexyl, 2,6-dimethylcyclohexyl, 1-methylcyclohexyl, 1-adamantyl, bornyl, norbornyl, 2-methoxyethyl, 3-hydroxypropyl, 2-methanesulfonamidoethyl, 2-acetamidoethyl, 2-carboxyethyl, 3-carbamoylpropyl, 4-carbamoylaminobutyl, or an alkyl group having the following structure:

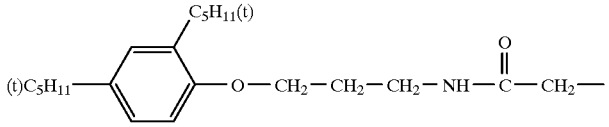

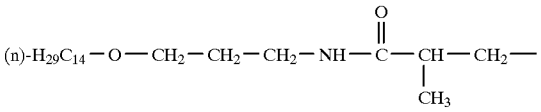

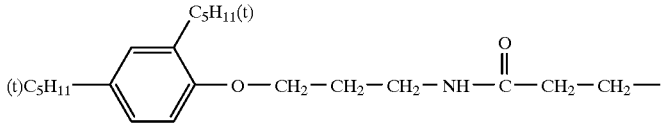

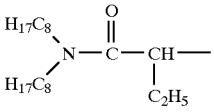

The acyl group is an acyl group having from 1 to 60, preferably from 1 to 40, carbon atoms, which may be substituted with an alkenyl group, an alkynyl group, an aryl group, a hydroxyl group, a nitro group, a cyano group, a halogen atom, or other substituent consisting of an oxygen atom, a nitrogen atom, a sulfur atom or a carbon atom, e.g., formyl, acetyl, propionyl, isobutyryl, trimethylacetyl, isovaleryl, hexanoyl, 2-ethylhexanoyl, lauroyl, myristoyl, palmitoyl, stearoyl, cyclohexanecarbonyl, 1-adamantanecarbonyl, oleyl, phenoxyacetyl, cinnamoyl, benzoyl, 3,5-dichlorobenzoyl, 4-methoxybenzoyl, pentafluorobenzoyl, 1-naphthyl, 2-octadecyloxybenzoyl, nicotinoyl, or an acyl group having the following structure:

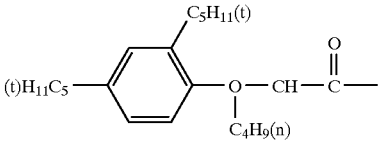

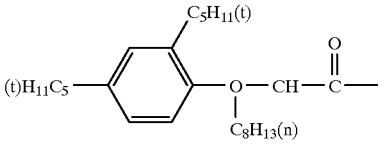

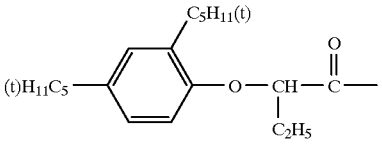

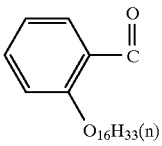

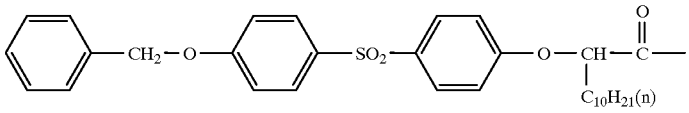

-continued
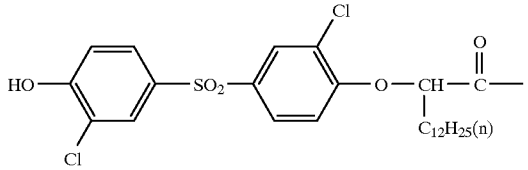
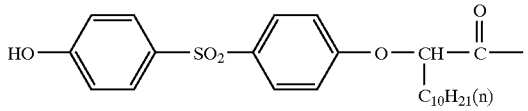
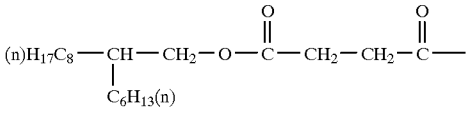
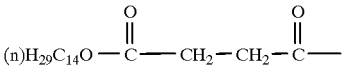
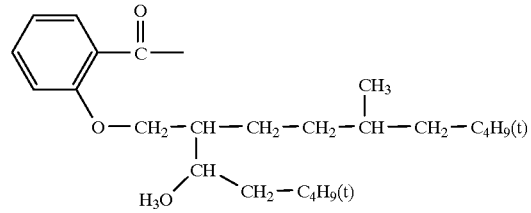
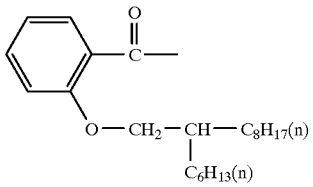
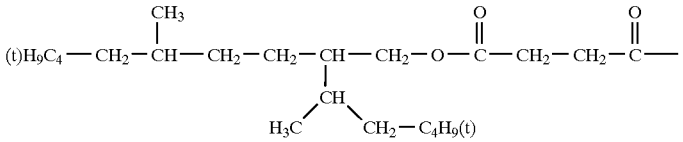
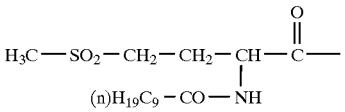
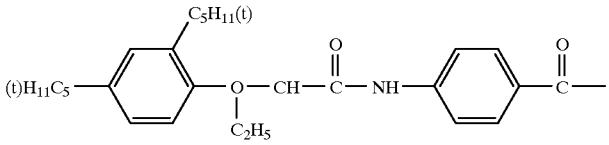
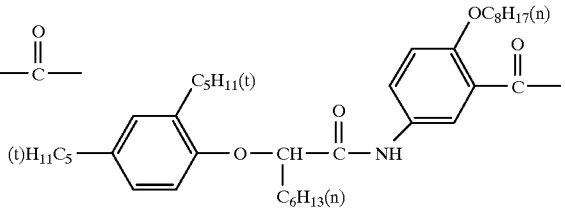
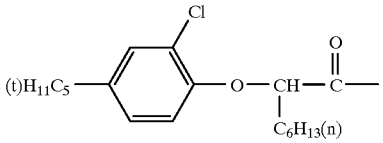
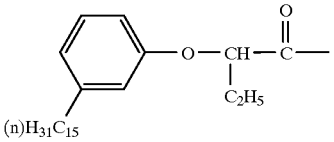
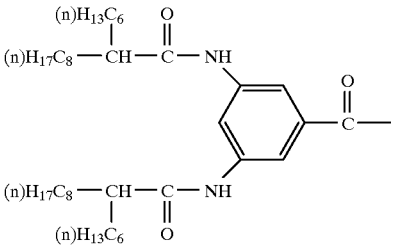
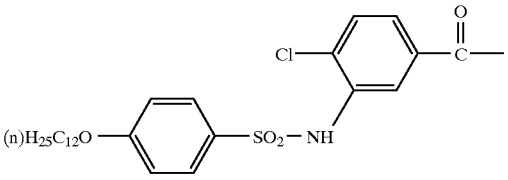
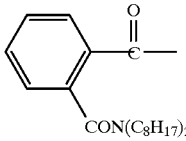
The alkoxycarbonyl group is an alkoxycarbonyl group having from 2 to 60, preferably from 2 to 40, carbon atoms, which may be substituted with an alkenyl group, an alkynyl group, an aryl group, a hydroxyl group, a nitro group, a cyano group, a halogen atom, or other substituent consisting of an oxygen atom, a nitrogen atom, a sulfur atom or a carbon atom, e.g., methoxycarbonyl, ethoxycarbonyl, 2,2,2-trichloroethoxycarbonyl, isopropyloxycarbonyl, isobutyloxycarbonyl, octyloxycarbonyl, hexadecyloxycarbonyl, 2-ethylhexyloxycarbonyl, 3-butenyloxycarbonyl, menthyloxycarbonyl, 1-adamantyloxycarbonyl, 2-methoxyethyloxycarbonyl, 2-(2-diethylaminoethoxy)ethoxycarbonyl, 2-hexyloxyethoxycarbonyl, 2-phenoxyethoxycarbonyl, or benzyloxycarbonyl.

The carbamoyl group is a carbamoyl group having from 1 to 60, preferably from 1 to 40, carbon atoms, which may be substituted with an alkenyl group, an alkynyl group, an aryl group, a hydroxyl group, a nitro group, a cyano group, a halogen atom, or other substituent consisting of an oxygen atom, a nitrogen atom, a sulfur atom or a carbon atom, e.g., dimethylcarbamoyl, diethylcarbamoyl, diisopropylcarbamoyl, 4-morpholinecarbamoyl, N-phenyl-N-benzylcarbamoyl, diphenylcarbamoyl, 1-tetrahydroquinolinecarbonyl, 2-ethylhexylcarbamoyl, hexadecylcarbamoyl, 3-tetradecyloxypropylcarbamoyl, dioctylcarbamoyl, 3-dodecyloxypropylcarbamoyl, or a carbamoyl group having the following structure:

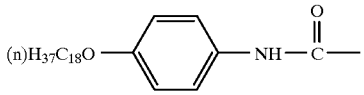

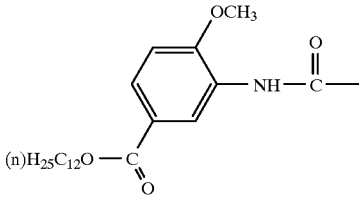

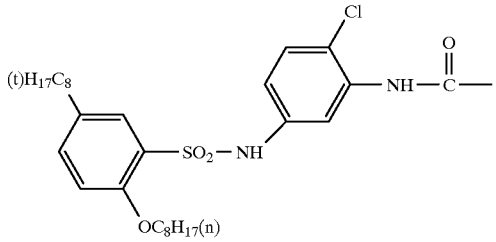

-continued

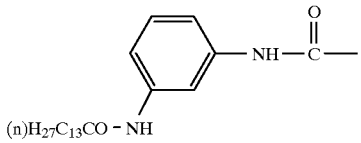

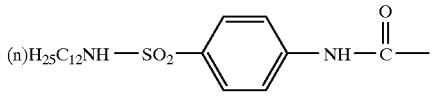

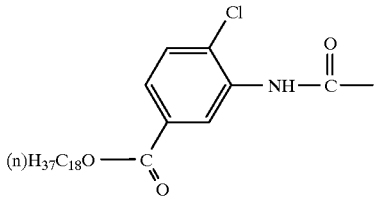

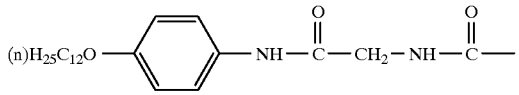

The sulfonyl group is a sulfonyl group having from 0 to 60, preferably from 0 to 40, carbon atoms, which may be substituted with an alkenyl group, an alkynyl group, an aryl group, a hydroxyl group, a nitro group, a cyano group, a halogen atom, or other substituent consisting of an oxygen atom, a nitrogen atom, a sulfur atom or a carbon atom, e.g., methanesulfonyl, ethanesulfonyl, a-toluenesulfonyl, isopropylsulfonyl, benzenesulfonyl, 1-octanesulfonyl, 2-nitrobenzenesulfonyl, p-toluenesulfonyl, 1-hexadecanesulfonyl, 4-bromobenzenesulfonyl, N-acetylsulfonyl, trifluoromethanesulfonyl, 1-naphthalenesulfonyl, 8-quinolinesulfonyl, or a sulfonyl group having the following structure:

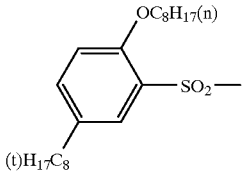

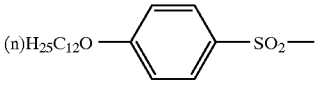

-continued
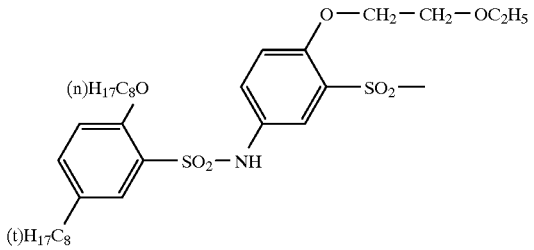
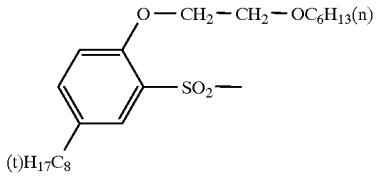
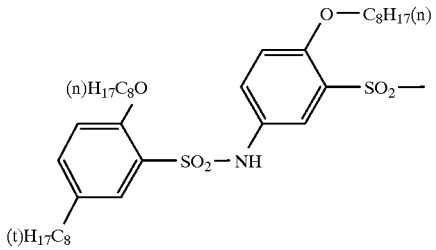
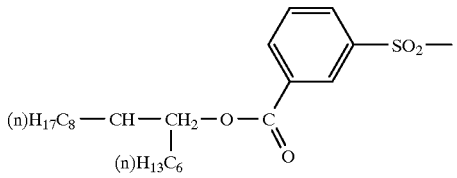
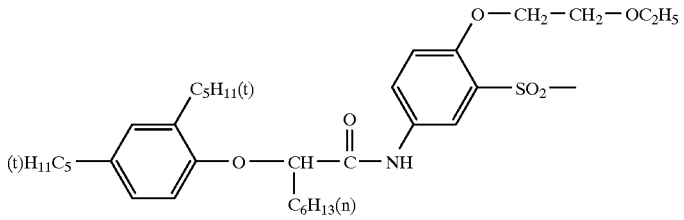
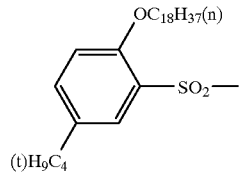
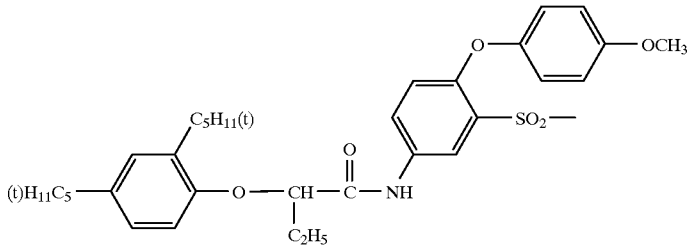

-continued

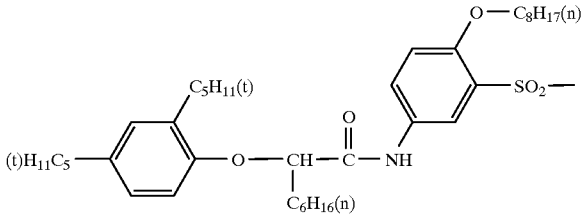

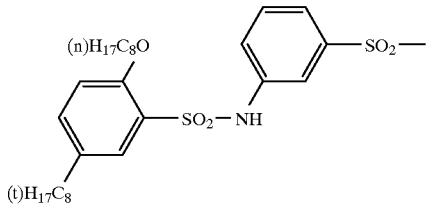

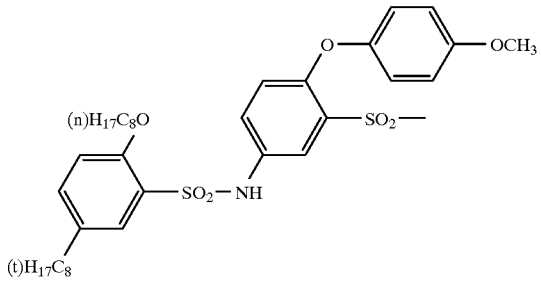

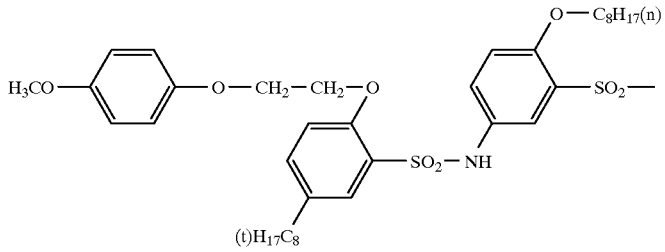

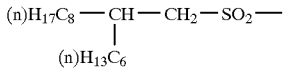

The sulfamoyl group is a sulfamoyl group having from 0 to 60, preferably from 0 to 40, carbon atoms, which may be substituted with an alkenyl group, an alkynyl group, an aryl group, a hydroxyl group, a nitro group, a cyano group, a halogen atom, or other substituent consisting of an oxygen atom, a nitrogen atom, a sulfur atom or a carbon atom, e.g., dimethylsulfamoyl.

$R_{12}$ represents a hydrogen atom, an alkyl group or an acyl group. When $R_{12}$ represents an alkyl group, the alkyl group has the same meaning as described in the alkyl group represented by $R_{11}$. Provided that when $R_{11}$ represents an alkyl group, $R_{12}$ represents an alkyl group. When $R_{12}$ represents an acyl group, the acyl group has the same meaning as described in the acyl group represented by $R_{11}$. $R_{11}$ and $R_{12}$ may be linked with each other to form a 5- to 7-membered ring. The element which constitutes the ring is selected from a carbon atom, a nitrogen atom, or an oxygen atom. Examples of the rings which are formed are shown below.

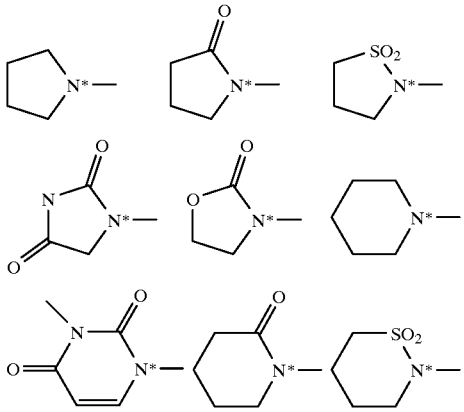

-continued

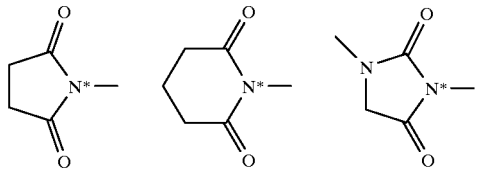

wherein the nitrogen atom marked with*indicate the nitrogen atom which are bonded to $R_{11}$ and $R_{12}$ in formula (S1).

When $R_{11}$ and $R_{12}$ are linked with each other to form a 5- to 7-membered ring including the above exemplified rings, the elements constituting the ring can be substituted with an alkenyl group, an alkynyl group, an aryl group, a hydroxyl group, a nitro group, a cyano group, a halogen atom, or other substituent consisting of an oxygen atom, a nitrogen atom, a sulfur atom or a carbon atom as far as possible. The ring may have a condensed ring structure with other ring.

$R_{13}$ represents a hydrogen atom, an alkyl group, an aryl group, or a heterocyclic group. Examples of $R_{13}$ are described in more detail below. When $R_{13}$ represents an alkyl group, the alkyl group has the same meaning as described in the alkyl group represented by $R_{11}$. The aryl group is an aryl group having from 6 to 60, preferably from 6 to 40, carbon atoms, which may be substituted with an alkenyl group, an alkynyl group, an aryl group, a hydroxyl group, a nitro group, a cyano group, a halogen atom, or other substituent consisting of an oxygen atom, a nitrogen atom, a sulfur atom or a carbon atom, e.g., phenyl, naphthyl, p-methoxyphenyl, or m-acetamidophenyl. The heterocyclic group is a 5- or 6-membered aromatic or aliphatic heterocyclic group having from 1 to 5 carbon atoms and containing one or more of an oxygen atom, a nitrogen atom or a sulfur atom, and the number of the hetero atom and the kind of the element constituting the ring may be one or more. The heterocyclic group may further be substituted with an alkyl group, an alkenyl group, an alkynyl group, an aryl group, a hydroxyl group, a nitro group, a cyano group, a halogen atom, or other substituent consisting of an oxygen atom, a nitrogen atom, a sulfur atom or a carbon atom. Provided that $R_{13}$ represents a heterocyclic group, the nitrogen atom in formula (S1) to which $R_{13}$ is bonded is bonded to the carbon atom constituting the heterocyclic group. Examples of the heterocyclic group include, e.g., 2-furyl, 2-thienyl, 2-pyrimidinyl, 2-benzotriazolyl, imidazolyl and pyrazolyl.

$R_{14}$ represents a hydrogen atom, an alkyl group, an aryl group, or a heterocyclic group. Examples of $R_{14}$ are described in more detail below. When $R_{14}$ represents an alkyl group, the alkyl group has the same meaning as described in the alkyl group represented by $R_{11}$. When $R_{14}$ represents an aryl group, the aryl group has the same meaning as described in the aryl group represented by $R_{13}$. When $R_{14}$ represents a heterocyclic group, the heterocyclic group has the same meaning as described in the heterocyclic group represented by $R_{13}$. L represents —CO—, —$SO_2$— or —SO—.

Preferred combinations of $R_{11}$, $R_{12}$, $R_{13}$, $R_{14}$ and L in formula (S1) are described below.

The combination in which $R_{13}$ is a hydrogen atom and L is —CO— is preferred. The combination in which $R_{11}$ is an acyl group, an alkoxycarbonyl group, a carbamoyl group, a sulfonyl group, or a sulfamoyl group, $R_{12}$ is a hydrogen atom, $R_{13}$ is a hydrogen atom, $R_{14}$ is a hydrogen atom or an alkyl group, and L is —CO— is more preferred. The combination in which $R_{11}$ is an acyl group or a carbamoyl group, $R_{12}$ is a hydrogen atom, $R_{13}$ is a hydrogen atom, $R_{14}$ is a hydrogen atom or an alkyl group, and L is —CO— is further preferred, wherein still more preferred is the case in which $R_{14}$ is an alkyl group, and the case in which $R_{11}$ is a substituted or unsubstituted benzoyl group is most preferred.

A compound represented by the following formula (S2) is preferred above all. A compound represented by formula (S2) can effectively inhibit fluctuation in photographic properties not only in a high temperature and high humidity condition but also in a high temperature and low humidity condition. The compound can be particularly preferably used when colored couplers for correcting the unnecessary absorption of colored dyes are used in a photographic material.

(S2)

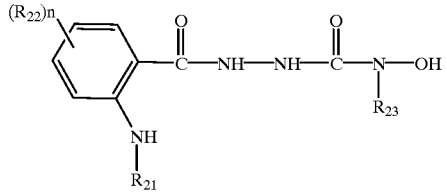

wherein $R_{21}$ represents an acyl group, an alkoxycarbonyl group, a carbamoyl group, a sulfonyl group or a sulfamoyl group; $R_{22}$ represents a substituent; $R_{23}$ represents an alkyl group having from 1 to 6 carbon atoms; and n represents 0 or an integer of from 1 to 4.

A compound represented by formula (S2) is described in detail below.

In formula (S2), $R_{21}$ represents an acyl group, an alkoxycarbonyl group, a carbamoyl group, a sulfonyl group, or a sulfamoyl group. $R_{21}$ is described in further detail. When $R_{21}$ represents an acyl group, the acyl group has the same meaning as described in $R_{11}$. When $R_{21}$ represents an alkoxycarbonyl group, the alkoxycarbonyl group has the same meaning as described in $R_{11}$. When $R_{21}$ represents a carbamoyl group, the carbamoyl group has the same meaning as described in $R_{11}$. When $R_{21}$ represents a sulfonyl group, the sulfonyl group has the same meaning as described in $R_{11}$. When $R_{21}$ represents a sulfamoyl group, the sulfamoyl group has the same meaning as described in $R_{11}$.

$R_{22}$ represents a substituent. Examples of substituents include a halogen atom, an alkyl group, an aryl group, a heterocyclic group, a cyano group, a nitro group, a hydroxyl group, a carboxyl group, a sulfo group, an alkoxyl group, an aryloxy group, an acylamino group, an amino group, an alkylamino group, an anilino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, a heterocyclic oxy group, an azo group, an acyloxy group, a carbamoyloxy group, a silyl group, a silyloxy group, an aryloxycarbonylamino group, an imido group, a heterocyclic thio group, a sulfinyl group, a phosphono group, an aryloxycarbonyl group, and an acyl group. These groups may be substituted with an alkyl group, an alkenyl group, an alkynyl group, an aryl group, a hydroxylgroup, a nitro group, a cyano group, a halogen atom or other substituent consisting of an oxygen atom, a nitrogen atom, a sulfur atom or a carbon atom.

Examples of substituents for $R_{22}$ are described in further detail. The halogen atom includes, e.g., a fluorine atom or a chlorine atom. The alkyl group is a straight chain, branched or cyclic alkyl group having from 1 to 40, preferably from 1 to 22, carbon atoms, e.g., methyl, ethyl, propyl, isopropyl, t-butyl, 2-hydroxyethyl, 3-hydroxypropyl, benzyl, 2-methanesulfonamidoethyl, 3-methanesulfonamidopropyl, 2-methanesulfonylethyl, 2-methoxyethyl, cyclopentyl, 2-acetamidoethyl, 2-carboxyethyl, 2-carbamoylethyl, 3-carbamoylpropyl, 2,3-dihydroxypropyl, 3,4-dihydroxybutyl, n-hexyl, 2-hydroxypropyl, 4-hydroxybutyl, 2-carbamoylaminoethyl, 3-carbamoylaminopropyl, 4-carbamoylaminobutyl, 4-carbamoylbutyl, 2-carbamoyl-1-methylethyl, 4-nitrobutyl, or or each of the alkyl groups described in $R_{11}$.

The aryl group is an aryl group having from 6 to 24 carbon atoms, e.g., phenyl, naphthyl or p-methoxyphenyl. The heterocyclic group is a 5- or 6-membered saturated or unsaturated heterocyclic group having from 1 to 5 carbon atoms containing one or more of an oxygen atom, a nitrogen atom or a sulfur atom, and the number of the hetero atom and the kind of the element constituting the ring may be one or more, e.g., 2-furyl, 2-thienyl, 2-pyrimidinyl, 2-benzotriazolyl, imidazolyl or pyrazolyl.

The alkoxyl group is an alkoxyl group having from 1 to 40, preferably from 1 to 22, carbon atoms, e.g., methoxy, ethoxy, 2-methoxyethoxy, or 2-methanesulfonylethoxy. The aryloxy group is an aryloxy group having from 6 to 24 carbon atoms, e.g., phenoxy, p-methoxyphenoxy, or m-(3-hydroxypropionamido)phenoxy. The acylamino group is an acylamino group having from 1 to 40, preferably from 1 to 22, carbon atoms, e.g., acetamido, 2-methoxypropionamido or p-nitrobenzoylamido.

The alkylamino group is an alkylamino group having from 1 to 40, preferably from 1 to 22, carbon atoms, e.g., dimethylamino, diethylamino, or 2-hydroxyethylamino. The anilino group is an anilino group having from 6 to 24 carbon atoms, e.g., anilino, m-nitroanilino or N-methylanilino. The ureido group is a ureido group having from 1 to 40, preferably from 1 to 22, carbon atoms, e.g., ureido, methylureido, N,N-diethylureido, or 2-methanesulfonamidoethylureido.

The sulfamoylamino group is a sulfamoylamino group having from 0 to 40, preferably from 0 to 22, carbon atoms, e.g., dimethylsulfamoylamino, methylsulfamoylamino, or 2-methoxyethylsulfamoylamino. The alkylthio group is an alkylthio group having from 1 to 40, preferably from 1 to 22, carbon atoms, e.g., methylthio, ethylthio, or 2-phenoxyethylthio. The arylthio group is an arylthio group having from 6 to 24 carbon atoms, e.g., phenylthio, 2-carboxyphenylthio, or 4-cyanophenylthio. The alkoxycarbonylamino group is an alkoxycarbonylamino group having from 2 to 40, preferably from 2 to 22, carbon atoms, e.g., methoxycarbonylamino, ethoxycarbonylamino, or 3-methanesulfonylpropoxycarbonylamino.

The sulfonamido group is a sulfonamido group having from 1 to 40, preferably from 1 to 22, carbon atoms, e.g., methanesulfonamido, p-toluenesulfonamido or 2-methoxyethanesulfonamido. The carbamoyl group is a carbamoyl group having from 1 to 40, preferably from 1 to 22, carbon atoms, e.g., carbamoyl, N,N-dimethylcarbamoyl, or N-ethylcarbamoyl. The sulfamoyl group is a sulfamoyl group having from 0 to 40, preferably from 0 to 22, carbon atoms, e.g., sulfamoyl, dimethylsulfamoyl, or ethylsulfamoyl.

The sulfonyl group is an aliphatic or aromatic sulfonyl group having from 0 to 40, preferably from 0 to 22, carbon atoms, e.g., methanesulfonyl, ethanesulfonyl, or 2-chloroethanesulfonyl. The alkoxycarbonyl group is an alkoxycarbonyl group having from 2 to 40, preferably from 2 to 22, carbon atoms, e.g., methoxycarbonyl, ethoxycarbonyl, or t-butoxycarbonyl. The heterocyclic oxy group is a 5- or 6-membered saturated or unsaturated heterocyclic oxy group having from 1 to 5 carbon atoms containing one or more of an oxygen atom, a nitrogen atom or a sulfur atom, and the number of the hetero atom and the kind of the element constituting the ring may be one or more, e.g., 1-phenyltetrazolyl-5-oxy, 2-tetrahydropyranyloxy, or 2-pyridyloxy.

The azo group is an azo group having from 0 to 40, preferably from 0 to 22, carbon atoms, e.g., phenylazo, 2-hydroxy-4-propanoylphenylazo, or 4-sulfophenylazo. The acyloxy group is an acyloxy group having from 1 to 40, preferably from 1 to 22, carbon atoms, e.g., acetoxy, benzoyloxy, or 4-hydroxybutanoyloxy. The carbamoyloxy group is a carbamoyloxy group having from 1 to 40, preferably from 1 to 22, carbon atoms, e.g., N,N-dimethylcarbamoyloxy, N-methylcarbamoyloxy, or N-phenylcarbamoyloxy.

The silyl group is a silyl group having from 3 to 40, preferably from 3 to 22, carbon atoms, e.g., trimethylsilyl, isopropyldiethylsilyl, or t-butyldimethylsilyl. The silyloxy group is a silyloxy group having from 3 to 40, preferably from 3 to 22, carbon atoms, e.g., trimethylsilyloxy, triethylsilyloxy, or diisopropylethylsilyloxy. The aryloxycarbonylamino group is an aryloxycarbonylamino group having from 7 to 24 carbon atoms, e.g., phenoxycarbonylamino, 4-cyanophenoxycarbonylamino, or 2,6-dimethoxyphenoxycarbonylamino.

The imido group is an imido group having from 4 to 40 carbon atoms, e.g., N-succinimido or N-phthalimido. The heterocyclic thio group is a 5- or 6-membered saturated or unsaturated heterocyclic thio group having from 1 to 5 carbon atoms containing one or more of an oxygen atom, a nitrogen atom or a sulfur atom, and the number of the hetero atom and the kind of the element constituting the ring may be one or more, e.g., 2-benzothiazolylthio or 2-pyridylthio.

The sulfinyl group is a sulfinyl group having from 0 to 40, preferably from 0 to 22, carbon atoms, e.g., methanesulfinyl, benzenesulfinyl or ethanesulfinyl. The phosphono group is a phosphono group having from 0 to 40, preferably from 0 to 22, carbon atoms, e.g., methoxyphosphono, ethoxyphosphono, or phenoxyphosphono. The aryloxycarbonyl group is an aryloxycarbonyl group having from 7 to 24 carbon atoms, e.g., phenoxycarbonyl, 2-methylphenoxycarbonyl, or 4-acetamidophenoxycarbonyl. The acyl group is an acyl group having from 1 to 40, preferably from 1 to 22, carbon atoms, e.g., acetyl, benzoyl, or 4-chlorobenzoyl.

$R_{23}$ represents an alkyl group having from 1 to 6 carbon atoms. Specifically, $R_{23}$ represents a straight chain, branched or cyclic alkyl group having from 1 to 6 carbon atoms, e.g., methyl, ethyl, propyl, isopropyl, t-butyl, 2-hydroxyethyl, 3-hydroxypropyl, 2-methanesulfonamidoethyl, 2-methoxyethyl, cyclopentyl, 2-carboxyethyl, 2-carbamoylethyl, 3-carbamoylpropyl, 2,3-dihydroxypropyl, n-hexyl 2-hydroxypropyl, 3-carbamoylaminopropyl, or 4-carbamoylbutyl.

n represents 0 or an integer of from 1 to 4. That n is 0 means $R_{22}$ being unsubstituted.

Preferred combinations of $R_{21}$, $R_{22}$, $R_{23}$ and n in formula (S2) are described below.

A case in which n is 0 is preferred, wherein more preferred is the case in which $R_{21}$ is an acyl group or a sulfonyl group. The combination in which n is 0, $R_{21}$ is an acyl group or a sulfonyl group, and $R_{23}$ is a methyl, ethyl or n-propyl group is furthermore preferred. The combination in which n is 0, $R_{21}$ is an acyl group, and $R_{23}$ is a methyl, ethyl or n-propyl group is still more preferred.

Specific examples of the compounds represented by formula (S1) are shown below, but the present invention is not limited thereto.

(S1-1)
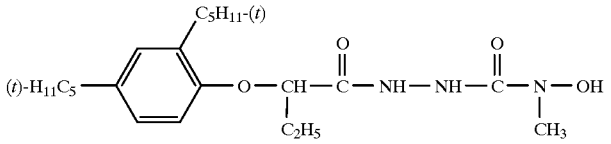
(S1-2)
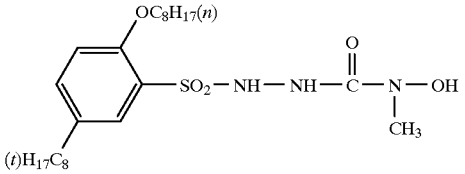
(S1-3)
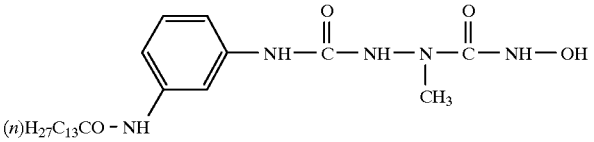
(S1-4)
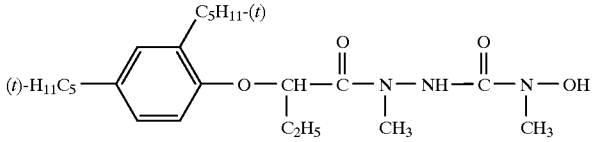
(S1-5)
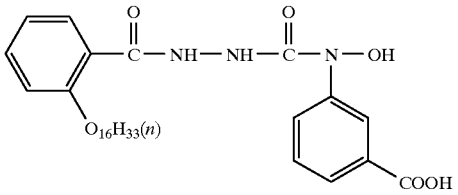
(S1-6)
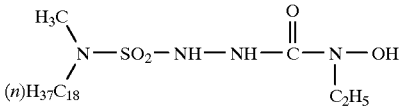
(S1-7)
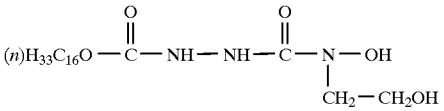
(S1-8)
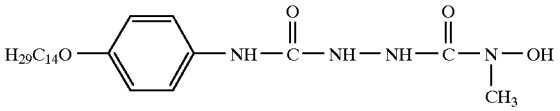
(S1-9)
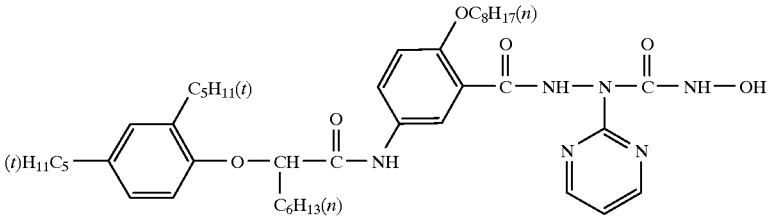

-continued
(S1-10)
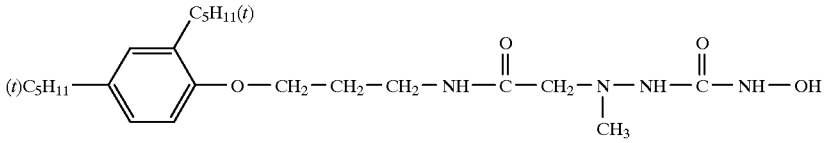
(S1-11)
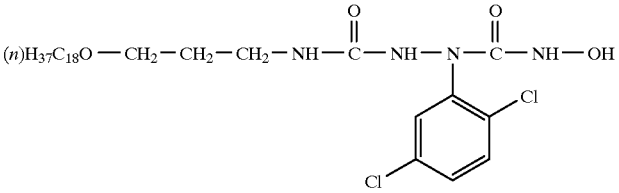
(S1-12)
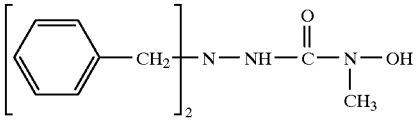
(S1-13)
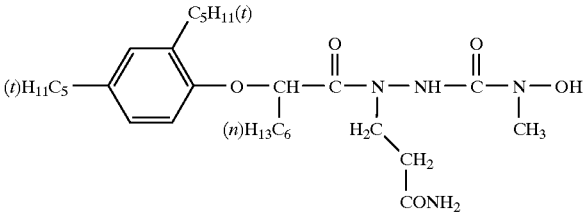
(S1-14)
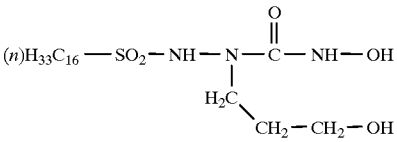
(S1-15)
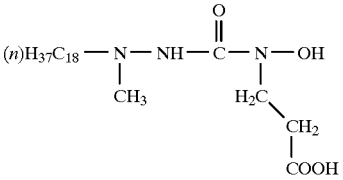
(S1-16)
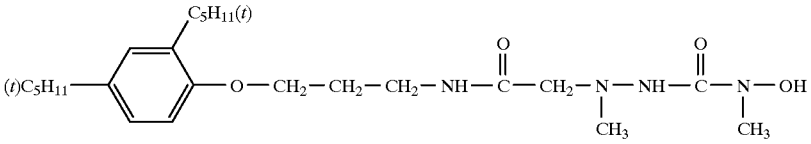
(S1-17)
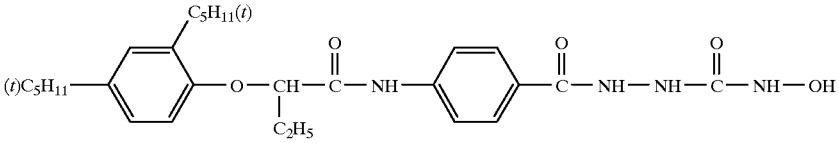

-continued
(S1-18)
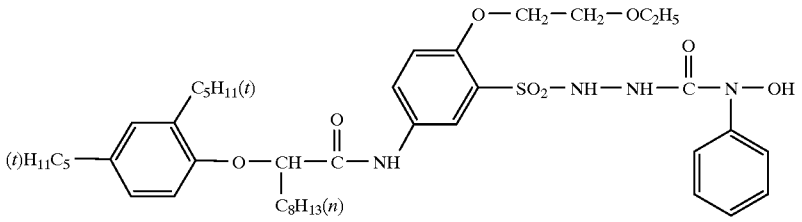
(S1-19)
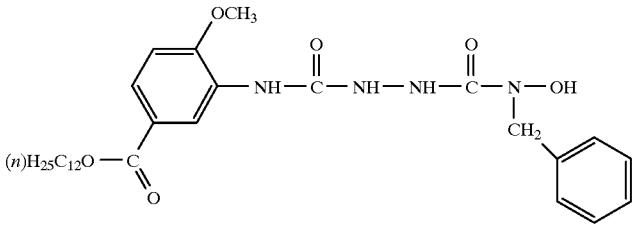
(S1-20)
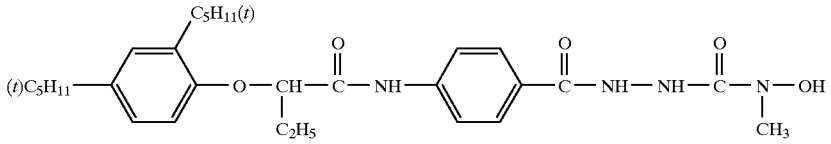
(S1-21)
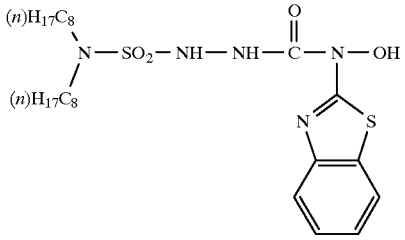
(S1-22)
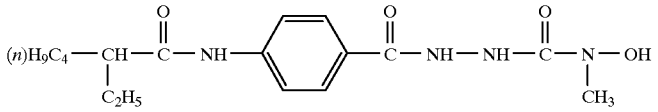
(S1-23)
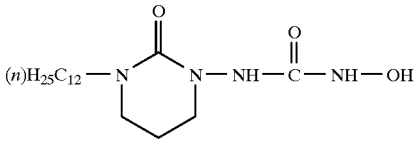
(S1-24)
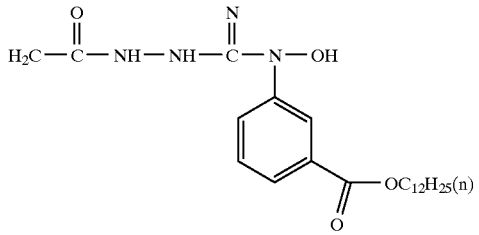

-continued
(S1-25)
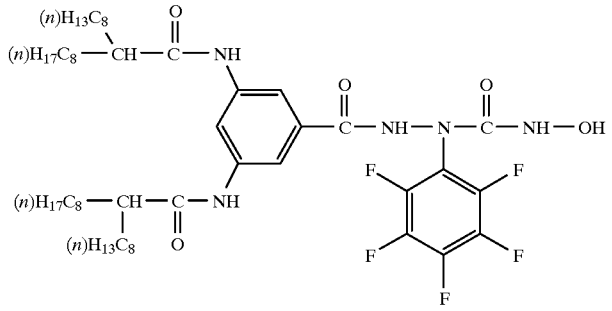
(S1-26)
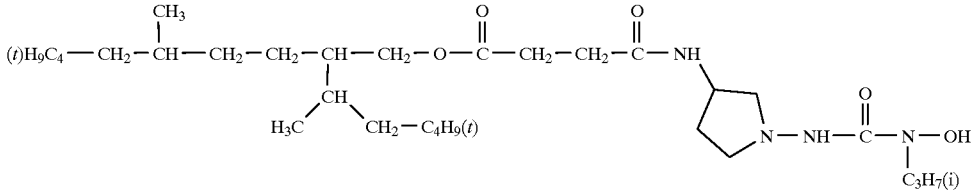
(S1-27)
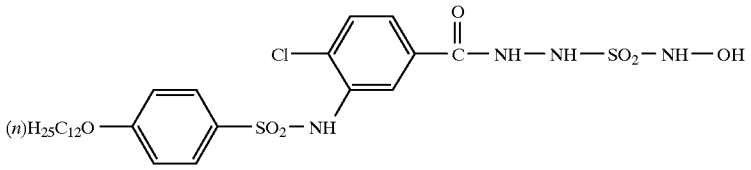
(S1-28)
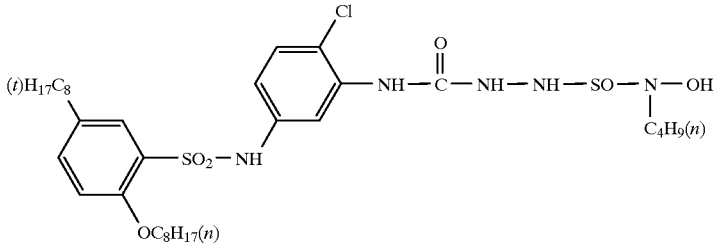
(S1-29)
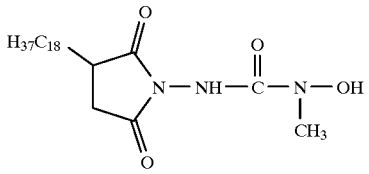
(S1-30)
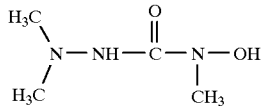
(S1-31)
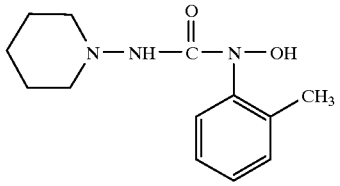

-continued
(S1-32)
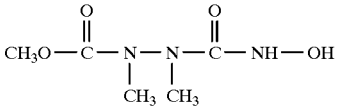
(S1-33)
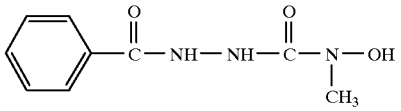
(S1-34)
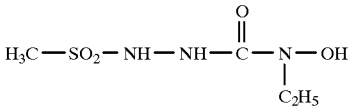
(S1-35)
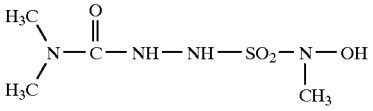
(S1-36)
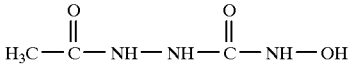
(S1-37)
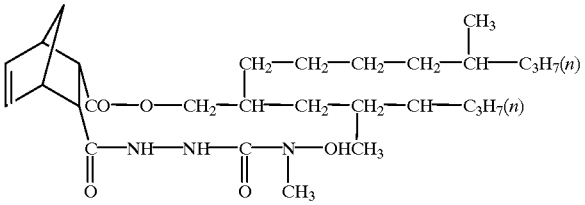
(S1-38)
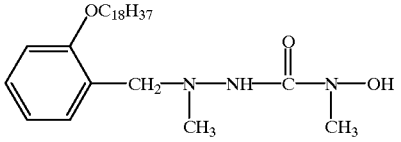
(S1-39)
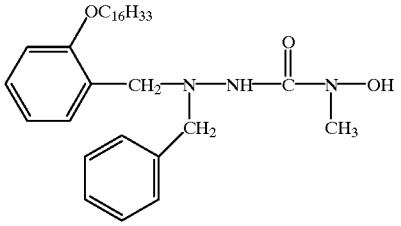
(S1-40)
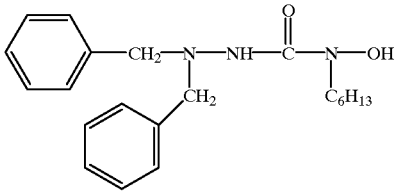

-continued
(S2-1)
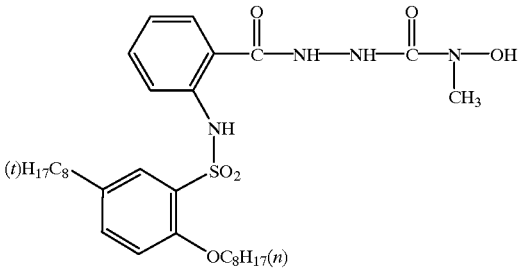
(S2-2)
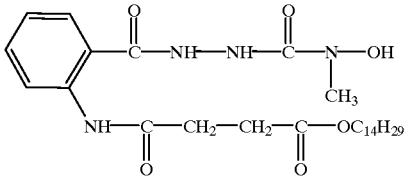
(S2-3)
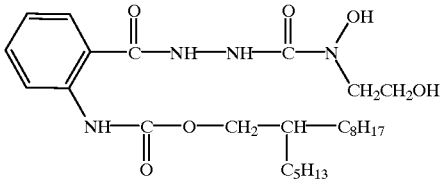
(S2-4)
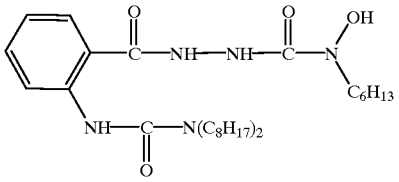
(S2-5)
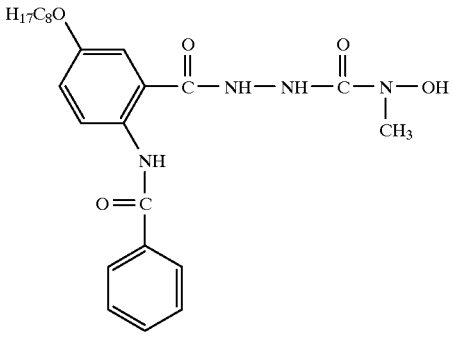
The compound represented by formula (S1) can be synthesized by arbitrarily selecting known methods in the organic chemistry. Two representative synthesis routes are shown below by reaction scheme 1.
Reaction scheme 1
Synthesis Route 1
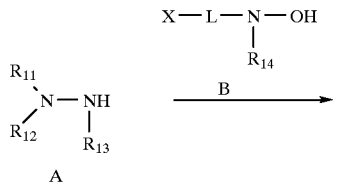
A -continued

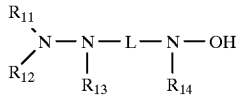

Synthesis Route 2

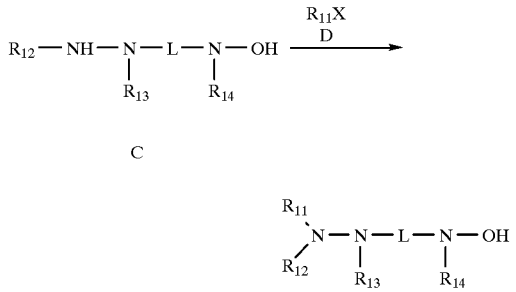

C wherein $R_{11}$, $R_{12}$, $R_{13}$, $R_{14}$ and L each has the same meaning as defined in formula (S1), and X represents a release group in the organic chemistry.

The compound represented by formula A (hereinafter referred to as "Compound A") in reaction scheme 1 is described below. When $R_{11}$ and $R_{12}$ each represents an alkyl group, Compound A may be commercially available products. For example, N,N-dimethylhydrazine is available from Wako Pure Chemical Industries Ltd. Further, Compound A can be synthesized by the alkylation of the corresponding hydrazine. As a method of alkylation, a method of substitution alkylation using alkyl halide, and a method of reduction using lithium aluminum hydride after acylation are known, and Compound A can be synthesized by referring to, for example, *Shin-Jikken Kagaku Koza* 14, *Yuki Kagobutsu no Gosei to Hanno* (III) (*New Experimental Chemistry Course* 14, *Syntheses and Reactions of Organic Compounds* (III)), compiled by Nippon Kagaku Kai, published by Maruzen, Tokyo (1977). When $R_{11}$ represents a group other than an alkyl group defined in formula (S1), Compound A can easily be synthesized by a condensation reaction of the corresponding hydrazine with the compound represented by formula D, e.g., the desired acid halide when $R_{11}$ represents an acyl group and the desired carbamoyl halide when $R_{11}$ represents a carbamoyl group.

The compound represented by formula B (hereinafter referred to as "Compound B") in reaction scheme 1 can easily be synthesized from a hydroxylamine derivative represented by $R_{14}$NHOH. For example, a corresponding compound to L═CO and X═Cl can be obtained by reacting a hydroxylamine derivative with phosgene, and a corresponding compound to L═CO and X═—OPh can be obtained by reacting a hydroxylamine derivative with phenyl chloroformate. Hydroxylamine derivatives represented by $R_{14}$NHOH are also commercially available, e.g., hydrochloride corresponding to N-methylhydroxylamine is available from Tokyo Kasei Kogyo K. K. Further, a method in which benzaldoxime is N-alkylated with halide corresponding to $R_{14}$ and hydrolyzed, and a method in which a nitro compound corresponding to $R_{14}$ is reduced with a zinc dust are known, and Compound B can be synthesized referring to, for example, *Journal of Orqanic Chemistry*, Vol. 32, page 265 (1967), *Shin-Jikken Kagaku Koza* 14, *Yuki Kagobutsu no Gosei to Hanno* (III), compiled by Nippon Kagaku Kai, published by Maruzen, Tokyo (1977), etc.

An ordinary amide bond formation reaction can be used for synthesizing compound (S1) according to the present invention from the compounds represented by formulae A and B, and *Shin-Jikken Kagaku Koza* 14, *Yuki Kagobutsu no Gosei to Hanno* (II), compiled by Nippon Kagaku Kai, published by Maruzen, Tokyo (1977), etc., can be referred to.

The synthesis method shown in synthesis route 2 can be preferably used when $R_{11}$ in formula (S1) represents a group other than an alkyl group.

The compound represented by formula C can be easily synthesized using an ordinary amide bond formation reaction as in the case of synthesizing compound (S1) from formula A and formula B. The compound represented by formula D is commercially available when $R_{11}$ represents any of an acyl group, an alkoxycarbonyl group, a carbamoyl group, a sulfonyl group, or a sulfamoyl group, for example, acetic anhydride, palmitoyl chloride and ethanesulfonyl chloride are available from Tokyo Kasei Kogyo K. K. The compound represented by formula D wherein X represents a chlorine atom is preferred in view of synthesis, and such a compound can be synthesized easily by ordinary synthesis methods in the organic chemistry and, for example, *Shin-Jikken Kagaku Koza* 14, *Yuki Kagobutsu no Gosei to Hanno* (II), compiled by Nippon Kagaku Kai, published by Maruzen, Tokyo (1977), etc., can be referred to.

Ordinary amide bond formation reaction can be used for synthesizing compound (S1) according to the present invention from the compounds represented by formulae C and D, and *Shin-Jikken Kagaku Koza* 14, *Yuki Kaqobutsu no Gosei to Hanno* (II), compiled by Nippon Kagaku Kai, published by Maruzen, Tokyo (1977), etc., can be referred to.

Specific synthesis methods of Compounds (S1-12) and (S1-20) according to the present invention are described below.

Synthesis Route of Compound (S1-12)

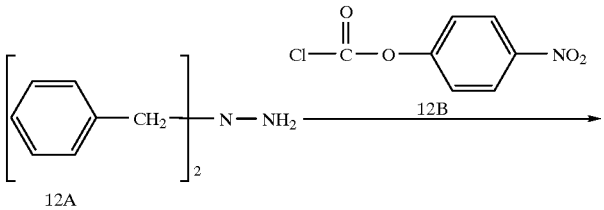

-continued

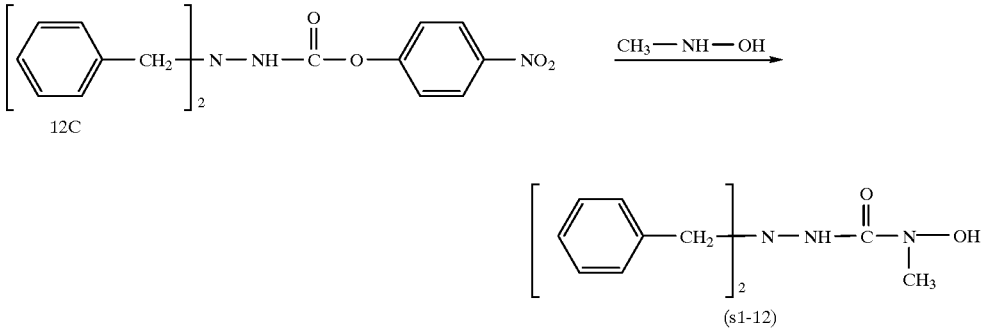

Synthesis of Compound 12C

Six hundred (600) ml of acetonitrile and 34 ml ($4.2\times10^{-1}$ mol) of pyridine were added to 75 g ($3.5\times10^{-1}$ mol) of Compound 12A. A solution obtained by adding 200 ml of acetonitrile to 75 g ($3.7\times10^{-1}$ mol) of Compound 12B was dropwise added to the above solution while stirring at about 0° C. The above solution was stirred for 1 hour at about 10° C., then poured into water, and the crystals precipitated were filtrated. The crystals filtrated were recrystallized from water-acetonitrile and 94 g of Compound 12C was obtained (yield: 71%).

Synthesis Route of Compound (S1-20)

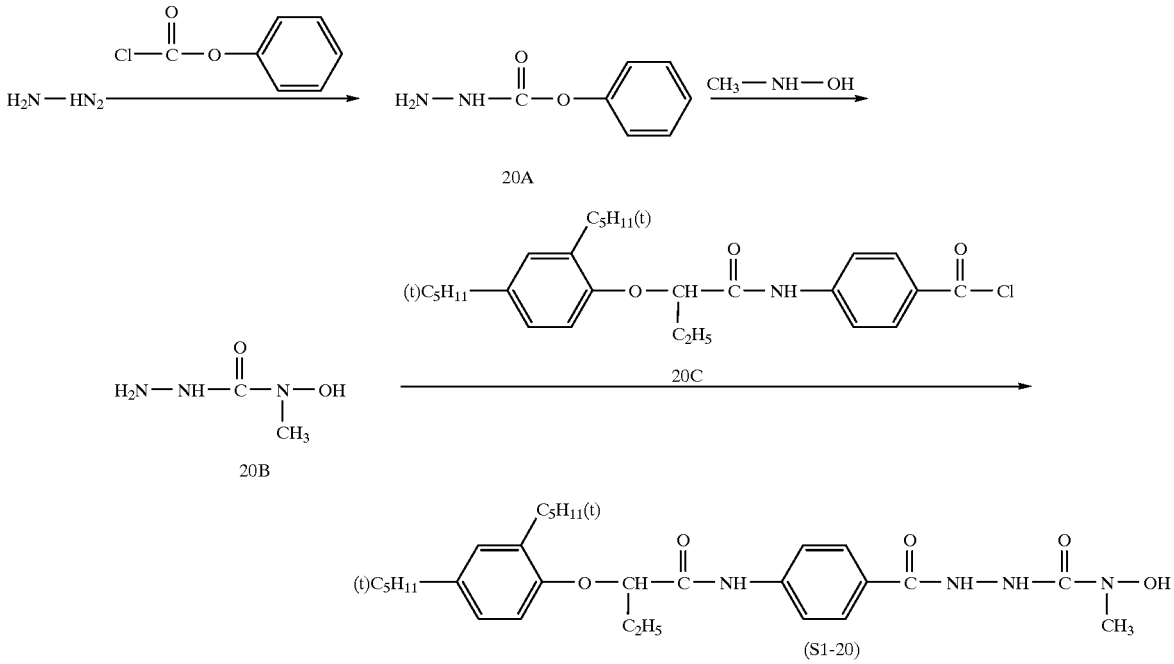

Synthesis of Compound (S1-12)

Five hundred (500) ml of acetonitrile was added to 94 g ($2.5\times10^{-1}$ mol) of Compound 12C. A solution obtained by adding 300 ml of ethanol to 23 g ($2.8\times10^{-1}$ mol) of N-methylhydroxylamine hydrochloride and to which was further added 53 g ($2.8\times10^{-1}$ mol) of a 28% methanol solution of sodium methoxide was added to the above solution while stirring at about 10° C. After the solution was stirred for 6 hours at room temperature, 300 ml of acetonitrile was added and the solvent was distilled off under reduced pressure. The residue was poured into water and extracted with ethyl acetate, dried over magnesium sulfate, and ethyl acetate was distilled off under reduced pressure. The residue was refined through a silica gel column chromatography and recrystallized from methylene chloride-hexane to obtain 44 g of Compound (S1-12) (yield: 61%). 1H-NMR (200 MHz, DMSO-d6) δ 2.85 (s, 3H), 3.96 (s, 4H), 7.1–7.5 (m, 10H), 7.90 (s, 1H), 9.28 (s, 1H). Melting point: 98–99° C.

Synthesis of Compound 20A

Four hundred (400) ml of acetonitrile and 200 ml of isopropanol were added to 243 ml (5.0 mol) of hydrazine hydrate. A solution obtained by adding 200 ml of acetonitrile to 126 ml (1.0 mol) of phenyl chloroformate was dropwise added to the above solution and the temperature of the reaction system was adjusted to be −10 to −5° C. during dropwise addition. The solution was stirred for 30 minutes as it was, then poured into 4 liters of water and insoluble substances were filtered off. The filtrate was extracted with ethyl acetate, dried over magnesium sulfate, and ethyl acetate was distilled off under reduced pressure. The residue was refined through a silica gel column chromatography to obtain 104 g (yield: 68%) of Compound 20A.

Synthesis of Compound 20B

Fifty (50) ml of isopropanol was added to 15.2 g ($1.0\times10^{-1}$ mol) of Compound 20A, then a mixed solution of 9.2 g ($1.1\times10^{-1}$ mol) of N-methylhydroxylamine hydrochloride, 22.6 ml ($1.1\times10^{-1}$ mol) of a 28% methanol solution of sodium methoxide, and 50 ml of isopropanol was added thereto. Subsequently, 15.3 ml ($1.1\times10^{-1}$ mol) of triethylamine was added thereto and the reaction solution was heated under reflux with stirring for 7 hours. After insoluble substances were filtered off, the solvent was distilled off under reduced pressure, and the residue was refined through a silica gel column chromatography to obtain 6.7 g (yield: 64%) of Compound 20B.

Synthesis of Compound (S1-20)

Seventy (70) ml of N,N-dimethylacetamide was added to 3.7 g ($3.4\times10^{-2}$ mol) of Compound 20B, then 3.6 ml ($4.3\times10^{-2}$ mol) of pyridine was added thereto. The mixture was stirred at about 0° C. and a solution obtained by adding 170 ml of acetonitrile to 15.7 g ($3.4\times10^{-2}$ mol) of Compound 20C was dropwise added thereto. The solution was stirred for 2 hours as it was, then poured into water and extracted with ethyl acetate, and after being dried over magnesium sulfate, ethyl acetate was distilled off under reduced pressure. The residue was refined through a silica gel column chromatography to obtain 16.5 g (yield: 92%) of Compound (S1-20) according to the present invention as a vitreous solid. 1H-NMR (200 MHz, DMSO-d6) δ 0.62 (t, 6H), 1.08 (t, 3H), 1.24 (s, 6H), 1.34 (s, 3H), 1.39 (s, 3H), 1.5–1.6 (m, 2H), 1.8–2.1 (m, 4H), 2.96 (s, 3H), 4.77 (t, 1H), 6.70 (d, 1H), 7.03 (d, 1H), 7.13 (s, 1H), 7.70 (d, 2H), 7.86 (d, 2H), 8.78 (s, 1H), 9.63 (s, 1H), 10.05 (s, 1H), 10.48 (s, 1H).

The compounds represented by formula (S1) can be used alone or in combination of two or more. The compounds represented by formula (S1) may be added directly to an emulsion, or may be added by dissolving in water, a water-soluble solvent such as methanol or ethanol or a mixed solvent of them, or may be added in the form of an emulsified dispersion. Further, they may be added previously at the time of preparation of an emulsion. When the compounds are added at the time of preparation of an emulsion, they may be added at any process of the preparation, for example, during the silver halide grain formation process, before the start of the desilvering process, during the desilvering process, before the start of the chemical ripening, during the chemical ripening process, or before the preparation of the finished emulsion. The compounds can be added two or more times during these processes dividedly. When the compounds are dissolved in water, if the solubility is increased with high pH or low pH, they may be dissolved with raising or lowering pH. The compounds represented by formula (S1) according to the present invention are preferably added in the form of an emulsified dispersion.

The compounds represented by formula (S1) can be used in any layer in a photographic material, that is, they can be used in any layer of light-sensitive layers (e.g., a blue-sensitive silver halide emulsion layer, a green-sensitive silver halide emulsion layer, a red-sensitive silver halide emulsion layer) or light-insensitive layers (e.g., a protective layer, a light-insensitive finely grained silver halide emulsion layer, an interlayer, a filter layer, an undercoat layer, an antihalation layer), but they are preferably used in emulsion layers. The coating amount of the compounds represented by formula (S1) is preferably from $10^{-4}$ mmol/m$^2$ to 10 mmol/m$^2$, more preferably from $10^{-3}$ mmol/m$^2$ to 1 mmol/m$^2$.

The production process of a silver halide emulsion can be classified broadly into processes of grain formation, desalting and chemical sensitization. The grain formation is divided into nucleation, ripening, growing and the like. These processes are not conducted evenly but the order is reversed in some case and one process is conducted repeatedly in another case. The present invention can be used preferably for the reduction sensitized emulsion. Reduction sensitization of silver halide emulsion can be conducted fundamentally at any stage, that is, it may be conducted at nucleation stage which is the early stage of the grain formation, at the stage of physical ripening or grain growth, or prior to chemical sensitization other than reduction sensitization or after this chemical sensitization. When chemical sensitization is conducted in combination with gold sensitization, reduction sensitization is preferably conducted prior to chemical sensitization so as not to generate unwanted fog. The most preferred method is to conduct reduction sensitization during growth of silver halide grains. Herein, "during growth of grains" means to include the method of conducting reduction sensitization in the state when silver halide grains are growing by physical ripening or by the addition of water-soluble silver salt and water-soluble alkali halide, or the method of further growing grains after reduction sensitization is conducted in the state when the growth is stopped temporarily.

The method of the reduction sensitization for use in the present invention can be selected from a method in which known reducing agents are added to a silver halide emulsion, a method in which grains are grown or ripened in the atmosphere of low pAg of from 1 to 7 which is called silver ripening, or a method in which grains are grown or ripened in the atmosphere of high pH of from 8 to 11 which is called high pH ripening. Further, two or more of these methods can be used in combination.

A method of adding a reduction sensitizer is preferred from the point of capable of delicately controlling the level of the reduction sensitization.

Stannous salt, amines and polyamines, hydrazine derivatives, formamidinesulfinic acid, silane compounds and borane compounds are well known as a reduction sensitizer. These known compounds can be selected and used in the present invention, and two or more of these compounds can also be used in combination. Stannous chloride, thiourea dioxide, and dimethylamineborane are preferred compounds as a reduction sensitizer. As the addition amount of a reduction sensitizer depends upon the production conditions of the emulsion, the addition amount needs to be selected, but $10^{-7}$ to $10^{-3}$ mol per mol of the silver halide is preferred.

Ascorbic acid and derivatives thereof can also be used as a reduction sensitizer according to the present invention.

The following compounds can be cited as specific examples of ascorbic acids and derivatives thereof (hereinafter referred to as "ascorbic acid compounds").

(A-1) L-Ascorbic acid
(A-2) Sodium L-ascorbate
(A-3) Potassium L-ascorbate
(A-4) DL-Ascorbic acid
(A-5) Sodium D-ascorbate
(A-6) L-Ascorbic acid-6-acetate
(A-7) L-Ascorbic acid-6-palmitate
(A-8) L-Ascorbic acid-6-benzoate (A-9) L-Ascorbic acid-5,6-diacetate (A-10) L-Ascorbic acid-5,6-o-isopropylidene It is preferred that the ascorbic acid compounds for use in the present invention are used in larger amount compared with the addition amount of reduction sensitizers which is the amount conventionally preferably used. For example, there are disclosed in JP-B-57-33572 (the term "JP-B" as used herein means an "examined Japanese patent publication") that "The amount of a reducing agent, in general, does not exceed $0.75\times10^{-2}$ milli-equivalent ($8\times10^{-4}$ mol/AgX mol) per gram of the silver ion. The amount of from 0.1 to 10 mg (as ascorbic acid, from $10^{-7}$ to $10^{-5}$ mol/AgX mol) per kg of the silver nitrate is in many cases effective." (calculated values are by the present inventors), in U.S. Pat. No. 2,487,850, "the addition amount of a tin compound which can be used as a reduction sensitizer is from $1\times10^{-7}$ to $44\times10^{-6}$ mol", and in JP-A-57-179835, "the appropriate addition amount of a thiourea dioxide is from about 0.01 mg to about 2 mg per mol of the silver halide, and that of a stannous chloride is from about 0.01 mg to about 3 mg per mol of the silver halide". Although the preferred addition amount of the ascorbic acid compounds for use in the present invention depends upon the grain size of the emulsion, the halogen composition, the temperature, pH and pAg of the production of the emulsion, it is preferred to select the amount from the range of from $5\times10^{-5}$ to $1\times10^{-1}$ mol, more preferably from $5\times10^{-4}$ to $1\times10^{-2}$ mol, and particularly preferably from 1×10–3 to $1\times10^{-1}$ mol, per mol of the silver halide.

Reduction sensitizers can be dissolved in water or a solvent such as alcohols, glycols, ketones, esters or amides and added during grain formation, before or after chemical sensitization. They may be added at any stage of the emulsion production process, but a method of adding them during grain growth is particularly preferred. They may be previously added to a reaction vessel but more preferably they are added at a proper stage during grain growth. Further, reduction sensitizers have been previously added to an aqueous solution of water-soluble silver salt or an aqueous solution of water-soluble alkali halide and grains can be grown using these aqueous solutions. In addition, the solution of reduction sensitizers may be divided to several parts and added in several times or may be added continuously over a long period of time with the degree of the grain growth.

It is preferred to use oxidizing agent for silver during the production process of the emulsion of the present invention. An oxidizing agent for silver is a compound having a function of acting on metal silver and converting it to a silver ion. In particular, a compound which can convert superminute silver grains by-produced in the course of the formation of silver halide grains and chemical sensitization to a silver ion is effective. The silver ion converted may form hardly water-soluble silver salt such as silver halide, silver sulfide or silver selenide, or may form easily water-soluble silver salt such as silver nitrate. An oxidizing agent for silver may be inorganic or organic. Examples of inorganic oxidizing agents include ozone, oxyacid salt, such as hydrogen peroxide and addition products thereof (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$, peroxyacid salt (e.g., $K_2S_2O_8$, $K_2C_2O_6$, $K_2P_2O_8$), a peroxy complex compound (e.g., $K_2[Ti(O_2)C_2O_4].3H_2O$, $4K_2SO_4.Ti(O_2)OH.SO_4.2H_2O$, $Na_3[VO(O_2)(C_2H_4)_2.]6H_2O$), permanganate (e.g., $KMnO_4$), and chromate (e.g., $K_2Cr_2O_7$), a halogen element such as iodine and bromine, perhalogen acid salt (e.g., potassium periodate), a salt of metal of high valency (e.g., potassium hexacyano-ferrate(III)), and thiosulfonate.

Further, examples of organic oxidizing agents include quinones such as p-quinone, organic peroxide such as peracetic acid and perbenzoic acid, a compound which releases active halogen (e.g., N-bromosuccinimide, chloramine T, chloramine B).

The oxidizing agents which are preferably used in the present invention are inorganic oxidizing agents such as ozone, hydrogen peroxide and addition products thereof, a halogen element, and thiosulfinate, and organic oxidizing agents such as quinones. It is preferred to use the above-described reduction sensitization in combination with an oxidizing agent for silver. The method of usage can be selected from a method in which an oxidizing agent is used and then reduction sensitization is carried out, an inverse method thereof, or a method in which both are concurred with. These methods can be used selectively in a grain formation process or in a chemical sensitization process.

Oxidizing agents which are particularly preferably used in the present invention are selected from the compounds represented by the following formula (XX), (XXI) or (XXII):

$$R_{101}—SO_2S—M_{101} \quad (XX)$$

$$R_{101}—SO_2S—R_{102} \quad (XXI)$$

$$R_{101}—SO_2S-(E)_a-SSO_2—R_{103} \quad (XXII)$$

wherein $R_{101}$, $R_{102}$ and $R_{103}$ each represents an aliphatic group, an aryl group or a heterocyclic group, $M_{101}$ represents a cation, E represents a divalent linking group, and a represents 0 or 1.

Formulae (XX), (XXI) and (XXII) are described in detail below.

When $R_{101}$, $R_{102}$ and $R_{103}$ each represents an aliphatic group, the aliphatic group is preferably an alkyl group having from 1 to 22 carbon atoms, an alkenyl group having from 2 to 22 carbon atoms, or an alkynyl group, and these groups may be substituted. Examples of alkyl groups include, e.g., methyl, ethyl, propyl, butyl, pentyl, hexyl, octyl, 2-ethylhexyl, decyl, dodecyl, hexadecyl, octadecyl, cyclohexyl, isopropyl and t-butyl.

Examples of alkenyl groups include, e.g., allyl and butenyl.

Examples of alkynyl groups include, e.g., propargyl and butynyl.

When $R_{101}$, $R_{102}$ and $R_{103}$ each represents an aryl group, the aryl group is preferably an aryl group having from 6 to 20 carbon atoms, e.g., phenyl and naphthyl. These groups may be substituted.

When $R_{101}$, $R_{102}$ and $R_{103}$ each represents a heterocyclic group, the heterocyclic group is a 3 to 15-membered ring having at least one element selected from nitrogen, oxygen, sulfur, selenium or tellurium. Examples of heterocyclic rings include, e.g., a pyrrolidine ring, a piperidine ring, a pyridine ring, a tetrahydrofuran ring, a thiophene ring, an oxazole ring, a thiazole ring, an imidazole ring, a benzothiazole ring, a benzoxazole ring, a benzimidazole ring, a selenazole ring, a benzoselenazole ring, a tetrazole ring, a triazole ring, a benzotriazole ring, a tetrazole ring, an oxadiazole ring, and a thiadiazole ring.

Examples of substituents for $R_{101}$, $R_{102}$ and $R_{103}$ include, e.g., an alkyl group (e.g., methyl, ethyl, hexyl), an alkoxyl group (e.g., methoxy, ethoxy, octyloxy), an aryl group (e.g., phenyl, naphthyl, tolyl), a hydroxyl group, a halogen atom (e.g., fluorine, chlorine, bromine, iodine), an aryloxy group (e.g., phenoxy), an alkylthio group (e.g., methylthio, butylthio), an arylthio group (e.g., phenylthio), an acyl group (e.g., acetyl, propionyl, butyryl, valeryl), a sulfonyl group (e.g., methylsulfonyl, phenylsulfonyl), an acylamino group (e.g., acetylamino, benzamino), a sulfonylamino group (e.g., methanesulfonylamino, benzenesulfonylamino), an acyloxy group (e.g., acetoxy, benzoxy), a carboxyl group, a cyano group, a sulfo group, and an amino group.

E preferably represents a divalent aliphatic group or a divalent aromatic group. Examples of divalent aliphatic groups represented by E include, e.g., $—(CH_2)_n—$ (n is from 1 to 12), $—CH_2—CH{=}CH—CH_2—$,

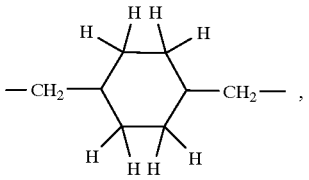

$—CH_2C{\equiv}C—CH_2—$ a xylylene group, etc. Examples of divalent aromatic groups represented by E include, e.g., phenylene and naphthylene.

$M_{101}$, preferably represents a metal ion or an organic cation. Examples of metal ions include a lithium ion, a sodium ion, and a potassium ion. Examples of organic cations include an ammonium ion (e.g., ammonium, tetramethylammonium, tetrabutylammonium), a phosphonium ion (e.g., tetraphenylphosphonium), a guanidine group, etc.

Specific examples of the compounds represented by formula (XX), (XXI) or (XXII) are shown below, but the present invention is not limited to these compounds.

$CH_3SO_2SNa$ (XX-1)

$C_2H_5CO_2SNa$ (XX-2)

$C_3H_7SO_2SK$ (XX-3)

$C_4H_9SO_2SLi$ (XX-4)

$C_6H_{13}SO_2SNa$ (XX-5)

$C_8H_{17}SO_2SNa$ (XX-6)

(XX-7)

$CH_3(CH_2)_3CH(C_2H_5)CH_2SO_2S{\cdot}NH_4$ $C_{10}H_{21}SO_2SNa$ (XX-8)

$C_{12}H_{25}SO_2SNa$ (XX-9)

$C_{16}H_{33}SO_2SNa$ (XX-10)

(XX-11)

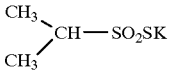

$t\text{-}C_4H_9SO_2SNa$ (XX-12)

$CH_3OCH_2CH_2SO_2S{\cdot}Na$ (XX-13)

(XX-14)

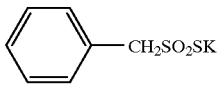

$CH_2{=}CHCH_2SO_2SNa$ (XX-15)

-continued (XX-16)

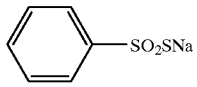

(XX-17)

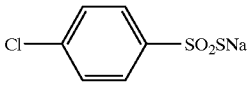

(XX-18)

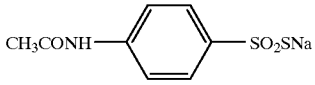

(XX-19)

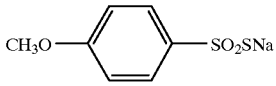

(XX-20)

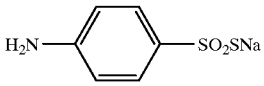

(XX-21)

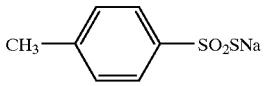

(XX-22)

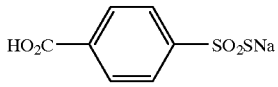

(XX-23)

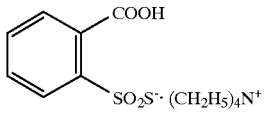

(XX-24)

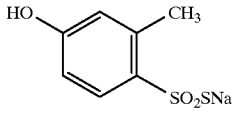

(XX-25)

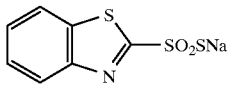

(XX-26)

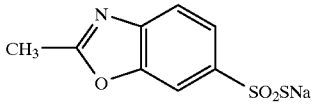

(XX-27)

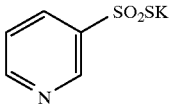

(XX-28)

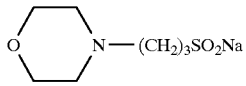

$KSSO_2(CH_2)_2SO_2SK$ (XX-29)

-continued
$NaSSO_2(CH_2)_4SO_2SNa$ (XX-30)
$NaSSO_2(CH_2)_4S(CH_2)_4SO_2SNa$ (XX-31)
(XX-32)
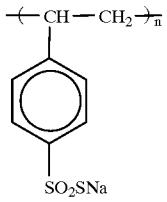
(XX-33)
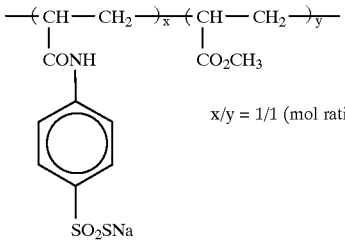
x/y = 1/1 (mol ratio)
(XXI-1)
$C_2H_5SO_2S—CH_3$
(XXI-2)
$C_8H_{17}SO_2SCH_2CH_3$
(XXI-3)
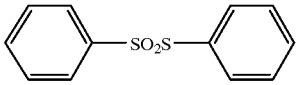
(XXI-4)
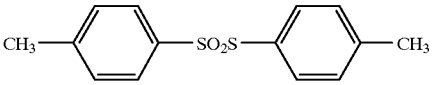
(XXI-5)
$C_2H_5SO_2SCH_2CH_2CN$
(XXI-6)
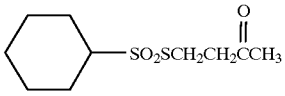
(XXI-7)
$C_4H_8SO_2SCH(CH_3)CH_2CN$
(XXI-8)
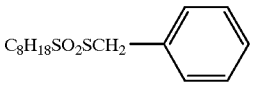
(XXI-9)
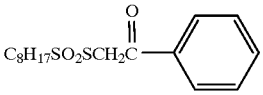
-continued
(XXI-10)
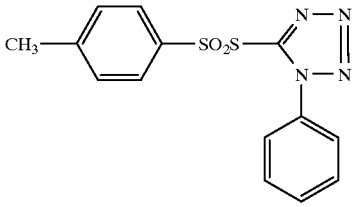
(XXI-11)
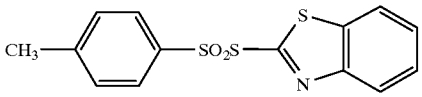
(XXI-12)
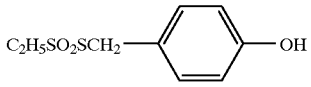
(XXI-13)
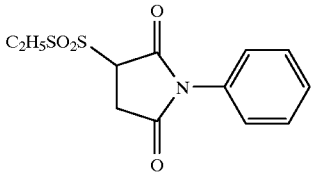
(XXI-14)
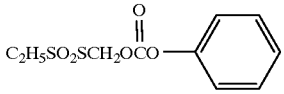
(XXI-15)
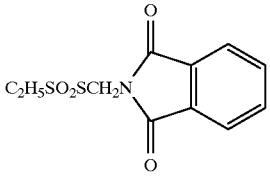
(XXI-16)
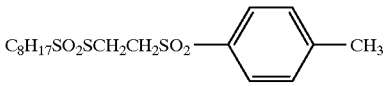
(XXI-17)
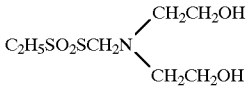
(XXI-18)
$C_2H_5SO_2SCH_2CH_2CH_2CH_2OH$
(XXI-19)
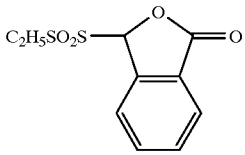
(XXI-20)
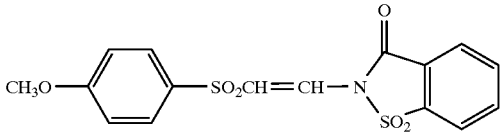

-continued (XXI-21)

$CH_3SSO_2(CH_2)_4SO_2SCH_3$ (XXI-22)

$CH_3SSO_2(CH_2)_2SO_2SCH_3$ (XX1-23)

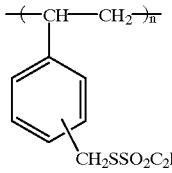

(XX1-24)

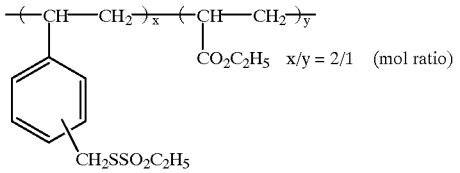

(XX1-25)

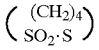

(XX11-1)

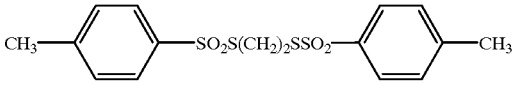

(XX11-2)

$C_2H_5SO_2SCH_2CH_2SO_2CH_2CH_2SSO_2C_2H_5$ (XX11-3)

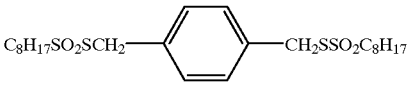

(XX11-4)

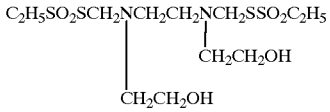

(XX11-5)

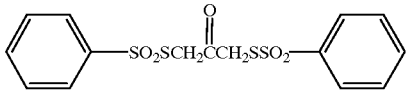

(XX11-6)

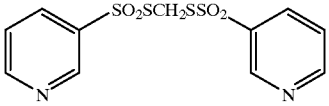

(XX11-7)

$C_2H_5SO_2SSSO_2C_2H_5$ (XX11-8)

$(n)C_3H_{17}SO_2SSSO_2C_3H_7(n)$ (XX11-9)

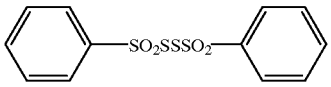

The compound represented by formula (XX) can be easily synthesized according to the methods disclosed in JP-A-54-1019 and British Patent 972,211.

The compound represented by formula (XX), (XXI) or (XXII) is preferably added in an amount of from $10^{-7}$ to $10^{-1}$ mol, more preferably from $10^{-6}$ to $10^{-2}$ mol, and particularly preferably from $10^{-5}$ to $10^{-3}$ mol, per mol of the silver halide.

For adding the compound represented by formula (XX), (XXI) or (XXII) to an emulsion during the production process thereof, methods usually used for adding additives to a photographic emulsion can be used. For example, a compound which is soluble in water is added as an aqueous solution having proper concentration, and a compound which is insoluble or hardly soluble in water is dissolved in an appropriate organic solvent which is miscible with water and does not adversely affect photographic properties selected from alcohols, glycols, ketones, esters or amides, and added as a solution.

The compound represented by formula (XX), (XXI) or (XXII) can be added to an emulsion at any stage such as during the grain formation of a silver halide emulsion, before or after chemical sensitization. The compound is preferably added after reduction sensitization has been conducted or during reduction sensitization is being conducted. The compound is particularly preferred added during grain growing.

The compound may be previously added to a reaction vessel but it is more preferred to be added at an appropriate stage during grain formation. Further, the compound represented by formula (XX), (XXI) or (XXII) has been previously added to an aqueous solution of water-soluble silver salt or an aqueous solution of water-soluble alkali halide and grains can be grown using these aqueous solutions. In addition, the solution of the compound represented by formula (XX), (XXI) or (XXII) may be divided to several parts and added in several times or may be added continuously over a long period of time with the degree of the grain growth.

Of the compounds represented by formula (XX), (XXI) or (XXII), the compounds represented by formula (XX) are most preferably used in the present invention.

The silver halide emulsion for use in the present invention is preferably gold-chalcogen sensitized. Chalcogen sensitization is conducted using at least one of a selenium sensitizer, a sulfur sensitizer and a tellurium sensitizer.

Selenium sensitization is conducted according to conventional methods. That is, in general, selenium sensitization is carried out by adding an unstable selenium compound and/or a non-unstable selenium compound to an emulsion and stirring the emulsion for a predetermined period of time at high temperature, preferably at 40° C. or more. The selenium sensitization using unstable selenium sensitizers disclosed in JP-B-44-15748 are preferably used in the present invention. Specific examples of unstable selenium sensitizers include aliphatic isoselenocyanates, e.g., allylisoselenocyanate, selenoureas, seleno ketones, selenoamides, selenocarboxylic acids, seleno esters, and selenophosphates. Particularly preferred unstable selenium compounds are described below.

I. Colloidal Metal Selenium

II. Organic Selenium Compound (selenium atom is double bonded to the carbon atom of an organic compound by covalent bonding)

a. Isoselenocyanates

For example, aliphatic isoselenocyanates such as allylisoselenocyanate.

b. Selenoureas (including an enol type)

For example, aliphatic selenourea having one or more aliphatic group(s) such as methyl, ethyl, propyl, isopropyl, butyl, hexyl, octyl, dioctyl, tetraoctyl, N-(β-carboxyethyl)-N',N'-dimethyl, N,N-dimethyl, diethyl, and dimethyl; aromatic selenourea having one or more aromatic group(s) such as phenyl or tolyl; and heterocyclic selenourea having a heterocyclic group such as pyridyl and benzothiazolyl.

c. Selenoketones

For example, selenoacetone, selenoacetophenone, selenoketone having an alkyl group bonded to >C=Se, and selenobenzophenone.

d. Selenoamides

For example, selenoacetamide.

e. Selenocarboxylic acids and esters

For example, 2-selenopropionic acid, 3-selenobutyric acid and methyl-3-selenobutyrate.

III. Others a. Selenides

For example, diethylselenide, diethyldiselenide and triphenylphosphineselenide.

b. Selenophosphates

For example, tri-p-tolylselenophosphate and tri-n-butylselenophosphate.

Preferred types of unstable selenium compounds are described above but they are not limitative. The structure of the unstable type selenium compound as a sensitizer for a photographic emulsion is not important for one skilled in the art as long as the selenium is unstable. It is generally understood that the organic moiety of a selenium sensitizer molecule has no role except for carrying selenium and allowing it to be present in an emulsion in an unstable form. Unstable selenium compounds having such a broad idea are advantageously used in the present invention.

Selenium sensitization using the non-unstable selenium compounds disclosed in JP-B-46-4553, JP-B-52-34491 and JP-B-52-34492 is also used in the present invention. Examples of the non-unstable selenium compounds include, e.g., selenious acid, potassium selenocyanide, selenazoles, quaternary ammonium salts of selenazoles, diaryl selenide, diaryl diselenide, 2-thioselenazolidinedione, 2-selenooxazolidinethione, and derivatives thereof.

The thioselenazolidinedione compounds disclosed in JP-B-52-38408 which are non-unstable selenium sensitizers are also useful in the present invention.

These selenium sensitizers are dissolved in water, or a single or a mixed solvent of an organic solvent such as methanol and ethanol and added at the time of chemical sensitization, preferably added before the start of chemical sensitization. A selenium sensitizer used is not limited to one kind, and two or more of the above-described selenium sensitizers can be used in combination. The combined use of unstable selenium compounds and non-unstable selenium compounds is particularly preferred.

The addition amount of a selenium sensitizer for use in the present invention is varied depending on the degree of activity of the selenium sensitizer used, the kind and size of the silver halide and the temperature and time of ripening, but is preferably $1\times10^{-8}$ mol or more, more preferably from $1\times10^{-7}$to $1\times10^{-4}$ mol, per mol of the silver halide. The temperature of chemical ripening when a selenium sensitizer is used is preferably 45° C. or more, more preferably from 50° C. to 80° C. pAg and pH are arbitrary. For example, the effect of the present invention can be obtained at a broad pH range of from 4 to 9.

Selenium sensitization is more advantageously conducted in the presence of a silver halide solvent.

Silver halide solvents which can be used in the present invention include (a) the organic thioethers disclosed in U.S. Pat. Nos. 3,271,157, 3,531,289, 3,574,628, JP-A-54-1019 and JP-A-54-158917, (b) the thiourea derivatives disclosed in JP-A-53-82408, JP-A-55-77737 and JP-A-55-2982, (c) the silver halide solvents having the thiocarbonyl group between an oxygen or sulfur atom and a nitrogen atom disclosed in JP-A-53-144319, (d) the imidazoles disclosed in JP-A-54-100717, (e) sulfite, and (f) thiocyanate.

Particularly preferred silver halide solvents are thiocyanate and tetramethylthiourea. The amount of the solvent used is varied depending on the kind of the solvent, for example, thiocyanate is preferably used in an amount of from $1\times10^{-4}$ mol to $1\times10^{-2}$ mol per mol of the silver halide.

Sulfur sensitization is usually carried out by adding a sulfur sensitizer and stirring the emulsion for a predetermined period of time at high temperature, preferably 40° C. or more.

Gold sensitization is usually carried out by adding a gold sensitizer and stirring the emulsion for a predetermined period of time at high temperature, preferably 40° C. or more.

Known sulfur sensitizers can be used for the above sulfur sensitization, for example, thiosulfate, allyl thiocarbamidothiourea, allyl isothiocyanate, cystine, p-toluenethiosulfonate, and rhodanine. In addition to the above, the sulfur sensitizers disclosed in U.S. Pat. Nos. 1,547,944, 2,410,689, 2,278,947, 2,728,668, 3,501,313, 3,656,955, German Patent 1,422,868, JP-B-56-24937 and JP-A-55-45016 can also be used. The addition amount of a sulfur sensitizer may be sufficient to effectively increase the sensitivity of the emulsion. The addition amount varies in a considerably wide range according to various conditions such as the pH, temperature and the size of the silver halide grain but is preferably from $1\times10^{-7}$ mol to $1\times10^{-4}$ mol per mol of the silver halide.

The oxidation number of the gold sensitizers for gold sensitization of the present invention may be monovalent or trivalent and gold compounds which are usually used as gold sensitizers can be used. Representative examples thereof include chloroaurate, potassium chloroaurate, auric trichloride, potassium auric thiocyanate, potassium iodoaurate, tetracyanoauric acid, ammonium aurothiocyanate, and pyridyl trichloro-gold.

The addition amount of a gold sensitizer varies according to various conditions but is preferably from $1\times10^{-7}$ to $1\times10^{-4}$ mol per mol of the silver halide as a criterion.

Gold-chalcogen sensitization is conducted by selecting any combination of gold-sulfur sensitization, gold-selenium sensitization, gold-tellurium sensitization, gold-sulfur-selenium sensitization, gold-sulfur-tellurium sensitization, gold-selenium-tellurium sensitization or gold-sulfur-selenium-tellurium sensitization.

The emulsion for use in the present invention is a tabular silver halide grain emulsion preferably having an aspect ratio of 3 or more, more preferably 5 or more. Here, a tabular silver halide grain is a general name for grains having one twin plane or two or more twin planes parallel to each other. In this case, when ions at all the lattice points at both sides of {111} plane are in enantiomer relationship, the twin plane means this {111} plane. A tabular grain when viewed from the above is, in general, in a triangular shape, a hexagonal shape, or a circular shape which is a rounded triangular or hexagonal shape, and a triangular shape has triangular, a hexagonal shape has hexagonal and a circular shape has circular outer surfaces parallel to each other.

The aspect ratio of a tabular grain for use in the present invention is defined as the value obtained by dividing the diameter of a grain by the thickness of each grain with respect to a grain having the grain diameter of 0.1 $\mu$m or more. The thickness of a grain can be measured easily by vacuum evaporating a metal from the oblique direction to a grain together with a latex for reference, measuring the length of the shadow from the electron microphotograph, and calculating the thickness by referring to the length of the shadow of the latex.

The grain diameter in the present invention is the diameter of a circle having the equal area to the projected area of the parallel outer surfaces of a grain.

The term "equivalent-circle diameter" as used hereinafter means a diameter of a circle having the same area as the projected area of a grain. The term "equivalent-sphere diameter" as used hereinafter means a diameter of a sphere having the same volume as the volume of a grain.

The projected area of a grain can be obtained by measuring the area from the electron microphotograph and compensating for the magnification.

The grain diameter of a tabular grain is preferably from 0.15 to 5.0 $\mu$m and the thickness is preferably from 0.05 to 1.0 $\mu$m.

The average aspect ratio is obtained as the arithmetic mean of the aspect ratio of each grain with respect to at least 100 silver halide grains. Further, the average aspect ratio can be obtained as the ratio of the average grain diameter to the average thickness.

The emulsion for use in the present invention preferably contains tabular silver halide grains having an aspect ratio of 3 or more, more preferably 5 or more, and preferably such tabular silver halide grains occupy 60% or more of the entire projected area.

The proportion of tabular grains is preferably 60% or more, particularly preferably 80% or more, of the entire projected area.

When monodisperse tabular grains are used, further preferred results can be obtained in some cases. The grain structure and the preparation method of monodisperse tabular grains are according to, for example, the disclosure in JP-A-63-151618. The shape of monodisperse tabular grains is described briefly. Monodisperse tabular grains are grains in which 70% or more of the entire projected area of silver halide grains are occupied by hexagonal tabular silver halide grains having the ratio of the length of the side having the longest length to the length of the side having the shortest length of 2 or less, and having two planes parallel to each other as outer surfaces, and, further, the variation coefficient of the grain size distribution of the hexagonal tabular silver halide grains [the value obtained by dividing the grain size distribution (standard deviation) represented by the diameter of the circle corresponding to the projected area by the average grain size] is 20% or less of monodispersibility.

Further, the emulsion grains of the present invention preferably have dislocation lines. The dislocation lines of tabular grains can be observed directly with the transmission type electron microscope at low temperature as disclosed, for example, in J. F. Hamilton, *Phot. Sci. Eng.*, 11, 57 (1967) and T. Shiozawa, *J. Soc. Phot. Sci. Japan*, 35, 213 (1972). That is, the silver halide grains taken out from the emulsion with a care so as not to apply such a pressure as generates dislocation lines on the grains are put on a mesh for observation by an electron microscope, and observation is conducted by a transmission method with the sample being in a frozen state so as to prevent the injury by an electron beam (e.g., printout). At this time, the thicker the thickness of the grain, the more difficult is the electron beam to be transmitted. Accordingly, it is preferred to use a high pressure type electron microscope (200 kV or more with the grains of the thickness of 0.25 $\mu$m) for observing clearly. When viewed from the vertical direction to the major face of the grain by the photograph of the grains obtained as described above, the place and the number of dislocation lines with respect to each grain can be obtained.

The number of dislocation lines is preferably 10 or more per one grain on an average, more preferably 20 or more. In the case where dislocation lines exist densely or when dislocation lines are observed mingling with each other, the number of dislocation lines per one grain sometimes cannot be counted rightly. However, even in such a case, it is feasible to count roughly such as about 10, about 20, about 30, and can be clearly distinguished from the case where there are only several. The average number of dislocation lines per one grain is obtained as the number average by counting the number of dislocation lines of 100 grains or more.

Dislocation lines can be introduced, for example, in the vicinity of the periphery of a tabular grain. In this case, dislocation lines are almost vertical to the periphery. Dislocation line originates from the position of x % of the length of the distance from the center to the periphery of a tabular grain and lead to the periphery. This x value is preferably 10 or more and less than 100, more preferably 30 or more and less than 99, and most preferably 50 or more and less than 98. At this time, the shape formed by linking these positions where dislocation lines originate is near the like figure of the shape of a grain but not the complete like figure and is sometimes distorted. These types of dislocation lines cannot be seen in the central region of a grain. The directions of these dislocation lines are about {211} directions crystallographically, but they are sometimes snaking or mingling with each other.

A tabular grain may have dislocation lines on the entire periphery almost uniformly, or may have dislocation lines locally on the periphery. That is, taking a hexagonal tabular silver halide grain as an example, dislocation lines may be limited to be introduced only in the vicinity of six vertexes, or may be limited to only the vicinity of one vertex. On the contrary, it is possible to limit the introduction of dislocation lines only to the sides exclusive of the vicinity of six vertexes.

Further, dislocation lines may be formed over the region inclusive of the center part of two major faces parallel to each other of a tabular grain. When dislocation lines are formed over the entire region of the major faces, when viewed from the vertical direction to the major face of the grain, the directions of these dislocation lines are sometimes about {211} directions crystallographically, but there are other cases such as in which the directions of dislocation lines are {110} directions or formed at random. Further, the length of each dislocation line is also variously different and there are a case where dislocation lines are observed on the major faces as short lines and a case where dislocation lines are observed as long lines arriving to the side (periphery). Dislocation lines are sometimes straight lines and sometimes snaking. Further, in many cases, they are mingling with each other.

As described above, positions of dislocation lines may be limited to the periphery, major faces or local positions, or may be formed in combinations of these. That is, they may be present on the periphery and major faces at the same time.

Dislocation lines can be introduced to the periphery of a tabular grain by providing a specific high silver iodide content layer in the interior of the grain. Here, a high silver iodide content layer includes the case of providing high silver iodide content regions discontinuously. Specifically, a grain as a substrate is prepared, then a high silver iodide content layer is provided on the substrate grain and the outside thereof is covered with a layer having a lower silver iodide content than that of the high silver iodide content layer. The silver iodide content of the substrate tabular grain is lower than that of the high silver iodide content layer, preferably from 0 to 20 mol % and more preferably from 0 to 15 mol %.

A high silver iodide content layer in the interior of a grain means a silver halide solid solution containing silver iodide. In this case, silver iodide, silver iodobromide, or silver chloroiodobromide is preferred as silver halide, and silver iodide or silver iodobromide (a silver iodide content: from 10 to 40 mol %) is more preferred. The high silver iodide content layers in the interior of a grain (hereinafter referred to as an internal high silver iodide content layer) can be selectively provided on either the sides or the corners of the substrate grain by controlling the growing conditions of the substrate grain and the growing conditions of the internal high silver iodide content layer. As the growing conditions of the substrate grain, pAg (the logarithm of the reciprocal of the silver ion concentration) the presence or absence, the kind and the amount of a silver halide solvent and the temperature are important factors. If the pAg at the time of growing of the substrate grain is 8.5 or less, preferably 8 or less, the internal high silver iodide content layer can be selectively present in the vicinity of the vertex of the substrate grain. On the contrary, if the pAg at the time of growing of the substrate grain is 8.5 or more, preferably 9 or more, the internal high silver iodide content layers can be present on the sides of the substrate grain. These threshold values of pAg are varied up and down by the temperature and the presence or absence, the kind and the amount of a silver halide solvent. When thiocyanate is used as a silver halide solvent, this threshold value of pAg shifts to the higher value. The particularly important pAg at the time of growing is the pAg at the final stage of the growing of the substrate grain. On the other hand, even if the pAg at the time of growing does not satisfy the above values, the selective position of the internal high silver iodide content layer can be controlled by adjusting the pAg to the above pAg values after the growth of the substrate grain and ripening. At this time, ammonia, amine compounds, and thiocyanate are effective as a silver halide solvent. For the formation of the internal high silver iodide content layer, the so-called conversion methods can be used. As one conversion method, there is a method of adding in the course of grain formation a halide ion having smaller solubility of salt for forming a silver ion than that of the halide ion which forms the grain or the vicinity of the surface of the grain at that time, but it is preferred in the present invention that the amount of the halide ion having smaller solubility added to the surface area at that time should be a certain amount or more (concerned with the halogen composition). For example, in the course of grain formation, it is preferred to add a certain amount or more of KI to the surface area of AgBr grain at that time. Specifically, it is preferred to add $8.2\times10^{-5}$ mol/$m^2$ or more of an iodide.

A more preferred forming method of an internal high silver iodide content layer is a method in which the addition of an aqueous solution of halide containing an iodide is conducted at the same time with the addition of an aqueous solution of silver salt.

For example, an aqueous solution of KI is added at the same time with an aqueous solution of $AgNO_3$ by a double jet method. At this time, the starting time and the terminating time of the addition of an aqueous solution of KI and those of an aqueous solution of $AgNO_3$ may not be the same. The molar ratio of the addition of an aqueous solution of $AgNO_3$ to an aqueous solution of KI is preferably 0.1 or more, more preferably 0.5 or more, and still more preferably 1 or more. The total addition mol amount of an aqueous solution of $AgNO_3$ to the amount of a halide ion and an iodide ion added in the reaction system may be a silver excess region. The pAg at the time of the addition of an aqueous solution of halide containing an iodide ion and the addition of an aqueous solution of silver salt by a double jet method is preferably reduced with the progress of the addition time. The pAg before the start of addition is preferably from 6.5 to 13 and more preferably from 7.0 to 11. The pAg at the time of termination of addition is most preferably from 6.5 to 10.0.

When conducting the above method, the solubility of the silver halide in the reaction mixture is preferably as small as possible. Accordingly, the temperature of the reaction mixture when a high silver iodide content layer is formed is preferably from 30° C. to 70° C. and more preferably from 30° C. to 50° C.

The formation of an internal high silver iodide content layer is conducted most preferably by the addition of fine grained silver iodide (fine silver iodide, hereinafter the same), fine grained silver iodobromide, fine grained silver chloroiodide or fine grained silver chloroiodobromide, particularly preferably fine grained silver iodide. The grain sizes of these fine grains are generally from 0.01 μm to 0.1 μm, but fine grains of the grain sizes of 0.01 μm or less or 0.1 μm or more can also be used. With respect to preparation methods of these fine grained silver halide grains, JP-A-1-183417, JP-A-2-44335, JP-A-1-183644, JP-A-1-183645, JP-A-2-43534 and JP-A-2-43535 can be referred to. An internal high silver iodide content layer can be provided by adding these fine grained silver halide grains and ripening. When these fine grains are dissolved by ripening, the above-described silver halide solvents can be used. All of these fine grains added are not necessarily immediately dissolved and vanished, it is sufficient that they should be dissolved and vanished when the final grain is completed.

The silver iodide content of the outer layer covering an internal high silver iodide content layer is lower than that of the high silver iodide content layer, preferably from 0 to 30 mol %, more preferably from 0 to 20 mol %, and most preferably from 0 to 10 mol %. This internal high silver iodide content layer is preferably positioned within the range of from 5 to less than 100 mol %, more preferably from 20 to less than 95 mol %, and particularly preferably within the range of from 50 to less than 90 mol %, based on the silver amount of the entire grain, measured from the center of the hexagon or the like of the projected silver halide grain. The content of the silver halide forming the internal high silver iodide content layer is 50 mol % or less, more preferably 20 mol % or less, of the silver amount of the entire grain calculated in terms of silver. These contents with respect to a high silver iodide content layer are the prescription values of the production of a silver halide emulsion and not values obtained by measuring the halogen composition of final grains by various analyzing methods. Internal high silver iodide content layers are often vanished through recrystallization process and the like out of the final grain and the above are all concerning the production method thereof.

Accordingly, dislocations lines in the final grain can be observed easily by the above-described method but the internal high silver iodide content layer which is provided for the purpose of introducing dislocation lines cannot be ascertained as a clear layer in many cases, for example, in some cases the entirety of the peripheral region of the tabular grain is observed as a high silver iodide content layer. The halogen composition of grains can be confirmed by various methods in combination, for example, X-ray diffraction, an EPMA method (XMA by another name) (a method of scanning a silver halide grain with an electron beam and detecting the silver halogen composition), an ESCA method (XPS by another name) (a method of X-raying a grain and spectral-analyzing the photoelectron coming out from the surface of the grain).

The temperature and pAg when the outer layer covering an internal high silver iodide content layer is formed are arbitrary, but the temperature is preferably from 30° C. to 80° C. and most preferably from 35° C. to 70° C., and the pAg is preferably from 6.5 to 11.5. The above-described silver halide solvents are preferably used in some cases. The most preferred silver halide solvent is thiocyanate.

For the introduction of dislocation lines on the major faces of a tabular grain, after a grain as a substrate is formed, silver halo-chloride is deposited on the major faces, the silver halo-chloride is converted to form high silver bromide or high silver iodide layers, and the outsides thereof are covered with shells. As silver halo-chloride, silver chloride, or silver chlorobromide or silver chloroiodobromide containing 10 mol % or more, preferably 60 mol % or more, of silver chloride content can be cited. Silver halo-chloride can be deposited on the major faces of a substrate grain by the addition of an aqueous solution of silver nitrate and an aqueous solution of appropriate alkali metal salt (e.g., potassium chloride) separately or simultaneously, or silver halo-chloride can also be deposited by adding emulsions comprising these silver salts and ripening. It is possible for silver halo-chloride to be deposited at any pAg range but most preferably at pAg of from 5.0 to 9.5. In this method, a tabular grain grows mainly in the direction of the thickness. The amount of the silver halo-chloride layers is preferably from 1 mol % to 80 mol %, more preferably from 2 mol % to 60 mol %, in mol % calculated in terms of silver, based on the amount of the substrate grain. Dislocation lines can be introduced on the major faces of a tabular grain by converting the silver halo-chloride layers with an aqueous solution of halide which can produce silver salt having lower solubility than that of silver halo-chloride. For example, by converting the silver halo-chloride layers with an aqueous solution of KI, then growing shells, the final grain can be obtained. The halogen conversion of the silver halo-chloride layers does not necessarily mean that the entire amount of the silver halo-chloride is replaced with silver salt having the lower solubility than that of the silver halo-chloride but preferably 5% or more, more preferably 10% or more, and most preferably 20% or more, of the silver halo-chloride is replaced with silver salt having lower solubility. Dislocation lines can be introduced locally on the major faces of a tabular grain by controlling the halogen composition of the substrate grain on which silver halo-chloride layers are provided. For example, when using an internal high silver iodide content substrate grain displaced in the transverse direction from the substrate tabular grain, it is possible to introduce dislocation lines only on the peripheral parts of the major faces exclusive of the central parts of the major faces. Further, when using an external high silver iodide content substrate grain displaced in the transverse direction from the substrate tabular grain, it is possible to introduce dislocation lines only on the central parts of the major faces exclusive of the peripheral parts. Moreover, by depositing silver halo-chloride only in a limited area using the locally predominant substance of epitaxial growth of silver halo-chloride, e.g., an iodide, dislocation lines can be introduced in that part only. The temperature at the time of deposition of silver halo-chloride is preferably from 30° C. to 70° C., more preferably from 30° C. to 50° C. After the deposition of silver halo-chloride, conversion is carried out, thereafter a shell can be grown, alternatively, after the deposition of silver halo-chloride, halide conversion can be conducted simultaneously with carrying out growing of a shell.

The internal silver halo-chloride layers which are formed almost parallel to major faces are preferably positioned within the range of from 5 to less than 100 mol %, more preferably from 20 to less than 95 mol %, and particularly preferably within the range of from 50 to less than 90 mol %, based on the silver amount of the entire grain, from the center of the thickness of the grain to both sides.

The content of silver iodide of the shell is preferably from 0 to 30 mol %, more preferably from 0 to 20 mol %. The temperature and pAg when the shell is formed are arbitrary, but the temperature is preferably from 30° C. to 80° C. and most preferably from 35° C. to 70° C., and the pAg is preferably from 6.5 to 11.5. In some cases the above-described silver halide solvents are preferably used. The most preferred silver halide solvent is thiocyanate. In the final grain, the internal silver halo-chloride layer subjected to halogen conversion cannot be ascertained in some cases by the above-described analyzing method depending on the conversion conditions, such as the degree of conversion or the like, but dislocations lines can be observed clearly.

Dislocation lines can be introduced by the optional combination of this method of introducing dislocation lines on arbitrary positions of the major faces of a tabular grain and the above-described method of introducing dislocation lines on arbitrary positions of the periphery of a tabular grain.

Any silver halide such as silver bromide, silver iodobromide, silver iodochlorobromide and silver chlorobromide can be used in the silver halide emulsion which can be used in combination in the present invention. A preferred silver halide is silver iodobromide or silver iodochlorobromide containing 30 mol % or less of silver iodide.

Tabular grains for use in the present invention can be prepared easily according to the methods disclosed in Cleve, *Photography Theory and Practice*, page 131 (1930), Gutoff, *Photographic Science and Engineering*, Vol. 14, pages 248 to 257 (1970), U.S. Pat. Nos. 4,434,226, 4,414,310, 4,433,048, 4,439,520 and British Patent 2,112,157.

A silver halide emulsion is generally chemical-sensitized. For chemical sensitization, the methods disclosed in H. Frieser compiled, *Die Grundlagen der Photographischen Prozesse mit Silverhalogeniden*, pages 675 to 734, Akademische Verlagsgesellshaft (1968) can be used.

That is, a sulfur sensitization method using a compound containing sulfur capable of reacting with active gelatin and silver (e.g., thiosulfate, thioureas, mercapto compounds, rhodanines); a reduction sensitization method using a reducing substance (e.g., stannous salt, amines, hydrazine derivatives, formamidinesulfinic acid, silane compounds); a noble metal sensitization method using a noble metal compound (e.g., complex salts of metals belonging to group VIII of the periodic table such as Pt, Ir, Pd, in addition to gold complex salts); and a selenium sensitization method using a selenium compound (e.g., selenoureas, selenoketones, selenides) can be used alone or in combination.

Various compounds can be added to the photographic emulsion according to the present invention for preventing generation of fog or stabilizing photographic capabilities during production, storage or processing of the photographic material. Such compounds include compounds well-known as an antifoggant or a stabilizer such as azoles, e.g., benzothiazolium salt, nitroindazoles, triazoles, benzotriazoles, benzimidazoles (in particular, nitro- or halogen-substituted);

heterocyclic mercapto compounds, e.g., mercaptothiazoles, mercaptobenzothiazoles, mercaptobenzimidazoles, mercaptothiadiazoles, mercaptotetrazoles (in particular, 1-phenyl-5-mercaptotetrazole), mercaptopyrimidines; the above heterocyclic mercapto compounds having a water-soluble group, e.g., a carboxyl group and a sulfone group; thioketo compounds, e.g., oxazolinethione; azaindenes, e.g., tetraazaindenes (in particular, 4-hydroxy-substituted-(1,3,3a,7)tetraazaindenes); benzenethiosulfonic acids; benzenesulfinic acid.

These antifoggant and stabilizer are, in general, added after chemical sensitization but they are more preferably added during chemical ripening or before the start of chemical ripening and the time of addition can be selected optionally. That is, in the silver halide emulsion grain formation process, they may be added during the addition of an aqueous solution of silver salt, during the period after the addition of an aqueous solution of silver salt and before the start of chemical ripening, or during chemical ripening (preferably within 50% of the time of chemical ripening from the start, more preferably within 20% of the chemical ripening time from the start).

The addition amount of the above-described compounds for use in the present invention cannot be determined uniformly according to the method of addition and the amount of silver halide, but is preferably from $10^{-7}$ to $10^{-2}$ mol, more preferably from $10^{-5}$ to $10^{-2}$ mol, per mol of the silver halide.

Gelatin is advantageously used as a preservative (a binder or protective colloid) for a photographic emulsion according to the present invention, but other hydrophilic colloids can also be used.

Examples thereof include proteins such as gelatin derivatives, graft polymers of gelatin and other high polymers, albumin and casein; sugar derivatives such as cellulose derivatives such as hydroxyethyl cellulose, carboxymethyl cellulose, and cellulose sulfate, sodium alginate, and starch derivatives; and various kinds of synthetic hydrophilic high polymers of homopolymers or copolymers such as polyvinyl alcohol, partially acetalated polyvinyl alcohol, poly-N-vinylpyrrolidone, polyacrylic acid, polymethacrylic acid, polyacrylamide, polyvinylimidazole, and polyvinylpyrazole.

Acid-processed gelatin and enzyme-processed gelatin disclosed in *Bull. Soc. Sci. Photo. Japan*, No. 16, p. 30 (1966) can be used as well as lime-processed gelatin, and hydrolyzed products and enzyme decomposed products of gelatin can also be used. Those which can be obtained by reacting gelatin with, for example, acid halide, acid anhydride, isocyanates, bromoacetic acid, alkanesultones, vinylsulfonamides, maleinimide compounds, polyalkylene oxides, and epoxy compounds can be used as gelatin derivatives.

Dispersion media for use in the present invention are specifically disclosed in *Research Disclosure*, Vol. 176, No. 17643 (December, 1978), Item IX.

When the present invention is applied to a color photographic material, the material can comprise at least one light-sensitive layer on a support. In a typical embodiment, the silver halide photographic material comprises at least one light-sensitive layer consisting of a plurality of silver halide emulsion layers having substantially the same spectral sensitivity but different degrees of sensitivity on a support. In a color photographic material, the light-sensitive layer is a unit light-sensitive layer having a spectral sensitivity to any of blue light, green light and red light. In a multilayer silver halide color photographic material, these unit light-sensitive layers are generally arranged in the order of red-sensitive layer, green-sensitive layer and blue-sensitive layer from the support side. However, the order of the arrangement can be reversed depending on the purpose, alternatively, the light-sensitive layers may be arranged in such a way that a layer having a different spectral sensitivity is interposed between layers having the same spectral sensitivity. Light-insensitive layers may be provided between the above-described silver halide light-sensitive layers, and on the uppermost layer and beneath the lowermost layer of the silver halide light-sensitive layers. These light-insensitive layers may contain couplers, DIR compounds and color mixing preventives described below. As the plurality of silver halide emulsion layers constituting each unit light-sensitive layer, a two-layer structure of a high sensitivity emulsion layer and a low sensitivity emulsion layer can be preferably used with the emulsion layers being arranged so as to decrease in sensitivity toward a support in turn as disclosed in German Patent 1,121,470 and British Patent 923,045. In addition, a low sensitivity emulsion layer may be provided farther from the support and a high sensitivity emulsion layer may be provided nearer to the support as disclosed in JP-A-57-112751, JP-A-62-200350, JP-A-62-206541 and JP-A-62-206543.

In one specific example, a low sensitivity blue-sensitive layer (BL)/a high sensitivity blue-sensitive layer (BH)/a high sensitivity green-sensitive layer (GH)/a low sensitivity green-sensitive layer (GL)/a high sensitivity red-sensitive layer (RH)/a low sensitivity red-sensitive layer (RL), or BH/BL/GL/GH/RH/RL, or BH/BL/GH/GL/RL/RH can be arranged in this order from the side farthest from the support.

A blue-sensitive layer/GH/RH/GL/RL can be arranged in this order from the side farthest from the support as disclosed in JP-B-55-34932. Further, a blue-sensitive layer/GL/RL/GH/RH can be arranged in this order from the side farthest from the support as disclosed in JP-A-56-25738 and JP-A-62-63936.

Further, useful arrangements include the arrangement in which there are three layers having different degrees of sensitivities with the sensitivity being lower towards the support such that the upper layer is a silver halide emulsion layer having the highest sensitivity, the middle layer is a silver halide emulsion layer having a lower sensitivity than that of the upper layer, and the lower layer is a silver halide emulsion layer having a lower sensitivity than that of the middle layer, as disclosed in JP-B-49-15495. In the case of the structure of this type comprising three layers having different degrees of sensitivity, the layers in the unit layer of the same spectral sensitivity may be arranged in the order of a middle sensitivity emulsion layer/a high sensitivity emulsion layer/a low sensitivity emulsion layer, from the side farthest from the support, as disclosed in JP-A-59-202464.

Alternatively, the layers can be arranged in the order of a high sensitivity emulsion layer/a low sensitivity emulsion layer/a middle sensitivity emulsion layer, or a low sensitivity emulsion layer/a middle sensitivity emulsion layer/a high sensitivity emulsion layer. Moreover, the arrangement may be varied as indicated above in the case where there are four or more layers.

For improving color reproducibility, a donor layer (CL) for an interlayer effect having a different spectral sensitivity distribution from a main light-sensitive layer such as BL, GL and RL may preferably be provided adjacent or close to the main light-sensitive layer, as disclosed in U.S. Pat. Nos. 4,663,271, 4,705,744, 4,707,436, JP-A-62-160448 and JP-A-63-89850.

The silver halide preferably used in the present invention is silver iodobromide, silver iodochloride or silver iodochlorobromide containing about 30 mol % or less of silver iodide, and particularly preferably used is silver iodobromide or silver iodochlorobromide containing from about 2 mol % to about 10 mol % of silver iodide.

Silver halide grains in a photographic emulsion may have a regular crystal form such as a cubic, octahedral or tetradecahedral form, an irregular crystal form such as a spherical or plate-like form, a form which has crystal defects such as twin crystal planes, or a form which is a composite of these forms.

The silver halide grains may be a fine grain having a grain size of about 0.2 μm or less, or large size grains having a projected area diameter of up to about 10 μm, and the emulsion may be a polydisperse emulsion or a monodisperse emulsion.

The silver halide photographic emulsions for use in the present invention can be prepared using the methods disclosed, for example, in *Research Disclosure* (hereinafter abbreviated to *RD*), No. 17643 (December, 1978), pages 22 and 23, "I. Emulsion Preparation and Types", *RD*, No. 18716 (November, 1979), page 648, *RD*, No. 307105 (November, 1989), pages 863 to 865, P. Glafkides, *Chimie et Physique Photographique*, Paul Montel (1967), G. F. Duffin, *Photographic Emulsion Chemistry*, Focal Press (1966), and V. L. Zelikman et al., *Making and Coating Photographic Emulsion*, Focal Press (1964).

The monodisperse emulsions disclosed in U.S. Pat. Nos. 3,574,628, 3,655,394 and British Patent 1,413,748 are also preferred.

Further, tabular grains having an aspect ratio of about 3 or more can also be used in the present invention. Tabular grains can be easily prepared according to the methods disclosed, for example, in Gutoff, *Photographic Science and Engineering*, Vol. 14, pages 248 to 257 (1970), U.S. Pat. Nos. 4,434,226, 4,414,310, 4,433,048, 4,439,520 and British Patent 2,112,157.

The crystal structure may be uniform, or the interior and exterior parts of the grains may be comprised of different halogen compositions, or the grains may have a stratifying structure. Silver halides which have different compositions may be joined with an epitaxial junction or may be joined with compounds other than a silver halide, such as silver thiocyanate or lead oxide. Further, mixtures of grains which have various crystal forms may also be used.

The above-described emulsions may be of the superficial latent image type wherein the latent image is primarily formed on the surface, or of the internal latent image type wherein the latent image is formed within the grains, or of the type wherein the latent image is formed both at the surface and within the grains, but a negative type emulsion is essential. Of the internal latent image types, the emulsion may be a core/shell type internal latent image type emulsion as disclosed in JP-A-63-264740, and a method for preparing such a core/shell type internal latent image type emulsion is disclosed in JP-A-59-133542. The thickness of the shell of this emulsion varies depending on the development process, but is preferably from 3 to 40 nm, and particularly preferably from 5 to 20 nm.

The silver halide emulsion for use in the present invention is usually subjected to physical ripening, chemical ripening and spectral sensitization. Additives for use in such processes are disclosed in *RD*, No. 17643, *RD*, No. 18716, and *RD*, No. 307105, and the locations of these disclosures are summarized in a table below.

In the photographic material of the present invention, two or more different types of emulsions which are different in terms of at least one of the characteristics of grain size, grain size distribution, halogen composition, the form of the grains, or light sensitivity of the light-sensitive silver halide emulsion can be used in admixture in the same layer.

It is preferred to use the silver halide grains having a fogged grain surface as disclosed in U.S. Pat. No. 4,082,553, the silver halide grains having a fogged grain interior as disclosed in U.S. Pat. No. 4,626,498 and JP-A-59-214852, or colloidal silver in light-sensitive silver halide emulsion layers and/or substantially light-insensitive hydrophilic colloid layers. Silver halide grains having a fogged grain interior or surface are silver halide grains which can be developed uniformly (not imagewise) irrespective of whether these grains are in an unexposed part or an exposed part of the photographic material, and methods for the preparation thereof are disclosed in U.S. Pat. No. 4,626,498 and JP-A-59-214852. The silver halide which forms the internal nuclei of a core/shell type silver halide grains having a fogged grain interior may have different halogen compositions. The silver halide having a fogged grain interior or surface may be any of silver chloride, silver chlorobromide, silver iodobromide, or silver chloroiodobromide. The average grain size of these fogged silver halide grains is preferably from 0.01 to 0.75 μm, and particularly preferably from 0.05 to 0.6 μm. Further, the form of the grains may be regular grains and may be a polydisperse emulsion, but a monodisperse emulsion (at least 95% of silver halide grains thereof have a grain size within ±40% of the average grain size in terms of the weight or number of silver halide grains) is preferred.

The use of light-insensitive fine grained silver halides is preferred in the present invention. Light-insensitive fine grained silver halides are fine grained silver halides which are not sensitive to light upon imagewise exposure for obtaining color images and which do not substantially undergo development during development processing, and they are preferably not pre-fogged. Fine grained silver halide has a silver bromide content of from 0 to 100 mol %, and may contain silver chloride and/or silver iodide, if necessary. Fine grained silver halides which have a silver iodide content of from 0.5 to 10 mol % are preferred. The average grain size of fine grained silver halide (the average value of the diameters of the circles equivalent to the projected areas) is preferably from 0.01 to 0.5 μm, more preferably from 0.02 to 0.2 μm.

Fine grained silver halide can be prepared by the same methods as the preparation of generally used light-sensitive silver halides. In the preparation of fine grained silver halide, the surface of silver halide grains does not need to be optically sensitized and also does not need to be spectrally sensitized. However, it is preferred to previously include known stabilizers such as triazole based, azaindene based, benzothiazolium based, or mercapto based compounds, or zinc compounds in fine grained silver halide before addition to the coating solution. Colloidal silver can be included in the layer containing fine grained silver halide grains.

The coating weight of silver in the photographic material of the present invention is preferably 6.0 g/m$^2$ or less, and most preferably 4.5 g/m$^2$ or less.

Photographic additives which can be used in the present invention are disclosed in *RD* and the locations related thereto are indicated in the table below.

| Type of Additives | RD 17643 | RD 18716 | RD 307105 |
|---|---|---|---|
| 1. Chemical Sensitizers | page 23 | page 648, right column | page 866 |
| 2. Sensitivity Increasing Agents | — | page 648, right column | — |
| 3. Spectral Sensitizers and Supersensitizers | pages 23–24 | page 648, right column to page 649, right column | pages 866–868 |
| 4. Brightening Agents | page 24 | page 647, right column | page 868 |
| 5. Light Absorbers, Filter Dyes, and Ultraviolet Absorbers | pages 25–26 | page 649, right column to page 650, left column | page 873 |
| 6. Binders | page 26 | page 651, left column | pages 873–874 |
| 7. Plasticizers and Lubricants | page 27 | page 650, right column | page 876 |
| 8. Coating Aids and Surfactants | pages 26–27 | page 650, right column | pages 875–876 |
| 9. Antistatic Agents | page 27 | page 650, right column | pages 876–877 |
| 10. Matting Agents | — | — | pages 878–879 |

Various dye-forming couplers can be used in the photographic material of the present invention, and the following couplers are particularly preferred.

Yellow Couplers:

The couplers represented by formula (I) or (II) disclosed in EP-A-502424; the couplers represented by formula (1) or (2) disclosed in EP-A-513496 (in particular, Y-28 on page 18); the couplers represented by formula (I) disclosed in claim 1 of EP-A-568037; the couplers represented by formula (I), lines 45 to 55, column n 1 of U.S. Pat. No. 5,066,576; the couplers represented by formula (I), paragraph 0008 of JP-A-4-274425; the couplers disclosed in claim 1 on page 40 of EP-A-498381 (in particular, D-35 on page 18); the couplers represented by formula (Y) on page 4 of EP-A-447969 (in particular, Y-1 (page 17) and Y-54 (page 41)); and the couplers represented by any of formulae (II) to (IV), lines 36 to 58, column 7 of U.S. Pat. No. 4,476,219 (in particular, II-17 and II-19 (column 17), and II-24 (column 19)).

Magenta Couplers:

L-57 (page 11, right lower column), L-68 (page 12, right lower column), and L-77 (page 13, right lower column) of JP-A-3-39737; A-4-63 (page 134), and A-4-73 to A-4-75 (page 139) of EP-A-456257; M-4 to M-6 (page 26) and M-7 (page 27) of EP-A-486965; M-45 (page 19) of EP-A-571959; (M-1) (page 6) of JP-A-5–204106; and M-22, paragraph 0237 of JP-A-4-362631.

Cyan Couplers:

CX-1, CX-3, CX-4, CX-5, CX-11, CX-12, CX-14 and CX-15 (pages 14 to 16) of JP-A-4-204843; C-7 and C-10 (page 35), C-34 and C-35 (page 37), and (I-1) and (I-17) (pages 42 and 43) of JP-A-4-43345; and the couplers represented by formula (Ia) or (Ib) disclosed in claim 1 of JP-A-6-67385.

Polymer Couplers:

P-1 and P-5 (page 11) of JP-A-2-44345.

Couplers the Colored Dyes of Which Have Appropriate Diffusibility:

The couplers disclosed in U.S. Pat. No. 4,366,237, British Patent 2,125,570, EP-B-96873 and German Patent 3,234,533 are preferred as couplers the colored dyes of which have an appropriate diffusibility.

Couplers for Correcting the Unnecessary Absorption of Colored Dyes:

Examples of preferred couplers for correcting the unnecessary absorption of colored dyes include the yellow colored cyan couplers represented by formula (CI), (CII), (CIII) or (CIV) disclosed on page 5 of EP-A-456257 (in particular, YC-86 on page 84); the yellow colored magenta couplers ExM-7 (page 202), EX-1 (page 249), and EX-7 (page 251) disclosed in EP-A-456257; the magenta colored cyan couplers CC-9 (column 8) and CC-13 (column 10) disclosed in U.S. Pat. No. 4,833,069; the coupler (2) (column 8) of U.S. Pat. No. 4,837,136; and the colorless masking couplers represented by formula (A) disclosed in claim 1 of WO 92/11575 (in particular, the compounds disclosed on pages 36 to 45).

Examples of compounds (inclusive of couplers) which release photographically useful residual groups of compounds upon reacting with the oxidation product of a developing agent include the following:

Development Inhibitor Releasing Compounds:

The compounds represented by formula (I), (II), (III) or (IV) disclosed on page 11 of EP-A-378236 (in particular, T-101 (page 30), T-104 (page 31), T-113 (page 36), T-131 (page 45), T-144 (page 51) and T-158 (page 58)); the compounds represented by formula (I) disclosed on page 7 of EP-A-436938 (in particular, D-49 (page 51)); the compounds represented by formula (1) disclosed in EP-A-568037 (in particular, (23) (page 11)); and the compounds represented by formula (I), (II) or (III) disclosed on pages 5 and 6 of EP-A-440195 (in particular, I-(1) on page 29);

Bleaching Accelerator Releasing Compounds:

The compounds represented by formula (I) or (I') disclosed on page 5 of EP-A-310125 (in particular, (60) and (61) on page 61); and the compounds represented by formula (I) disclosed in claim 1 of JP-A-6-59411 (in particular, (7) on page 7);

Ligand Releasing Compounds:

The compounds represented by LIG-X disclosed in claim 1 of U.S. Pat. No. 4,555,478 (in-particular, the compounds in lines 21 to 41, column 12);

Leuco Dye Releasing Compounds:

Compounds 1 to 6, columns 3 to 8 of U.S. Pat. No. 4,749,641;

Fluorescent Dye Releasing Compounds:

The compounds represented by COUP-DYE disclosed in claim 1 of U.S. Pat. No. 4,774,181 (in particular, compounds 1 to 11, columns 7 to 10);

Development Accelerator Releasing or Fogging Agent Releasing Compounds:

The compounds represented by formula (1), (2) or (3), column 3 of U.S. Pat. No. 4,656,123 (in particular, (I-22), column 25); and compound ExZK-2, lines 36 to 38, page 75 of EP-A-450637; and Compounds Which Release Dyes the Color of Which Is Restored after Elimination:

The compounds represented by formula (I) disclosed in claim 1 of U.S. Pat. No. 4,857,447 (in particular, Y-1 to Y-19, columns 25 to 36).

Preferred additives other than couplers are listed below:

Dispersion Mediums of Oil-Soluble Organic Compound:

P-3, P-5, P-16, P-19, P-25, P-30, P-42, P-49, P-54, P-55, P-66, P-81, P-85, P-86 and P-93 (pages 140 to 144) of JP-A-62-215272;

Latexes for Impregnation of Oil-Soluble Organic Compound:

The latexes disclosed in U.S. Pat. No. 4,199,363;

Scavengers for the Oxidation Product of Developing Agent:

The compounds represented by formula (I), lines 54 to 62, column 2 of U.S. Pat. No. 4,978,606 (in particular, I-(1), I-(2), I-(6) and I-(12), columns 4 and 5); and the compounds represented by the formula disclosed in lines 5 to 10, column 2 of U.S. Pat. No. 4,923,787 (in particular, compound 1, column 3);

Antistaining Agents:

The compounds represented by formula (I), (II) or (III), lines 30 to 33, page 4 of EP-A-298321 (in particular, I-47, I-72, III-1 and III-27, pages 24 to 48);

Discoloration Inhibitors:

A-6, A-7, A-20, A-21, A-23, A-24, A-25, A-26, A-30, A-37, A-40, A-42, A-48, A-63, A-90, A-92, A-94 and A-164 (pages 69 to 118) of EP-A-298321; II-1 to III-23, columns 25 to 38 of U.S. Pat. No. 5,122,444 (in particular, III-10); I-1 to III-4, pages 8 to 12 of EP-A-471347 (in particular, II-2); and A-1 to A-48, columns 32 to 40 of U.S. Pat. No. 5,139,931 (in particular, A-39 and A-42);

Compounds for Reducing the Using Amounts of Color Intensifiers and Color Mixing Preventives:

I-1 to II-15, pages 5 to 24 of EP-A-411324 (in particular, I-46);

Formaldehyde Scavengers:

SCV-1 to SCV-28, pages 24 to 29 of EP-A-477932 (in particular, SCV-8);

Hardening Agents:

H-1, H-4, H-6, H-8 and H-14 on page 17 of JP-A-1-214845; the compounds represented by any of formulae (VII) to (XII), columns 13 to 23 of U.S. Pat. No. 4,618,573 (H-1 to H-54); the compounds represented by formula (6), right lower column, page 8 of JP-A-2-214852 (H-1 to H-76) (in particular, H-14); and the compounds disclosed in claim 1 of U.S. Pat. No. 3,325,287;

Development Inhibitor Precursors:

P-24, P-37 and P-39, pages 6 and 7 of JP-A-62-168139; and the compounds disclosed in claim 1 of U.S. Pat. No. 5,019,492 (in particular, compounds 28 and 29, column 7);

Fungicides and Biocides:

I-1 to III-43, columns 3 to 15 of U.S. Pat. No. 4,923,790 (in particular, II-1, II-9, II-10, II-18 and III-25);

Stabilizers and Antifoggants:

I-1 to (14), columns 6 to 16 of U.S. Pat. No. 4,923,793 (in particular, I-1, 60, (2) and (13)); and compounds 1 to 65, columns 25 to 32 of U.S. Pat. No. 4,952,483 (in particular, compound 36);

Chemical Sensitizers:

Triphenylphosphine selenide; and compound 50 disclosed in JP-A-5-40324;

Dyes:

a-1 to b-20, pages 15 to 18 (in particular, a-1, a-12, a-18, a-27, a-35, a-36, and b-5), and V-1 to V-23, pages 27 to 29 (in particular, V-1) of JP-A-3-156450; F-I-1 to F-II-43, pages 33 to 55 of EP-A-445627 (in particular, F-I-11 and F-II-8); III-1 to III-36, pages 17 to 28 of EP-A-457153 (in particular, III-1 and III-3); crystallite dispersions of Dye-1 to Dye-124, pages 8 to 26 of WO 88/04794; compounds 1 to 22, pages 6 to 11 of EP-A-319999 (in particular, compound 1); compounds D-1 to D-87 represented by any of formulae (1) to (3), pages 3 to 28 of EP-A-519306; compounds 1 to 22 represented by formula (I), columns 3 to 10 of U.S. Pat. No. 4,268,622; and compounds (1) to (31) represented by formula (I), columns 2 to 9 of U.S. Pat. No. 4,923,788;

Ultraviolet Absorbers:

Compounds (18b) to (18r) represented by formula (1), 101 to 427, pages 6 to 9 of JP-A-46-3335; compounds (3) to (66) represented by formula (I), pages 10 to 44, and compounds HBT-1 to HBT-10 represented by formula (III), page 14, of EP-A-520938; and compounds (1) to (31) represented by formula (1), columns 2 to 9 of EP-A-521823.

The present invention can be applied to various color photographic materials such as color negative films for general and cinematographic uses, color reversal films for slide and television uses, color papers, color positive films and color reversal papers. The present invention can also preferably be applied to the film units equipped with lenses as disclosed in JP-B-2-32615 and JP-B-U-3-39784 (the term "JP-B-U" as used herein means an "examined Japanese utility model publication"). Further, the present invention can also be applied to black-and-white photographic materials such as black-and-white negative films and X-ray films.

Suitable supports which can be used in the present invention are disclosed, for example, in *RD*, No. 17643, page 28, *RD*, No. 18716, from page 647, right column to page 648, left column, and *RD*, No. 307105, page 879.

The photographic material of the present invention has a total film thickness of all the hydrophilic colloid layers on the side where the emulsion layers are located of preferably 28 μm or less, more preferably 23 μm or less, still more preferably 18 μm or less, and most preferably 16 μm or less. Further, the film swelling rate $T_{1/2}$ is preferably 30 seconds or less, more preferably 20 seconds or less. $T_{1/2}$ is defined as the time required for the film thickness to reach ½ of the saturated film thickness, taking 90% of the maximum swollen film thickness reached when being processed at 30° C. for 3 minutes and 15 seconds in a color developing solution as the saturated film thickness. The film thickness means the film thickness measured under the conditions of 25° C., 55% relative humidity (stored for two days), and $T_{1/2}$ can be measured using a swellometer of the type described in A. Green et al., *Photogr. Sci. Eng.*, Vol. 19, No. 2, pages 124 to 129. $T_{1/2}$ can be adjusted by adding hardening agents to gelatin which is used as a binder, or by changing the aging conditions after coating. Further, a swelling factor of from 150% to 400% is preferred. The swelling factor can be calculated from the maximum swollen film thickness obtained under the conditions described above using the equation: (maximum swollen film thickness—film thickness)/film thickness.

The provision of hydrophilic colloid layers (known as backing layers) having a total dry film thickness of from 2 μm to 20 μm on the side of the support opposite to the side on which emulsion layers are provided is preferred in the photographic material of the present invention. The inclusion of the above described light absorbers, filter dyes, ultraviolet absorbers, antistatic agents, hardening agents, binders, plasticizers, lubricants, coating aids, and surfactants in the backing layers is preferred. The swelling factor of the backing layer is preferably from 150 to 500%.

The photographic material of the present invention can be development processed by the ordinary methods disclosed in *RD*, No. 17643, pages 28 and 29, *RD*, No. 18716, from left column to right column, page 651, and *RD*, No. 307105, pages 880 and 881.

The color developing solution for use in the development processing of the photographic material of the present invention is preferably an alkaline aqueous solution which contains an aromatic primary amine color developing agent as a main component. Aminophenol based compounds are useful as the color developing agent, but the use of p-phenylenediamine based compounds is preferred, and representative examples thereof include the compounds disclosed in lines 43 to 52, page 28 of EP-A-556700. Two or more of these compounds can be used in combination according to purposes.

The color developing solution generally contains a pH buffer such as alkali metal carbonate, borate or phosphate, or a development inhibitor or an antifoggant such as chloride, bromide, iodide, benzimidazoles, benzothiazoles, or mercapto compounds. The color developing solution may also contain, if necessary, various preservatives such as hydroxylamine, diethylhydroxylamine, sulfite, hydrazines, e.g., N,N-bis-carboxymethylhydrazine, phenylsemicarbazides, triethanolamine and catecholsulfonic acids, an organic solvent such as ethylene glycol and diethylene glycol, a development accelerator such as benzyl alcohol, polyethylene glycol, quaternary ammonium salt, and amines, a dye-forming coupler, a competitive coupler, an auxiliary developing agent such as 1-phenyl-3-pyrazolidone, a thickener, and various chelating agents typified by aminopolycarboxylic acid, aminopolyphosphonic acid, alkylphosphonic acid, and phosphonocarboxylic acid, e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of these acids.

Further, color development is generally carried out after black-and-white development in the case of reversal processing. In a black-and-white developing solution, known black-and-white developing agents such as dihydroxybenzenes, e.g., hydroquinone, 3-pyrazolidones, e.g., 1-phenyl-3-pyrazolidone, or aminophenols, e.g., N-methyl-p-aminophenol can be used alone or in combination. The pH of these color developing solution and black-and-white developing solution is generally from 9 to 12. The replenishing rate of these developing solutions depends on the color photographic material to be processed but, in general, it is 3 liters or less per square meter of the photographic material, and the amount can be reduced to 500 ml or less by reducing the bromide ion concentration in the replenisher. In the case when the replenishing rate is reduced, it is preferred to prevent evaporation and air oxidation of the solution by minimizing the area of contact of the solution with the air in the processing tank.

The processing effect by the contact of the photographic processing solution with the air in a processing tank can be evaluated by the following equation: Open factor=[Contact area of processing solution with air ($cm^2$)]÷[Volume of processing solution ($cm^3$)]. This open factor is preferably 0.1 or less, more preferably from 0.001 to 0.05. The method using a movable lid as disclosed in JP-A-1-82033 and the slit development processing method as disclosed in JP-A-63-216050 can be used as means of reducing the open factor, as well as the provision of a shielding material such as a floating lid on the surface of the photographic processing solution in the processing tank. Reduction of the open factor is preferred not only in processes of color development and black-and-white development but also in all the subsequent processes such as bleaching, blixing, fixing, washing and stabilizing processes. Further, the replenishing rate can be reduced by suppressing the accumulation of the bromide ion in a developing solution.

The color development processing time is usually set between 2 and 5 minutes, but shorter processing time is available by raising the temperature and the pH and increasing the concentration of the color developing agent.

A photographic emulsion layer is generally bleaching processed after being color development processed. A bleaching process and a fixing process may be carried out at the same time (blixing process) or may be performed separately. A processing method comprising carrying out a blixing process after a bleaching process can be adopted for further rapid processing. Also, processing in two successive blixing baths, a fixing process before a blixing process, or a bleaching process after a blixing process may optionally be selected according to purposes. Compounds of polyvalent metals such as iron(III), peracids, quinones, and nitro compounds are used as a bleaching agent. Representative examples of bleaching agents which are preferably used in the present invention include a complex salt such as organic complex salts of iron(III) with aminopolycarboxylic acids, e.g., ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid, or citric acid, tartaric acid or malic acid. The use of aminopolycarboxylic acid iron(III) complex salts such as ethylenediaminetetraacetic acid iron(III) complex salts and 1,3-diaminopropanetetraacetic acid iron(III) complex salts is particularly preferred of them from the point of providing rapid processing and preventing environmental pollution. Further, aminopolycarboxylic acid iron(III) complex salts are particularly useful in both of a bleaching solution and a blixing solution. The pH of the bleaching solution or the blixing solution in which these aminopolycarboxylic acid iron(III) complex salts are included is generally from 4.0 to 8, but lower pH can be used to speed up the processing.

Bleaching accelerators can be used, if necessary, in a bleaching solution, a blixing solution, or prebaths thereof. Specific examples of useful bleaching accelerators are disclosed in the following publications: the compounds which have a mercapto group or a disulfido group disclosed in U.S. Pat. No. 3,893,858, German Patents 1,290,812, 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *RD*, No. 17129 (July, 1978); the thiazolidine derivatives disclosed in JP-A-50-140129; the thiourea derivatives disclosed in JP-B-45-8506, JP-A-52-20832, JP-A-53-32735, and U.S. Pat. No. 3,706,561; the iodides disclosed in German Patent 1,127,715 and JP-A-58-16235; the polyoxyethylene compounds disclosed in German Patents 966,410 and 2,748,430; the polyamine compounds disclosed in JP-B-45-8836; other compounds disclosed in JP-A-49-40943, JP-A-49-59644, JP-A-53-94927, JP-A-54-35727, JP-A-55-26506 and JP-A-58-163940; and bromide ions. The compounds which have a mercapto group or a disulfido group are preferred from the point of providing large accelerating effect, and those disclosed in U.S. Pat. No. 3,893,858, German Patent 1,290,812 and JP-A-53-95630 are particularly preferred of all. Further, the compounds disclosed in U.S. Pat. No. 4,552,834 are also preferred. These bleaching accelerators can be included in photographic materials. These bleaching accelerators are especially effective when color photographic materials for photographing are blixed.

It is preferred to include organic acids in a bleaching solution and a blixing solution, in addition to the above compounds, for inhibiting bleaching stain. Particularly preferred organic acids are compounds having an acid dissociation constant (pKa) of from 2 to 5, specifically, acetic acid, propionic acid, and hydroxyacetic acid are preferred.

Thiosulfate, thiocyanate, thioether based compounds, thioureas, and a large amount of iodide are cited for use in a fixing solution and a blixing solution, but thiosulfate is generally used, in particular, ammonium thiosulfate can be most widely used. Further, the combined use of thiosulfate with thiocyanate, thioether based compounds and thiourea is also preferred. As preservatives for a fixing solution and a blixing solution, sulfite, bisulfite, carbonyl-bisulfite addition products or the sulfinic acid compounds disclosed in EP-A-294769 are preferred. Moreover, aminopolycarboxylic acids and organic phosphonic acids are preferably added to a fixing solution and a blixing solution for stabilizing the solutions.

In the present invention, compounds having a pKa of from 6.0 to 9.0 are preferably added to a fixing solution or a blixing solution for adjusting pH, preferably imidazoles such as imidazole, 1-methylimidazole, 1-ethylimidazole and 2-methylimidazole, in an amount of from 0.1 to 10 mol per liter.

The total processing time of the desilvering process is preferably shorter in the range not generating a desilvering failure. The desilvering processing time is preferably from 1 minute to 3 minutes and more preferably from 1 minute to 2 minutes. Further, the processing temperature is generally from 25° C. to 50° C., and preferably from 35° C. to 45° C. In the preferred temperature range, the desilvering rate is increased and the occurrence of staining after processing is effectively prevented.

Stirring as vigorous as possible in the desilvering process is preferred. Specific examples of the methods of forced stirring include the method wherein a jet of the processing solution is impinged on the surface of the emulsion of the photographic material as disclosed in JP-A-62-183460, the method wherein the stirring effect is raised using a rotating means as disclosed in JP-A-62-183461, the method wherein the photographic material is moved with a wiper blade, which is installed in the solution, in contact with the surface of the emulsion, and the generated turbulent flow at the surface of the emulsion increases the stirring effect, and the method wherein the circulating flow rate of the entire processing solution is increased. These means for increasing the stirring level are effective for the bleaching solution, the blixing solution and the fixing solution. It is supposed that the increased stirring level increases the rate of supply of the bleaching agent and the fixing agent to the emulsion film and, as a result, increases the desilvering rate. Further, the above means of increasing stirring are more effective when a bleaching accelerator is used, and it is possible to extremely increase the bleaching accelerating effect and to eliminate the fixing hindrance action due to the bleaching accelerator.

The automatic processors which are used in the present invention preferably have the means of transporting photographic materials as disclosed in JP-A-60-191257, JP-A-60-191258, and JP-A-60-191259. As described in the above JP-A-60-191257, such a transporting means can greatly reduce the carryover of the processing solution from the previous bath to the next bath and effectively prevent the deterioration of the capabilities of the processing solution, and is especially effective in reducing the processing time of each processing step and reducing the replenishing rate of each processing solution.

The photographic material of the present invention is generally subjected to a washing step and/or a stabilizing step after the desilvering step. The amount of the washing water in the washing step can be selected from a wide range according to the properties and the application of the photographic materials (for example, the materials used-such as couplers, etc.), the temperature of the washing water, the number of washing tanks (the number of washing stages), the replenishing system, that is, whether a countercurrent system or a concurrent system, and other various conditions. Of the foregoing conditions, the relationship between the number of washing tanks and the amount of the water in a multistage countercurrent system can be obtained by the method described in *Journal of the Society of Motion Picture and Television Engineers*, Vol. 64, pages 248 to 253 (May, 1955). According to the multistage countercurrent system of the above literature, the amount of the washing water can be greatly reduced, however, problems arise that bacteria proliferate due to the increased residence time of the water in the tanks, and suspended matters produced thereby adhere to the photographic material. The method of reducing the calcium ion and magnesium ion concentrations as disclosed in JP-A-62-288838 can be used as a very effective means for overcoming these problems. Also, the isothiazolone compounds and the thiabendazoles as disclosed in JP-A-57-8542, the chlorine based antibacterial agents such as chlorinated sodium isocyanurate, the benzotriazoles, and the antibacterial agents disclosed in Hiroshi Horiguchi, *Bohkin Bohbai no Kagaku* (*Antibacterial and Antifungal Chemistry*), published by Sankyo Shuppan K. K. (1986), *Biseibutsu no Mekkin, Sakkin, Bohbai Gijutsu* (*Germicidal and Antifungal Techniques of Microorganisms*), edited by Eisei Gijutsukai, published by Kogyo Gijutsukai (1982), and *Bohkin Bohbai Zai Jiten* (*Antibacterial and Antifungal Agents Thesaurus*), edited by Nippon Bohkin Bohbai Gakkai (1986), can be used.

The pH of the washing water in the processing of the photographic material of the present invention is generally from 4 to 9 and preferably from 5 to 8. The temperature and the time of the washing step can be selected variously according to the characteristics and the end use purpose of the photographic material to be processed, but is generally from 15 to 45° C. for 20 seconds to 10 minutes, and preferably from 25 to 40° C. for 30 seconds to 5 minutes. Further, the photographic material of the present invention can be processed directly with a stabilizing solution without employing the washing step as described above. Any known methods as disclosed in JP-A-57-8543, JP-A-58-14834 and JP-A-60-220345 can be used in such a stabilizing process.

Further, there is also a case in which a stabilizing process is carried out following the above described washing process, and the stabilizing bath which contains a dye stabilizer and a surfactant which is used as a final bath for color photographic materials for photographing is one example of such a process. Aldehydes such as formaldehyde and glutaraldehyde, N-methylol compounds, hexamethylenetetramine and sulfite addition products of aldehyde can be used as a dye stabilizer. Various chelating agents and fungicides can also be added to this stabilizing bath.

The overflow generated by the replenishment of the above described washing water and/or stabilizing solution can be reused in other steps such as a desilvering step, etc.

When the above each processing solution is concentrated due to the evaporation by the processing using an automatic processor, etc., it is preferred to replenish an appropriate amount of water for the correction of concentration.

Color developing agents may be incorporated into a photographic material of the present invention to simplify and speed up the processing. Color developing agent precursors are preferred for the incorporation. For example, the indoaniline based compounds disclosed in U.S. Pat. No. 3,342,597, the Schiff's base type compounds disclosed in U.S. Pat. No. 3,342,599, *Research Disclosure*, Nos. 14850 and 15159, the aldol compounds disclosed in *RD*, No. 13924, the metal complex salts disclosed in U.S. Pat. No. 3,719,492 and the urethane based compounds disclosed in JP-A-53-135628 can be used for this purpose.

Various 1-phenyl-3-pyrazolidones may be included, if required, in the photographic material of the present invention to accelerate color development. Typical compounds are disclosed in JP-A-56-64339, JP-A-57-144547 and JP-A-58-115438.

The processing solutions used for the processing of the photographic material of the present invention are used at a temperature of from 10° C. to 50° C. The standard temperature is generally from 33° C. to 38° C., but higher temperatures can be used to accelerate the processing to shorten the processing time, on the contrary, lower temperatures can be used to improve the picture quality and stabilize the processing solutions.

When the present invention is applied to black-and-white photographic materials, various additives and development processing methods used therefor are not particularly limited, and those disclosed in the following places of JP-A-2-68539, JP-A-5-11389 and JP-A-2-58041 can be preferably used.

| | | |
|---|---|---|
| 1. | Silver halide emulsion and the preparation method hereof | from 6 lines up from the bottom, right lower column, page 8 to line 12, right upper column, page 10 of JP-A-2-68539 |
| 2. | Chemical sensitization method | from line 13, right upper column, page 10 to line 16, left lower column, page 10 of JP-A-2-68539; selenium sensitization methods disclosed in JP-A-5-11389 |
| 3. | Antifoggant and stabilizer | from line 17, left lower column, page 10 to line 7, left upper column, page 11 of JP-A-2-68539; from line 2, left lower column, page 3 to left lower column, page 4 of JP-A-2-68539 |
| 4. | Spectral sensitizing dye | from line 4, right lower column, page 4 to right lower column, page 8 of JP-A-2-68539; from line 8, left lower column, page 12 to line 19, right lower column, page 12 of JP-A-2-58041 |
| 5. | Surfactant and antistatic agent | from line 14, left upper column, page 11 to line 9, left upper column, page 12 of JP-A-2-68539; from line 14, left lower column, page 2 to line 12, left lower column, page 5 of JP-A-2-58041 |
| 6. | Matting agent, plasticizer and sliding agent | from line 10, left upper column, page 12 to line 10, right upper column, page 12 of JP-A-2-68539; from line 13, left lower column, page 5 to line 3, left lower column, page 10 of JP-A-2-58041 |
| 7. | Hydrophilic colloid | from line 11, right upper column, page 12 to line 16, left lower column, page 12 of JP-A-2-68539 |
| 8. | Hardening agent | from line 17, left lower column, page 12 to line 6, right upper column, page 13 of JP-A-2-68539 |
| 9. | Development processing method | from line 14, left upper column, page 15, to line 13, left lower column, page 15 of JP-A-2-68539 |

The silver halide photographic material of the present invention can also be applied to heat-developable photographic materials, for example, those disclosed in U.S. Pat. No. 4,500,626, JP-A-60-133449, JP-A-59-218443, JP-A-61-238056 and EP-A-210660.

Silver halide photographic materials having a magentic recording layer which can be used in the present invention are not limitative and any photographic material can be used as long as it has a magentic recording layer. A magnetically recording layer may be contiguous to a support or may be provided via other photographic constitutional layers.

The above-described magnetically recording layer may be provided on a support in stripe as disclosed in JP-A-4-124642 and JP-A-4-124645.

A magnetically recording layer can be coated with ferromagnetic grains as disclosed in JP-A-59-23505, JP-A-4-195726 and JP-A-6-59357.

The silver halide emulsions disclosed in JP-A-4-166932, JP-A-3-41436 and JP-A-3-41437 can be used herein.

Transparent triacetate cellulose or polyethylene terephthalate conventionally used in a color film can be used as a support in the present invention, but polyethylene aromatic dicarboxylate based polyester supports are preferably used in the light of magnetically recording properties. Of the polyethylene aromatic dicarboxylate based polyester supports, polyethylene terephthalate is particularly preferred.

The support according to the present invention has a thickness of from 50 to 300 $\mu$m, preferably from 50 to 200 $\mu$m, more preferably from 80 to 115 $\mu$m, and particularly preferably from 85 to 105 $\mu$m.

The polyester laminar supports which have been previously heat-treated disclosed in detail in JP-A-6-35118, JP-A-6-17528, and Hatsumei-Kyokai Kokai Giho No. 94-6023 are preferably used. Specifically, those annealed at 40° C. or more and the glass transition point temperature or less for from 1 to 1,500 hours are preferred.

The above-described supports may further be subjected to a surface treatment such as an ultraviolet irradiation treatment as disclosed in JP-B-43-2603, JP-B-43-2604 and JP-B-45-3828, a corona discharge treatment as disclosed in JP-B-48-5043 and JP-A-51-131576, and a glow discharge treatment as disclosed in JP-B-35-7578 and JP-B-46-43480, undercoated as disclosed in U.S. Pat. No. 5,326,689, provided with an under-layer as disclosed in U.S. Pat. No. 2,761,791, if necessary, and further, the supports may be subjected to an antistatic treatment, if necessary, as disclosed in JP-A-4-62543.

The photographic material of the present invention is preferably manufactured according to the manufacturing and controlling methods as disclosed in JP-B-4-86817 and manufacturing data are recorded according to the methods disclosed in JP-B-6-87146. Before or after that, according to the methods disclosed in JP-A-4-125560, the photographic material is cut to a film of a narrower width than that of a conventional 135 size film and two perforations are made on one side per a smaller format picture plane so as to match with the smaller format picture plane than the picture plane heretofore in use.

The thus-produced film can be loaded and used in the cartridge packages disclosed in JP-A-4-157459, the cartridge disclosed in FIG. 9 in Example of JP-A-5-210202, the film patrones disclosed in U.S. Pat. No. 4,221,479, and the cartridges disclosed in U.S. Pat. Nos. 4,834,308, 4,834,366, 5,226,613 and 4,846,418.

Film cartridges and film patrones of the type which can encase a film tip as disclosed in U.S. Pat. Nos. 4,848,893 and 5,317,355 are preferred in view of the light shielding capability.

Further, a cartridge which has a locking mechanism as disclosed in U.S. Pat. No. 5,296,886, a cartridge which has the displaying function of working conditions, and a cartridge which has the function of preventing double exposure as disclosed in U.S. Pat. No. 5,347,334 are preferred.

In addition, a cartridge by which a film can be easily loaded only by inserting a film into a cartridge as disclosed in JP-A-6-85128 may be used.

The thus-produced film cartridges can be used for various photographic pleasures such as photographing and development processing using the following cameras, developing machines, and laboratory devices according to purposes.

The functions of film cartridges (patrones) can be sufficiently demonstrated using, for example, the easily loadable camera disclosed in JP-A-6-8886 and JP-A-6-99908, the automatic winding type camera disclosed in JP-A-6-57398 and JP-A-6-101135, the camera capable of pulling out the film and exchanging for a different kind of film in the course of photographing disclosed in JP-A-6-205690, the camera which can magnetically record the information at photographing time such as panorama photographing, high vision photographing or general photographing (capable of magnetic recording which can set up the print aspect ratio) disclosed in JP-A-5-293138 and JP-A-5-283382, the camera having the function of preventing double exposure disclosed in JP-A-6-101194, and the camera having the displaying function of working conditions of a film and the like disclosed in JP-A-5-150577.

The thus-photographed films may be processed using the automatic processors disclosed in JP-A-6-222514 and JP-A-6-222545, the using methods of the magnetically recording information on the film disclosed in JP-A-6-95265 and JP-A-4-123054 may be used before, during or after processing, or the function of selecting the aspect ratio disclosed in JP-A-5-19364 can be used.

If development processing is motion picture type development, the film is processed by splicing according to the method disclosed in JP-A-5-119461.

Further, during and after development processing, the attachment and detachment disclosed in JP-A-6-148805 are conducted.

After processing has been conducted thus, the information on the film may be altered to a print through back printing and front printing according to the methods disclosed in JP-A-2-184835, JP-A-4-186335 and JP-A-6-79968.

The film may be returned to a customer with the index print disclosed in JP-A-5-11353 and JP-A-5-232594 and the return cartridge.

According to the photographic material of the present invention, fluctuation in photographic properties is little and no development hindrance occurs even in high temperature and high humidity conditions. Furthermore, the influence of the change of the production condition is exerted on photographic properties at the time of the production of the photographic material as small as possible.

The present invention will be illustrated in more detail with reference to examples below, but these are not to be construed as limiting the invention.

EXAMPLE 1

Preparation of Seed Emulsion a:

One thousand and six hundred (1,600) ml of an aqueous solution containing 4.5 g of KBr and 7.9 g of gelatin having the average molecular weight of 15,000 was stirred while maintaining the temperature at 40° C. To the foregoing aqueous solution, an $AgNO_3$ (8.9 g) aqueous solution and a KBr (6.2 g) aqueous solution containing 6.3 wt % of KI were added by a double jet method for 40 seconds. After 38 g of gelatin was added thereto, the temperature was raised to 58° C. An $AgNO_3$ (5.6 g) aqueous solution was added thereto, then 0.1 mol of ammonia was added, and after 15 minutes the aqueous solution was neutralized with acetic acid to adjust pH to 5.0. Subsequently, an $AgNO_3$ (219 g) aqueous solution and a KBr aqueous solution were added by a double jet method for 40 minutes with increasing the feed rate. At that time, silver potential was maintained at −10 mV to a saturated calomel electrode. After the reaction mixture was desalted, 50 g of gelatin was added and pH was adjusted to 5.8 and pAg to 8.8 at 40° C. to thereby obtain Seed Emulsion a. This seed emulsion contained 1 mol of Ag and 80 g of gelatin per kg of the emulsion, and contained tabular grains having the average equivalent-circle diameter of 0.62 μm, the variation coefficient of equivalent-circle diameter of 16%, the average thickness of 0.103 μm and the average aspect ratio of 6.0

Preparation of Emulsion A:

One thousand and two hundred (1,200) ml of an aqueous solution containing 134 g of Seed Emulsion a, 1.9 g of KBr and 38 g of gelatin was stirred with maintaining the temperature at 78° C. After 2 mg of thiourea dioxide was added thereto, an $AgNO_3$ (87.7 g) aqueous solution and a KBr aqueous solution containing 17.9 wt % of KI were added by a double jet method for 46 minutes with increasing the feed rate. At that time, silver potential was maintained at −40 mV to a saturated calomel electrode. Subsequently, an $AgNO_3$ (42.6 g) aqueous solution and a KBr aqueous solution were added by a double jet method for 17 minutes. At that time, silver potential was maintained at +40 mV to a saturated calomel electrode.

Silver potential was adjusted to −80 mV by adding 44 mg of sodium ethylthiosulfonate and a KBr aqueous solution. Seven point one (7.1) grams in terms of $AgNO_3$ of a silver iodide fine grain emulsion having the average equivalent-circle diameter of 0.025 μm and the variation coefficient of equivalent-circle diameter of 18% was suddenly added within 5 seconds, 30 seconds after the addition of a silver iodide fine grain emulsion, an $AgNO_3$ (66.4 g) aqueous solution was added to the mixed solution in constant feed rate over 8 minutes. The silver potential after the addition was −10 mV. After washing the solution with water ordinarily, gelatin was added and pH was adjusted to 5.8 and pAg to 8.8 at 40° C.

This emulsion was designated Emulsion A.

Emulsion A contained tabular grains having the average equivalent-circle diameter of 1.17 μm, the variation coefficient of equivalent-circle diameter of 26%, the average thickness of 0.23 μm, the average aspect ratio of 5.1, and the average equivalent-sphere diameter of 0.78 μm. Further, the grains having the aspect ratio of 5 or more occupied 60% or more based on the total projected area of the entire grains.

The temperature of Emulsion A was raised to 60° C., and Emulsion A was optimally chemically sensitized by the addition of the following sensitizing dyes, potassium thiocyanate, chloroauric acid, sodium thiosulfate and N,N-dimethylselenourea. This emulsion was named Emulsion B.

Sensitizing Dyes

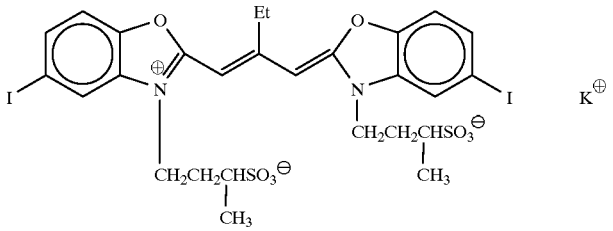

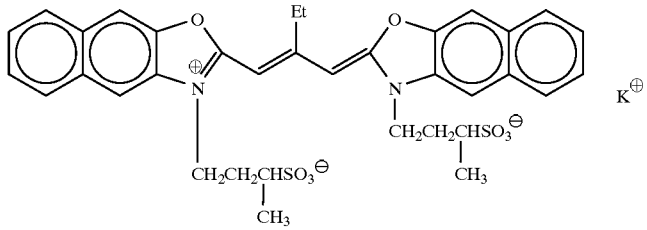

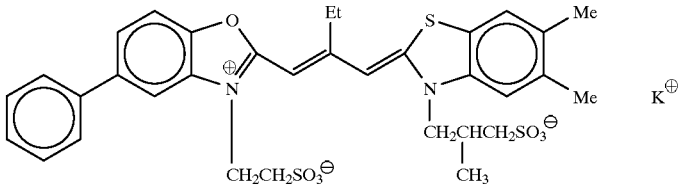

Preparation of Emulsified Substance Containing Coupler

Ten point six (10.6) grams of the following compound as a magenta coupler was dissolved in 11 ml of tricresyl phosphate and 30 ml of ethyl acetate, mixed with 200 ml of a 5% aqueous solution of gelatin, and emulsion dispersed using a colloid mill.

Magenta Coupler

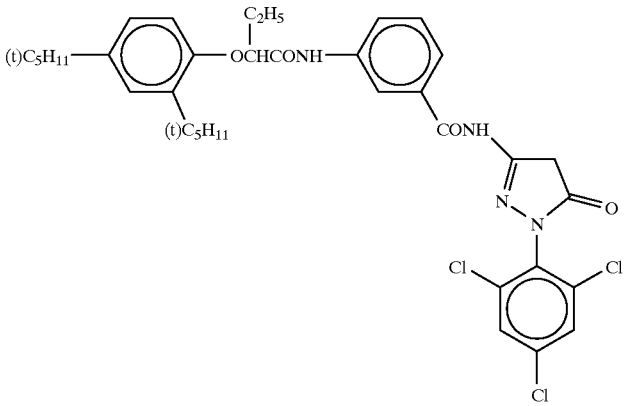

In the preparation of the above emulsified substance, each of the compounds of the present invention or the comparative compounds shown below was dissolved with the magenta coupler with the proportion of each compound being 0.3 mol to 1 mol of the magenta coupler and emulsion dispersed. Emulsified substances shown in Table 1 below were thus obtained.

(COM-1)

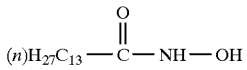

Exemplified compound (A-43) represented by formula (A-I) disclosed in JP-A-7-239540.

(COM-2)

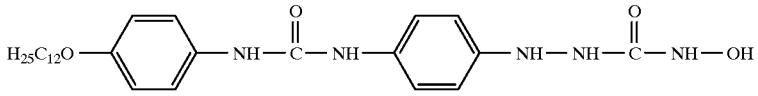

The compound represented by formula (I) disclosed in JP-A-2-841 (this is not exemplified but is allied to exemplified compound (50)).

(COM-3)

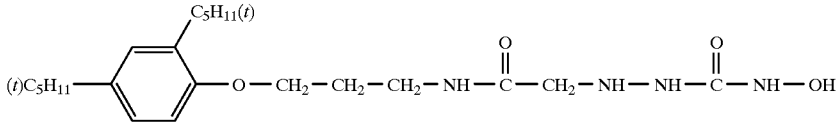

A comparative compound for explaining the present invention.

(COM-4)

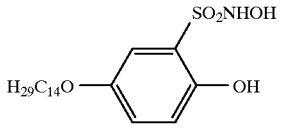

The compound exemplified as a specific example of the compound represented by formula (8) in JP-A-5-165171 (also represented by formula (A-1) in JP-A-7-239540).

TABLE 1

| Name of Emulsified Substance | Compound Added |
|---|---|
| B-1 | None |
| B-2 | (COM-1) |

TABLE 1-continued

| Name of Emulsified Substance | Compound Added |
|---|---|
| B-3 | (COM-2) |
| B-4 | (COM-3) |
| B-5 | (COM-4) |
| B-6 | (S1-1) |
| B-7 | (S1-2) |
| B-8 | (S1-3) |
| B-9 | (S1-5) |
| B-10 | (S1-7) |
| B-11 | (S1-8) |
| B-12 | (S1-10) |
| B-13 | (S1-17) |
| B-14 | (S1-20) |
| B-15 | (S1-22) |

Emulsion B was mixed with each emulsified substance shown in Table 1 and stirred at 40° C. to thereby obtain a finished emulsion. Each of these finished emulsions was aged for 2 hours or 24 hours and then coated on a cellulose triacetate film support under the coating condition shown in Table 2.

TABLE 2

| Coating Condition of Emulsion |
|---|
| (1) Emulsion Layer |
| Emulsion: each kind of emulsion ($2.1 \times 10^{-2}$ mol/m$^2$ as silver) |
| Coupler ($1.5 \times 10^{-3}$ mol/m$^2$) |

TABLE 2-continued

| Coating Condition of Emulsion | |
|---|---|
| 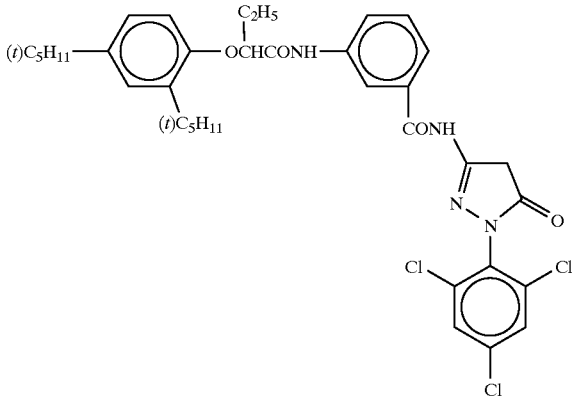 | |
| Tricresyl Phosphate | 1.10 g/m$^2$ |
| Gelatin | 2.30 g/m$^2$ |
| (2) Protective Layer | |
| Sodium 2,4-Dichloro-6-hydroxy-s-triazine | 0.08 g/m$^2$ |
| Gelatin | 1.80 g/m$^2$ |

These samples were allowed to stand under the condition of 40° C., 70% RH for 14 hours. Subsequently, the samples were subjected to exposure for 1/100 seconds through a gelatin filter SC-50, a product of Fuji Photo Film Co., Ltd., and continuous wedge.

Samples were processed according to the following step using Nega Processor FP-350, a product of Fuji Photo Film Co., Ltd., until the accumulated replenishment amount of the processing solution reached 3 times of the capacity of the mother liquid tank.

Processing Step

| Step | Processing Time | Processing Temperature (°C.) | Replenishment* Amount (ml) |
|---|---|---|---|
| Color Development | 3 min 15 sec | 38 | 45 |
| Bleaching | 1 min 00 sec | 38 | 20 The overflow from the bleaching tank was all introduced into the blixing tank. |
| Blixing | 3 min 15 sec | 38 | 30 |
| Washing (1) | 40 sec | 35 | countercurrent system from (2) to (1) |
| Washing (2) | 1 min 00 sec | 35 | 30 |
| Stabilization | 40 sec | 38 | 20 |
| Drying | 1 min 15 sec | 55 | |

*Replenishment rate: per 1.1 meter of 35 mm wide photographic material (corresponding to a 24 ex. film)

The composition of each processing solution is described below.

Color Developing Solution

| | Tank Solution (g) | Replenisher (g) |
|---|---|---|
| Diethylenetriaminepentaacetic Acid | 1.0 | 1.1 |
| 1-Hydroxyethylidene-1,1-diphosphonic Acid | 2.0 | 2.0 |
| Sodium Sulfite | 4.0 | 4.4 |
| Potassium Carbonate | 30.0 | 37.0 |
| Potassium Bromide | 1.4 | 0.7 |
| Potassium Iodide | 1.5 mg | — |
| Hydroxylamine Sulfate | 2.4 | 2.8 |
| 4-[N-Ethyl-N-(β-hydroxyethyl)-amino]-2-methylaniline Sulfate | 4.5 | 5.5 |
| Water to make | 1.0 l | 1.0 l |
| pH (adjusted with potassium hydroxide and sulfuric acid) | 10.05 | 10.10 |

Bleaching Solution (replenisher equals tank solution)

| | (unit: g) |
|---|---|
| Ammonium Ethylenediaminetetraacetato Ferrate Dihydrate | 120.0 |
| Disodium Ethylenediaminetetraacetate | 10.0 |

-continued

| | (unit: g) |
|---|---|
| Ammonium Bromide | 100.0 |
| Ammonium Nitrate | 10.0 |
| Bleach Accelerator $(CH_3)_2N—CH_2—CH_2—S—S—CH_2—CH_2—N(CH_3)_2.2HCl$ | 0.005 mol |
| Aqueous Ammonia (27%) | 15.0 ml |
| Water to make | 1.0 l |
| pH (adjusted with aqueous ammonia and nitric acid) | 6.3 |

Blixing Solution

| | Tank Solution (g) | Replenisher (g) |
|---|---|---|
| Ammonium Ethylenediaminetetra-acetato Ferrate Dihydrate | 50.0 — | |
| Disodium Ethylenediaminetetra-acetate | 5.0 | 2.0 |
| Sodium Sulfite | 12.0 | 20.0 |
| Aqueous Solution of Ammonium Thiosulfate (700 g/liter) | 240.0 ml | 400.0 ml |
| Aqueous Ammonia (27%) | 6.0 ml | — |
| Water to make | 1.0 l | 1.0 l |
| pH (adjusted with aqueous ammonia and acetic acid) | 7.2 | 7.3 |

Washing Water (replenisher equals tank solution)

City water was passed through a mixed bed column packed with an H-type strongly acidic cation exchange resin (Amberlite IR-120B of Rohm & Haas) and an OH-type anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 150 mg/liter of sodium sulfate were added thereto. The pH of this washing water was in the range of from 6.5 to 7.5.

Stabilizing Solution (replenisher equals tank solution)

| | (unit: g) |
|---|---|
| Sodium p-Toluenesulfinate | 0.03 |
| Polyoxyethylene-p-monononylphenyl Ether (average polymerization degree: 10) | 0.2 |
| Disodium Ethylenediaminetetraacetate | 0.05 |
| 1,2,4-Triazole | 1.3 |
| 1,4-Bis(1,2,4-triazol-1-ylmethyl)-piperazine | 0.75 |
| Water to make | 1.0 l |
| pH | 8.5 |

Density of each sample at the time when the accumulated replenishment amount of the processing solution reached 3 times of the capacity of the mother liquid tank was measured using a green filter. By this experiment, the difference in the influence of the compounds of the present invention and the comparative compounds on photographic capabilities of the finished emulsion aged for the various aging time and the difference in the influence thereof on the original color density were evaluated.

Of the samples obtained by the above method, the samples which were aged for 2 hours as finished emulsions underwent the same procedure until exposure, and were allowed to stand under the condition of 60° C., 60% RH for three days not being development processed immediately. These samples were processed with each processing solution used in development processing of the samples which were measured for color density using a green filter described above, and color density was measured using a green filter in the same manner. By this experiment, the fluctuation in photographic properties of each sample due to preservation was evaluated. The results obtained are shown in Table 3 below.

TABLE 3

| Sample No. | Name of Emulsified Substance | Effect of* Storage Stability Improvement | Fogging** due to Aging Time of Finished Emulsion | Color*** Density | Remarks |
|---|---|---|---|---|---|
| 1 | B-1 | 0.45 | — | Control | Comparison |
| 2 | B-2 | 0.23 | 0.31 | — | Comparison |
| 3 | B-3 | 0.24 | 0.09 | −0.53 | Comparison |
| 4 | B-4 | 0.25 | 0.10 | −0.61 | Comparison |
| 5 | B-5 | 0.43 | 0.36 | — | Comparison |
| 6 | B-6 | 0.03 | 0.02 | 0.00 | Invention |
| 7 | B-7 | 0.14 | 0.06 | −0.01 | Invention |
| 8 | B-8 | 0.25 | 0.10 | −0.04 | Invention |
| 9 | B-9 | 0.21 | 0.08 | −0.03 | Invention |
| 10 | B-10 | 0.15 | 0.04 | 0.00 | Invention |
| 11 | B-11 | 0.04 | 0.01 | −0.01 | Invention |
| 12 | B-12 | 0.20 | 0.09 | −0.10 | Invention |
| 13 | B-13 | 0.09 | 0.04 | 0.01 | Invention |
| 14 | B-14 | 0.04 | 0.02 | −0.01 | Invention |
| 15 | B-15 | 0.03 | 0.02 | 0.00 | Invention |

*Effect of storage stability improvement was evaluated using samples which were aged for 2 hours as finished emulsions by the increase of the fog level of the sample which was allowed to stand under the condition of 60° C., 60% RH for three days after exposure to the fog level of the sample immediately development processed after exposure. The larger the value, the more is the fog increase.

**The fog due to the aged time of the finished emulsion was evaluated by the increase of the fog level of the sample aged for 24 hours as a finished emulsion to the fog level of the sample aged for 2 hours as a finished emulsion. The larger the value, the more is the fog increase. Both samples were development processed immediately after exposure.

***Color density was compared under conditions that each sample was aged for 2 hours, and immediately development processed after exposure. The reduction of color density of each sample was evaluated at the same exposure amount as that of Sample No. 1 giving fog density plus 1.5. The smaller the value, the more is the reduction of color density.

As is apparent from the results in Table 3, Sample Nos. 2 to 14 containing the emulsified substance to which compounds having a hydroxylamino group is added showed the effect of the storage stability improvement, that is, the fluctuation in photographic properties due to the difference in storage condition of the photographic material after exposure until development processing is suppressed compared with Sample No. 1 to which any compound having a hydroxylamino group is not added. However, in Sample Nos. 2 and 5, a new problem of the fluctuation in photographic properties due to the aging time of the finished emulsion arose, and in Sample Nos. 3 and 4, coloring hindrance occurred in the exposure region where a magenta coupler need to color in comparatively high density due to the addition of the compound to the emulsified substance. All of the comparative compounds cannot satisfy three photographic capabilities at the same time, on the contrary, the compounds according to the present invention can suppress the degradation of the finished emulsion due to aging and coloring hindrance of a magenta coupler to a smaller degree while maintaining the effect of storage stability improvement. These results have been found for the first time by the present inventors and cannot be absolutely foreseen from the conventional techniques.

Further, the difference between the comparative compounds and the compounds according to the present invention is explained in detail from the point of chemical structure. When applying Compound (COM-2) contained in the emulsified substance of Sample No. 3 to the compound represented by formula (S1), $R_{11}$ corresponds to an aryl group and $R_{12}$ corresponds to a hydrogen atom. Further, when applying Compound (COM-3) contained in the emulsified substance of Sample No. 4 to the compound represented by formula (S1), $R_{11}$ corresponds to an alkyl group and $R_{12}$ corresponds to a hydrogen atom. As is shown in Table 3, these compounds generate conspicuous coloring hindrance, while coloring hindrance is suppressed to a smaller degree in Sample No. 12 containing Compound (S1-10) of the present invention. (COM-3) wherein a methyl group is incorporated to $R_{12}$ is Compound (S1-10). That is, coloring hindrance of a magenta coupler is conspicuous when $R_{11}$ has an alkyl group or an aryl group and $R_{12}$ has a hydrogen atom in the compound represented by formula (S1), and the hindrance is small when $R_{11}$ and $R_{12}$ each represents an alkyl group. Further, when $R_{11}$ represents an acyl group or a carbamoyl group, coloring hindrance of a magenta coupler is small even if $R_{12}$ represents a hydrogen atom. That is, it is apparent that coloring hindrance of a magenta coupler is influenced by the combination of substituents at specific positions ($R_{11}$ and $R_{12}$) of the compound, this point cannot be forecast from the conventional techniques.

Further, it can be understood from the results in Table 3 that the effect of storage stability improvement is remarkably large when the compound represented by formula (S1) wherein $R_{11}$ represents an acyl group or a carbamoyl group, $R_{12}$ represents a hydrogen atom, $R_{13}$ represents a hydrogen atom, $R_{14}$ represents an alkyl group, and L represents —CO—, simultaneously, is used (Sample Nos. 6, 11, 14 and 15).

EXAMPLE 2

1) Support

The support which was used in the present invention was prepared as follows.

One hundred (100) weight parts of polyethylene-2,6-naphthalate polymer and 2 weight parts of Tinuvin P. 326 (product of Ciba Geigy), as an ultraviolet absorber, were dried, then melted at 300° C., subsequently, extruded through a T-type die, and stretched 3.3 times in a machine direction at 140° C. and then 3.3 times in a transverse direction at 130° C., and further thermal fixed for 6 seconds at 250° C. and the PEN film having the thickness of 90 μm was obtained. Appropriate amounts of blue dyes, magenta dyes and yellow dyes were added to this PEN film (I-1, I-4, I-6, I-24, I-26, I-27 and II-5 disclosed in Kokai-Giho, Kogi No. 94–6023). Further, the film was wound on to a stainless steel spool having a diameter of 20 cm and provided heat history at 110° C. for 48 hours to obtain a support reluctant to get curling habit.

2) Coating of Undercoat Layer

After both surfaces of the above support were subjected to corona discharge, UV discharge and glow discharge treatments, on one side of the support an undercoat solution having the following composition was coated (10 ml/m$^2$, using a bar coater): 0.1 g/m$^2$ of gelatin, 0.01 g/m$^2$ of sodium α-sulfo-di-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of polyamideepichlorohydrin polycondensation product. The undercoat layer was provided on the hotter side at the time of stretching. Drying was conducted at 115° C. for 6 minutes (the temperature of the roller and the transporting device of the drying zone was 115° C.).

3) Coating of Backing Layer

On one side of the above support after undercoat layer coating, which side was opposite to the side on which the undercoat solution was coated, an antistatic layer, a magnetically recording layer and a sliding layer having the following compositions were coated as backing layers.

3-1) Coating of Antistatic Layer

Zero point two (0.2) gram/m$^2$ of a dispersion of fine particle powder of a stannic oxide-antimony oxide composite having the average particle size of 0.005 μm and specific resistance of 5 Ω·cm (the particle size of the second agglomerate: about 0.08 μm), 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree: 10) and 0.22 g/m$^2$ of resorcin were coated.

3-2) Coating of Magnetically recording Layer

Zero point zero six (0.06) gram/m$^2$ of cobalt-γ-iron oxide which was coating-treated with 3-polyoxyethylene-propyloxytrimethoxysilane (polymerization degree: 15) (15 wt %) (specific surface area: 43 m$^2$/g, major axis: 0.14 μm, minor axis: 0.03 μm, saturation magnetization: 89 emu/g, $Fe^{+2}/Fe^{+3}$ is 6/94, the surface was treated with 2 wt %, respectively, based on the iron oxide, of aluminum oxide and silicon oxide), 1.2 g/m$^2$ of diacetyl cellulose (dispersion of the iron oxide was carried out using an open kneader and a sand mill) and 0.3 g/m$^2$ of $C_2H_5C[CH_2OCONH\text{-}C_6H_3(CH_3)NCO]_3$ as a curing agent, with acetone, methyl ethyl ketone and cyclohexanone as solvents, were coated with a bar coater to obtain a magnetically recording layer having the film thickness of 1.2 μm. Ten (10) mg/m$^2$ of silica particles (0.3 μm) as a matting agent and 10 mg/m$^2$ of an aluminum oxide abrasive (0.15 μm) coating-treated with 3-polyoxyethylene-propyloxytrimethoxysilane (polymerization degree: 15) (15 wt %) were added. Drying was conducted at 115° C. for 6 minutes (the temperature of the roller and the transporting device of the drying zone was 115° C.). The increase of the color density of $D^B$ of the magnetically recording layer by X-light (a blue filter) was about 0.1, and saturation magnetization moment of the magnetically recording layer was 4.2 emu/g, coercive force was $7.3\times10^4$ A/m, and rectangular ratio was 65%.

3-3) Preparation of Sliding Layer

Diacetyl cellulose (25 mg/m$^2$), and a mixture of $C_6H_{13}CH(OH)C_{10}H_{20}COOC_{40}H_{81}$ (Compound a, 6 mg/m$^2$)/$C_{50}H_{101}O(CH_2CH_2O)_{16}H$ (Compound b, 9 mg/m$^2$) were coated. This mixture of Compound a/Compound b was dissolved in xylene/propylene glycol monomethyl ether (1/1) by heating at 105° C., and poured into propylene glycol monomethyl ether (10 times amount) at room temperature and dispersed, and further dispersed in acetone (average grain size: 0.01 μm), then added to the coating solution. Silica grains (0.3 μm), as a matting agent and aluminum oxide (0.15 μm) coated with 3-polyoxyethylene-propyloxytrimethoxysilane (polymerization degree: 15) (15 wt %), as an abrasive were added each in an amount of 15 mg/m$^2$. Drying was conducted at 115° C. for 6 minutes (the temperature of the roller and transporting device of the drying zone was 115° C.). The thus-obtained sliding layer showed excellent characteristic of dynamic friction coefficient of 0.06 (a stainless steel hard ball of 5 mmϕ, load: 100 g, speed: 6 cm/min), static friction coefficient of 0.07 (a clip method), and the sliding property with the surface of the emulsion described below provided dynamic friction coefficient of 0.12.

4) Coating of light-sensitive layer

Next, each layer having the following composition was multilayer coated on the opposite side of the above obtained backing layer and a color negative film was prepared as Sample No. 201.

Composition of Light-Sensitive Layer

The main components for use in each layer are classified as follows:

ExC: Cyan Coupler

ExM: Magenta Coupler

ExY: Yellow Coupler

ExS: Sensitizing Dye

UV: Ultraviolet Absorber

HBS: High Boiling Point Organic Solvent

H: Hardening Agent for Gelatin

The numeral corresponding to each component indicates the coated weight in unit of g/m$^2$, and the coated weight of silver halide is shown as the calculated weight of silver. Further, in the case of a sensitizing dye, the coated weight is indicated in unit of mol per mol of silver halide in the same layer.

Sample No. 201

| | |
|---|---|
| First Layer: First Antihalation Layer | |
| Black Colloidal Silver | 0.08 as silver |
| Gelatin | 0.70 |
| Second Layer: Second Antihalation Layer | |
| Black Colloidal Silver | 0.09 as silver |
| Gelatin | 1.00 |
| ExM-1 | 0.12 |
| ExF-1 | $2.0 \times 10^{-3}$ |
| Solid Dispersion Dye ExF-2 | 0.030 |
| Solid Dispersion Dye ExF-3 | 0.040 |
| HBS-1 | 0.15 |
| HBS-2 | 0.02 |
| Third Layer: Interlayer | |
| Silver Iodobromide Emulsion N | 0.06 as silver |
| ExC-2 | 0.05 |
| Polyethyl Acrylate Latex | 0.20 |
| Gelatin | 0.70 |
| Fourth Layer: Low Sensitivity Red-Sensitive Emulsion Layer | |
| Silver Iodobromide Emulsion A | 0.07 as silver |
| Silver Iodobromide Emulsion B | 0.28 as silver |
| ExS-1 | $3.3 \times 10^{-4}$ |
| ExS-2 | $1.4 \times 10^{-5}$ |
| ExS-3 | $4.6 \times 10^{-4}$ |
| ExC-1 | 0.17 |

-continued

| | |
|---|---|
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 1.10 |
| Fifth Layer: Middle Sensitivity Red-Sensitive Emulsion Layer | |
| Silver Iodobromide Emulsion C | 0.75 as silver |
| ExS-1 | $4.2 \times 10^{-4}$ |
| ExS-2 | $1.8 \times 10^{-5}$ |
| ExS-3 | $5.9 \times 10^{-4}$ |
| ExC-1 | 0.15 |
| ExC-2 | 0.04 |
| ExC-3 | 0.05 |
| ExC-4 | 0.08 |
| ExC-5 | 0.02 |
| ExC-6 | 0.015 |
| Cpd-4 | 0.02 |
| Cpd-2 | 0.02 |
| HBS-1 | 0.10 |
| Gelatin | 0.80 |
| Sixth Layer: High Sensitivity Red-Sensitive Emulsion Layer | |
| Silver Iodobromide Emulsion D | 1.30 as silver |
| ExS-1 | $3.5 \times 10^{-4}$ |
| ExS-2 | $1.5 \times 10^{-5}$ |
| ExS-3 | $4.9 \times 10^{-4}$ |
| ExC-1 | 0.08 |
| ExC-3 | 0.03 |
| ExC-6 | 0.020 |
| ExC-7 | 0.010 |
| Cpd-2 | 0.040 |
| Cpd-4 | 0.040 |
| HBS-1 | 0.22 |
| HBS-2 | 0.050 |
| Gelatin | 1.10 |
| Seventh Layer: Interlayer | |
| Cpd-1 | 0.060 |
| Solid Dispersion Dye ExF-4 | 0.030 |
| HBS-1 | 0.040 |
| Polyethyl Acrylate Latex | 0.15 |
| Gelatin | 1.10 |
| Eighth Layer: Low Sensitivity Green-Sensitive Emulsion Layer | |
| Silver Iodobromide Emulsion E | 0.27 as silver |
| Silver Iodobromide Emulsion F | 0.22 as silver |
| Silver Iodobromide Emulsion G | 0.16 as silver |
| ExS-7 | $7.5 \times 10^{-4}$ |
| ExS-8 | $3.4 \times 10^{-4}$ |
| ExS-4 | $2.5 \times 10^{-5}$ |
| ExS-5 | $9.0 \times 10^{-5}$ |
| ExS-6 | $4.3 \times 10^{-4}$ |
| ExM-3 | 0.22 |
| ExM-4 | 0.07 |
| ExY-1 | 0.01 |
| ExY-5 | 0.0020 |
| HBS-1 | 0.30 |
| HBS-3 | 0.015 |
| Cpd-4 | 0.010 |
| Gelatin | 0.95 |
| Ninth Layer: Middle Sensitivity Green-Sensitive Emulsion Layer | |
| Silver Iodobromide Emulsion G | 0.45 as silver |
| Silver Iodobromide Emulsion H | 0.35 as silver |
| ExS-4 | $3.6 \times 10^{-5}$ |
| ExS-7 | $1.7 \times 10^{-4}$ |
| ExS-8 | $8.0 \times 10^{-4}$ |
| ExC-8 | 0.0020 |
| ExM-3 | 0.193 |
| ExM-4 | 0.05 |
| ExY-1 | 0.015 |
| ExY-4 | 0.005 |
| ExY-5 | 0.002 |
| Cpd-4 | 0.015 |
| HBS-1 | 0.13 |
| HBS-3 | $4.4 \times 10^{-3}$ |
| Gelatin | 0.80 |

-continued

| Tenth Layer: High Sensitivity Green-Sensitive Emulsion Layer | |
|---|---|
| Silver Iodobromide Emulsion I | 1.40 as silver |
| ExS-4 | $6.3 \times 10^{-5}$ |
| ExS-7 | $1.7 \times 10^{-4}$ |
| ExS-8 | $7.8 \times 10^{-4}$ |
| ExC-6 | 0.01 |
| ExM-4 | 0.005 |
| ExM-2 | 0.020 |
| ExM-5 | 0.001 |
| ExM-6 | 0.001 |
| ExM-7 | 0.005 |
| ExM-3 | 0.02 |
| Cpd-3 | 0.001 |
| Cpd-4 | 0.040 |
| HBS-1 | 0.25 |
| Polyethyl Acrylate Latex | 0.15 |
| Gelatin | 1.33 |
| Eleventh Layer: Yellow Filter Layer | |
| Yellow Colloidal Silver | 0.015 as silver |
| Cpd-1 | 0.16 |
| Solid Dispersion Dye ExF-5 | 0.060 |
| Solid Dispersion Dye ExF-6 | 0.060 |
| Oil-Soluble Dye ExF-7 | 0.010 |
| HBS-1 | 0.60 |
| Gelatin | 0.60 |
| Twelfth Layer: Low Sensitivity Blue-Sensitive Emulsion Layer | |
| Silver Iodobromide Emulsion J | 0.07 as silver |
| Silver Iodobromide Emulsion K | 0.13 as silver |
| Silver Iodobromide Emulsion L | 0.19 as silver |
| ExS-9 | $8.4 \times 10^{-4}$ |
| ExC-1 | 0.03 |
| ExC-8 | $7.0 \times 10^{-3}$ |
| ExY-1 | 0.060 |
| ExY-2 | 0.75 |
| ExY-3 | 0.40 |
| ExY-4 | 0.040 |
| Cpd-2 | 0.005 |
| Cpd-4 | 0.005 |
| Cpd-3 | 0.004 |

-continued

| | |
|---|---|
| HBS-1 | 0.28 |
| Gelatin | 2.60 |
| Thirteenth Layer: High Sensitivity Blue-Sensitive Emulsion Layer | |
| Silver Iodobromide Emulsion M | 0.37 as silver |
| ExS-9 | $6.0 \times 10^{-4}$ |

-continued

| | |
|---|---|
| ExY-2 | 0.070 |
| ExY-3 | 0.020 |
| ExY-4 | 0.0050 |
| ExY-6 | 0.0050 |
| Cpd-2 | 0.10 |
| Cpd-3 | $1.0 \times 10^{-3}$ |
| Cpd-4 | $5.0 \times 10^{-3}$ |
| HBS-1 | 0.075 |
| Gelatin | 0.55 |
| Fourteenth Layer: First Protective Layer | |
| Silver Iodobromide Emulsion N | 0.10 as silver |
| UV-1 | 0.13 |
| UV-2 | 0.10 |
| UV-3 | 0.16 |
| UV-4 | 0.025 |
| ExF-8 | 0.03 |
| ExF-9 | 0.005 |
| ExF-10 | 0.005 |
| ExF-11 | 0.02 |
| HBS-1 | $5.0 \times 10^{-2}$ |
| HBS-4 | $5.0 \times 10^{-2}$ |
| Gelatin | 1.8 |
| Fifteenth Layer: Second protective Layer | |
| H-1 | 0.40 |
| B-1 (diameter: 1.7 μm) | 0.04 |
| B-2 (diameter: 1.7 μm) | 0.09 |
| B-3 | 0.13 |
| ES-1 | 0.20 |
| Gelatin | 0.70 |

Further, W-1 to W-3, B-4 to B-6, F-1 to F-18, iron salt, lead salt, gold salt, platinum salt, palladium salt, iridium salt are rhodium salt were appropriately included in each layer to improve storage stability, processing properties, pressure resistance, fungicidal and biocidal properties, antistatic properties and coating properties.

TABLE 4

| Emulsion | Average AgI Content (%) | Average Grain Size, Equivalent-Sphere Diameter (μm) | Variation Coefficient of the Grain Size (%) | Projected Area, Equivalent-Circle Diameter (μm) | Diameter/Thickness Ratio | Tabularity |
|---|---|---|---|---|---|---|
| A | 3.7 | 0.37 | 13 | 0.43 | 2.3 | 12 |
| B | 3.7 | 0.43 | 19 | 0.58 | 3.2 | 18 |
| C | 5.0 | 0.55 | 20 | 0.86 | 6.2 | 45 |
| D | 5.4 | 0.66 | 23 | 1.10 | 7.0 | 45 |
| E | 3.7 | 0.37 | 13 | 0.43 | 2.3 | 12 |
| F | 3.7 | 0.43 | 19 | 0.58 | 3.2 | 18 |
| G | 5.4 | 0.55 | 20 | 0.86 | 6.2 | 45 |
| H | 5.4 | 0.66 | 23 | 1.10 | 7.0 | 45 |
| I | 5.4 | 0.72 | 23 | 1.10 | 6.3 | 36 |
| J | 3.7 | 0.37 | 19 | 0.55 | 4.6 | 38 |
| K | 3.7 | 0.37 | 19 | 0.55 | 4.6 | 38 |
| L | 8.8 | 0.64 | 23 | 0.85 | 5.2 | 32 |
| M | 6.8 | 0.88 | 30 | 1.12 | 4.7 | 20 |
| N | 1.0 | 0.07 | — | — | 1.0 | — |

In Table 4:

(1) Emulsions J to M were reduction sensitized during preparation of the grains using thiourea dioxide and thiosulfonic acid according to the examples of JP-A-2-191938 (corresponding to U.S. Pat. No. 5,061,614).

(2) Emulsions C to I and M were gold, sulfur, and selenium sensitized, respectively, in the presence of the spectral sensitizing dyes which are described at each light-sensitive layer and sodium thiocyanate according to the examples of JP-A-3-237450 (corresponding to EP-A-443453).

(3) Low molecular weight gelatin was used in the preparation of the tabular grains according to the examples of JP-A-1-158426.

(4) In tabular grains, there were observed such dislocation lines as disclosed in JP-A-3-237450 (corresponding to EP-A-443453), using a high pressure electron microscope.

(5) Emulsions A to E, G, H, and J to M contained optimal amounts of Rh, Ir and Fe.

Further, tabularity is defined by $Dc/t^2$, taking the average equivalent-circle diameter in the projected area of tabular grains as Dc and the average thickness of tabular grains as t.

Preparation of Dispersion of Organic Solid Dispersion Dye

ExF-2 shown below was dispersed according to the following method. That is, 21.7 ml of water, 3 ml of a 5% aqueous solution of sodium p-octylphenoxyethoxyethoxyethane. sulfonate, and 0.5 g of a 5% aqueous solution of p-octylphenoxypolyoxyethylene ether (polymerization degree: 10) were put in a pot mill having a capacity of 700 ml, and 5.0 g of Dye ExF-2 and 500 ml of zirconium oxide beads (diameter: 1 mm) were added thereto and the content was dispersed for 2 hours. The dispersion was performed using a BO-type vibrating ball mill manufactured by Chuo Koki K. K. The content was taken out after dispersion and added to 8 g of a 12.5% aqueous solution of gelatin and the beads were removed by filtration and the gelatin dispersion of the dye was obtained. The average particle size of fine particles of the dye was 0.44 μm.

Solid dispersions of ExF-3, ExF-4 and ExF-6 were obtained in the same manner. The average particle sizes of fine particles of the dyes were 0.24 μm, 0.45 μm and 0.52 μm, respectively. ExF-5 was dispersed according to the microprecipitation dispersion method disclosed in Working Example 1 of EP-A-549489. The average particle size was 0.06 μm.

ExC-1

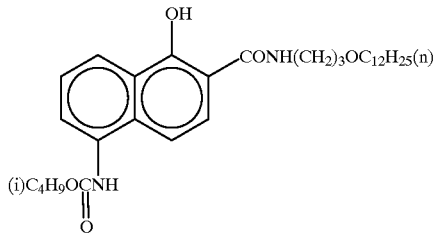

ExC-2

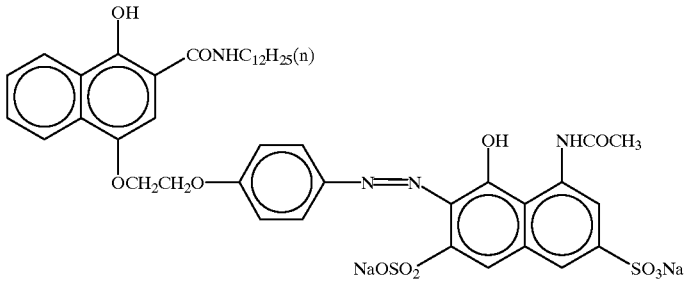

ExC-3

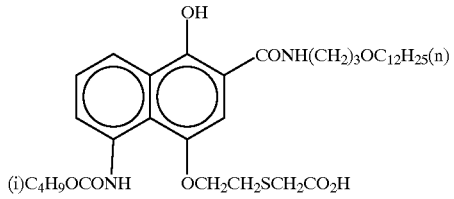

ExC-4

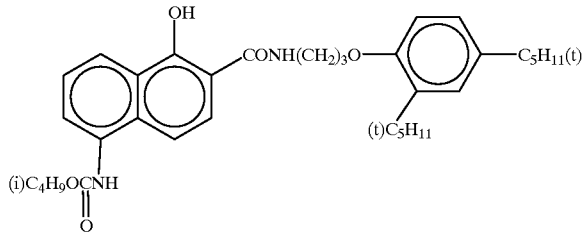

-continued
ExC-5
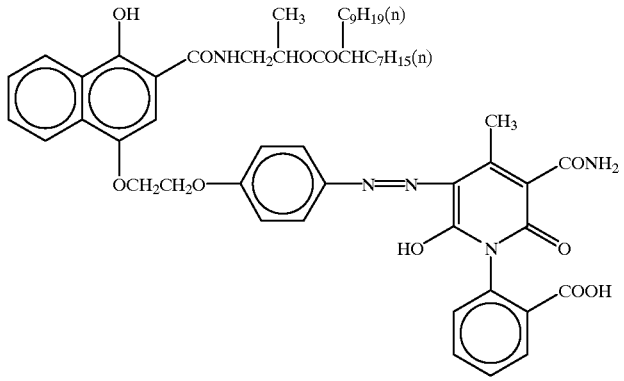
ExC-6
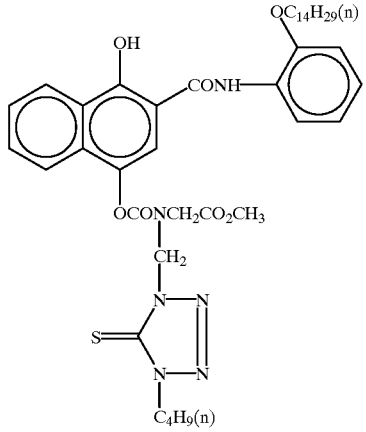
ExC-7
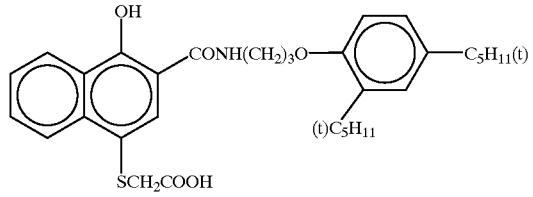
ExC-8
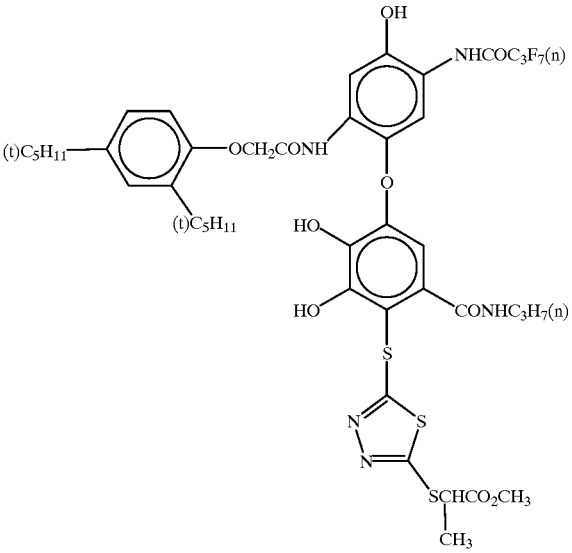

-continued
ExM-1
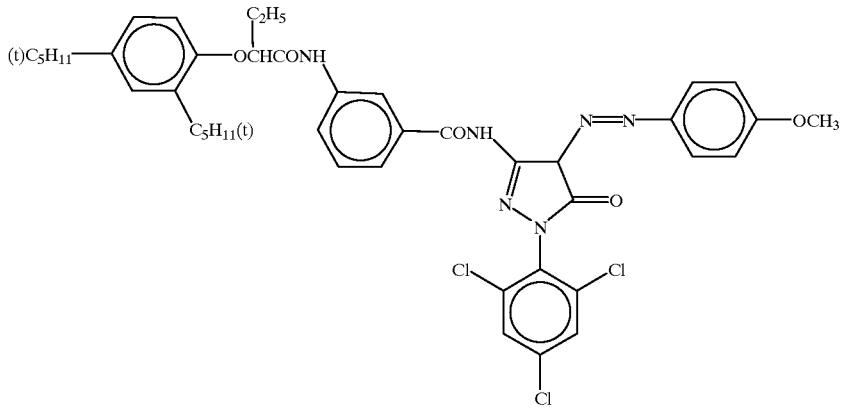
ExM-2
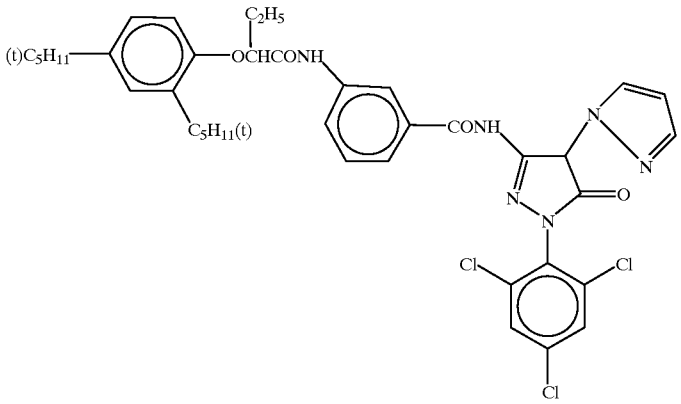
ExM-3
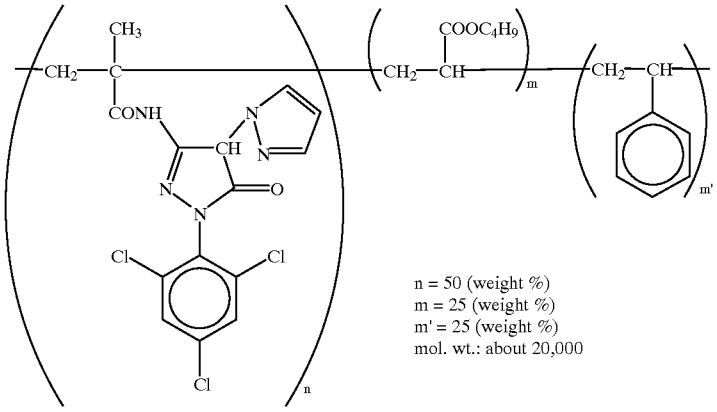
n = 50 (weight %)
m = 25 (weight %)
m' = 25 (weight %)
mol. wt.: about 20,000

-continued
ExM-4
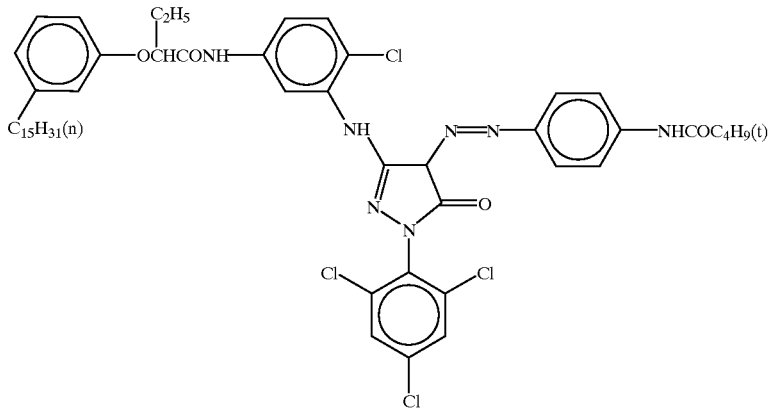
ExM-5
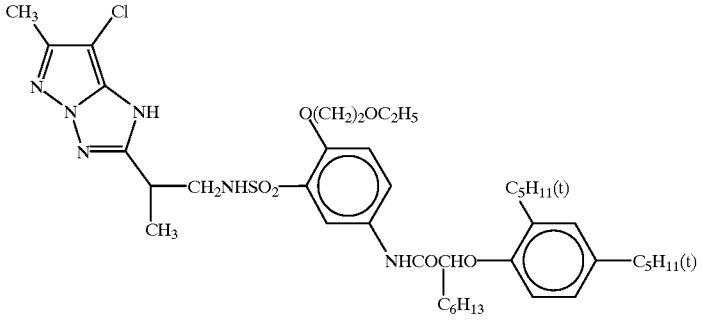
ExM-6
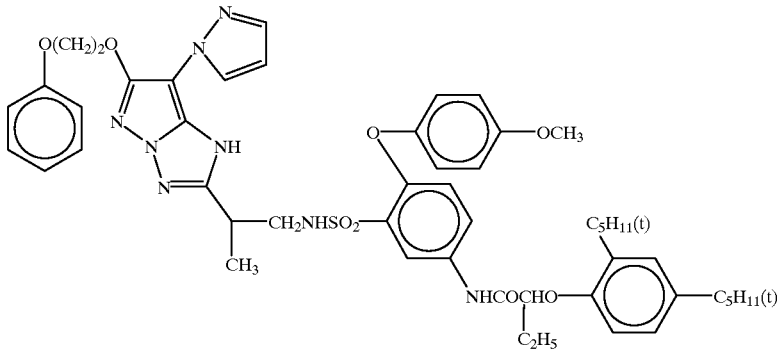
ExY-1
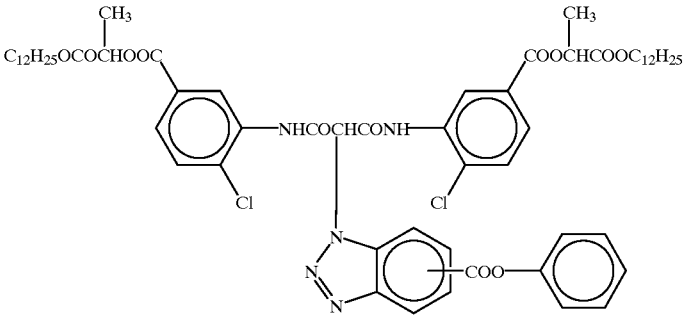

-continued
ExM-7
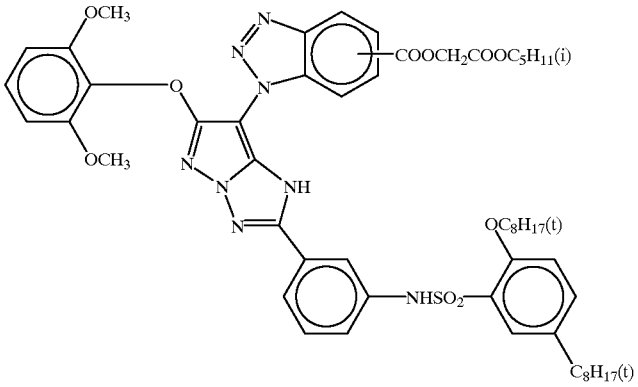
ExY-2
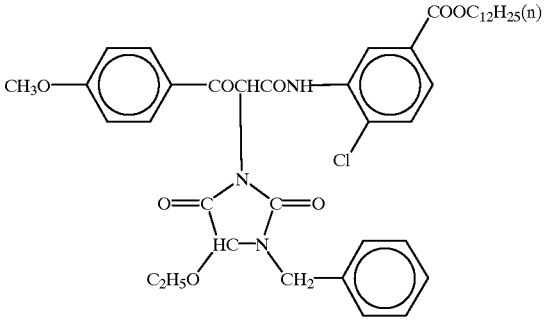
ExY-3
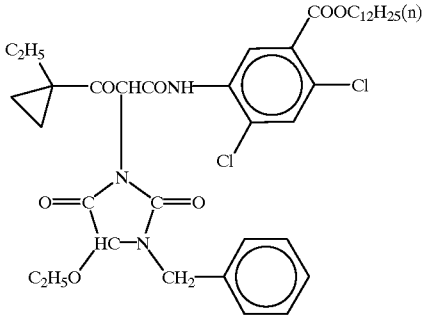
ExY-4
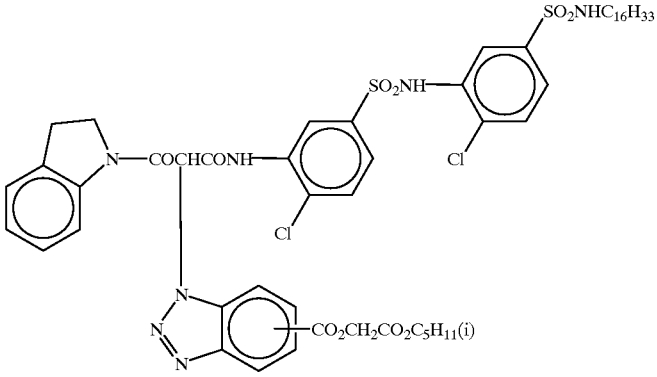

-continued
ExY-5
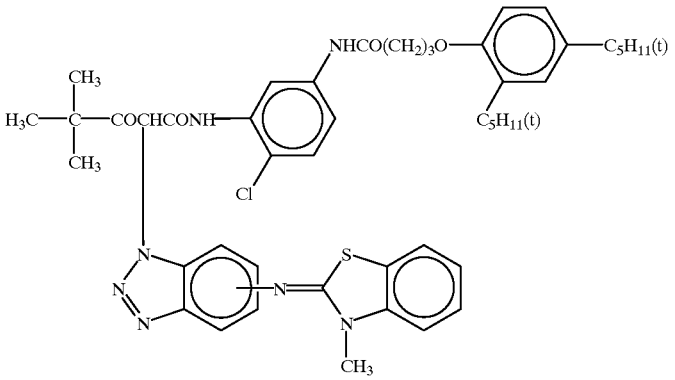
ExY-6
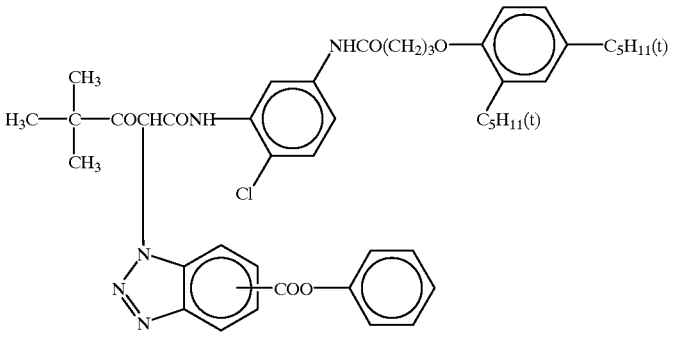
ExF-1
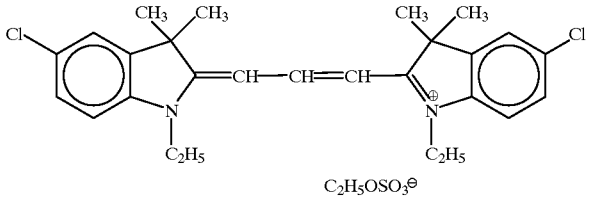
ExF-2
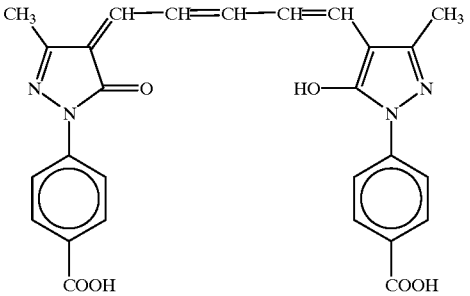
ExF-3
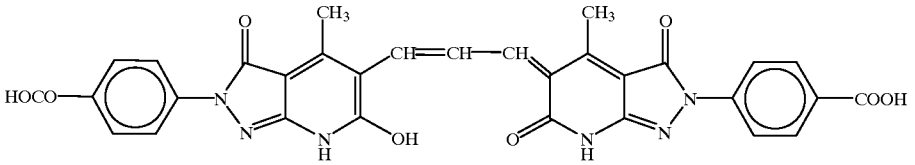

-continued
ExF-4
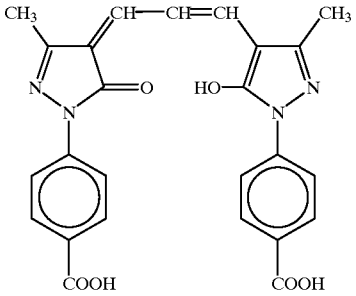
ExF-5
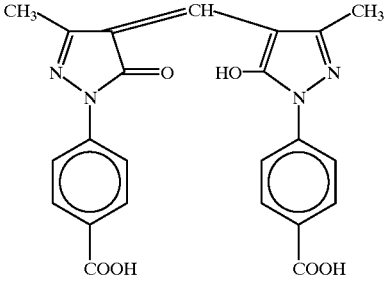
ExF-6
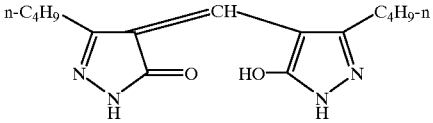
ExF-7
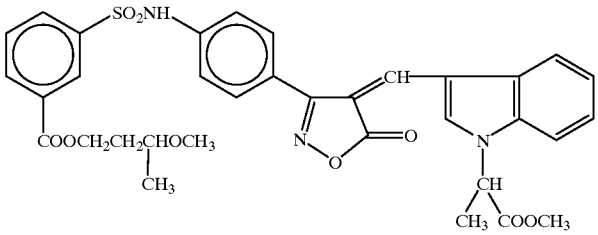
ExF-8
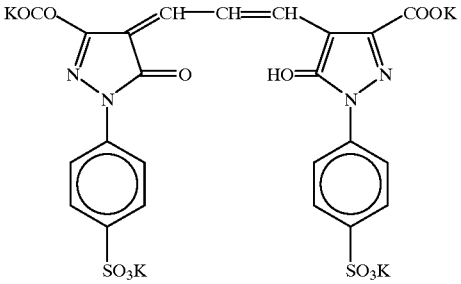
ExF-9
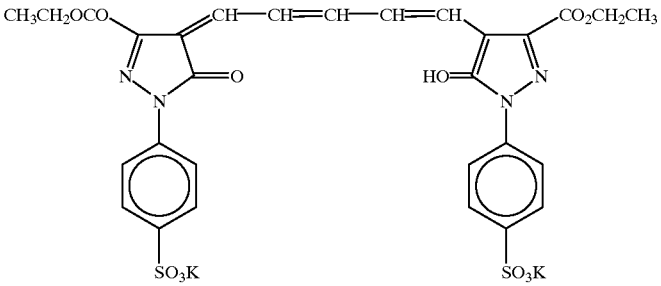

-continued
ExF-10
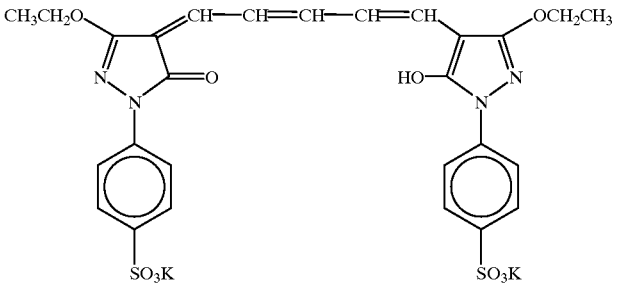
ExF-11
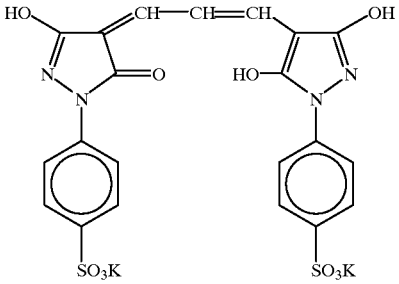
Cpd-1
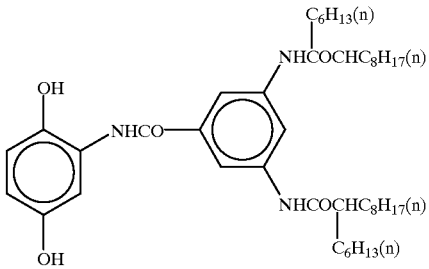
Cpd-2
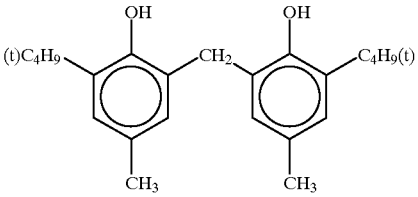
Cpd-3
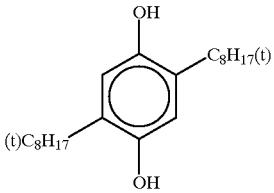
Cpd-4
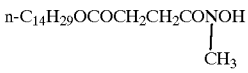
UV-1
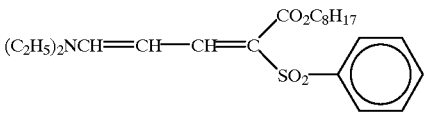

-continued
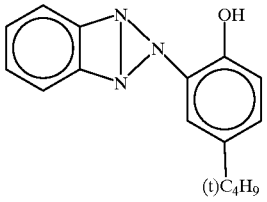
UV-2
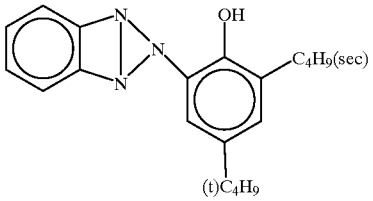
UV-3
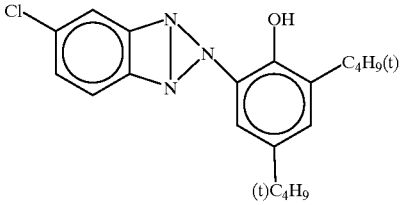
UV-4
Tricresyl Phosphate HBS-1
Di-n-butyl Phthalate HBS-2
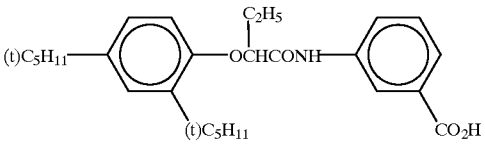
HBS-3
Tri (2-ethylhexyl) Phosphate HBS-3
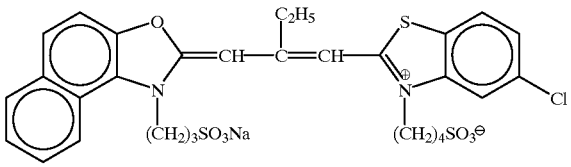
ExS-1
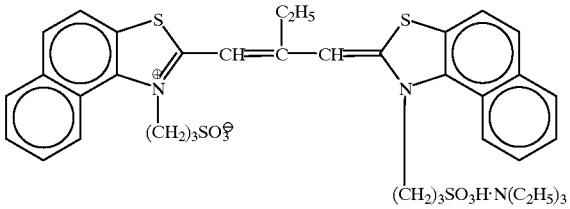
ExS-2

-continued
ExS-3
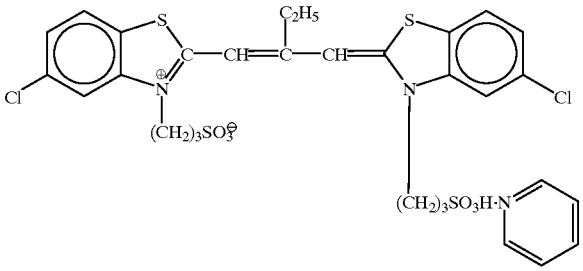
ExS-4
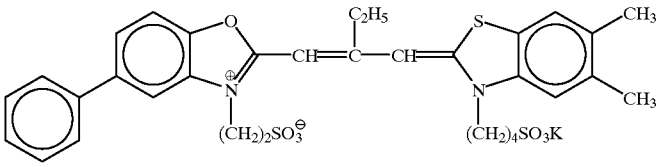
ExS-5
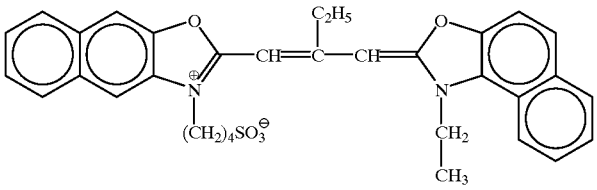
ExS-6
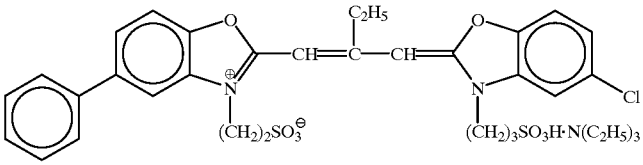
ExS-7
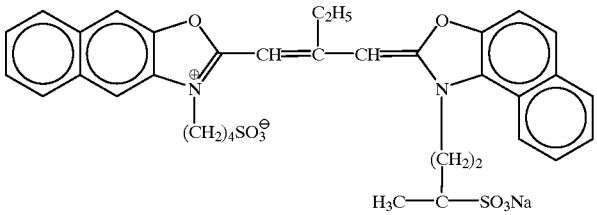
ExS-8
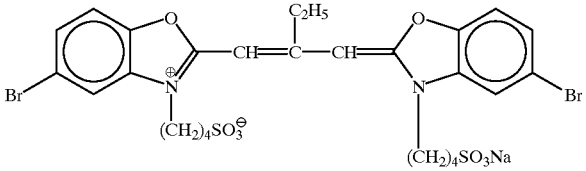
ExS-9
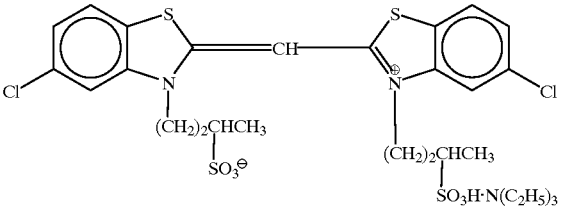

-continued
ES-1
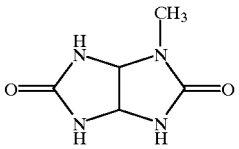
H-1
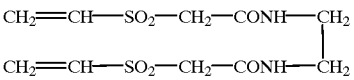
B-1
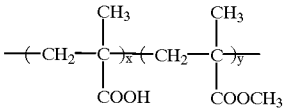
x/y = 10/90 (weight ratio)
average molecular weight:
about 35,000
B-2
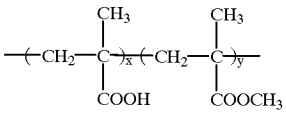
x/y = 45/55 (weight ratio)
average molecular weight:
about 20,000
B-3
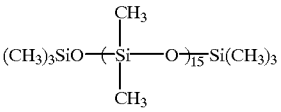
B-4
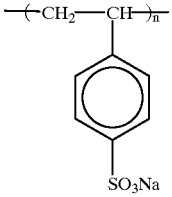
average molecular weight:
about 750,000
n = an integer
B-5
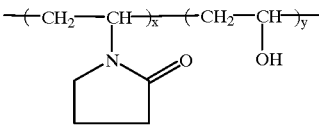
x/y = 70/30 (weight ratio)
average molecular weight:
about 17,000
B-6
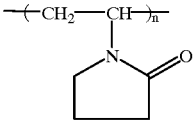
average molecular weight:
about 10,000
n = an integer
W-1
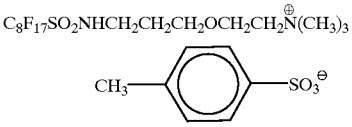
W-2
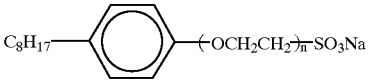
n = 2 ~ 4
W-3
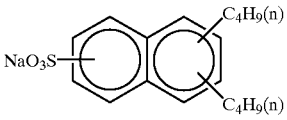

-continued
F-1
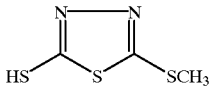
F-2
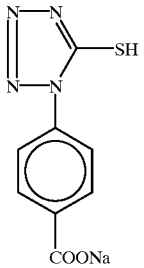
F-3
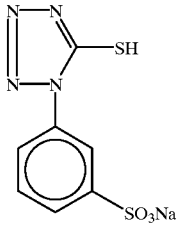
F-4
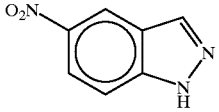
F-5
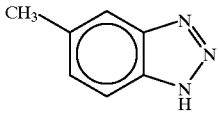
F-6
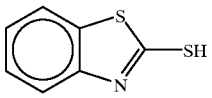
F-7
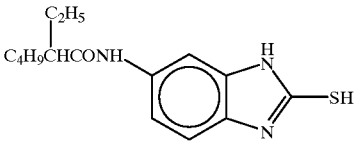
F-8
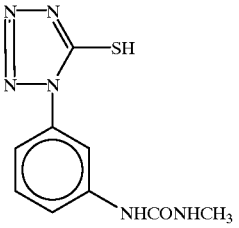
F-9
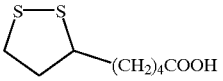

-continued

F-10

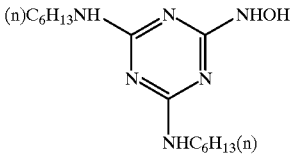

F-11

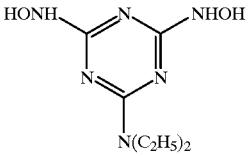

F-12

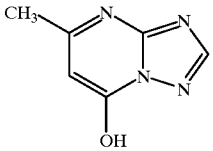

F-13

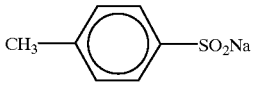

F-14

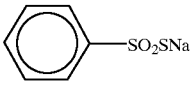

F-15

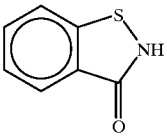

F-16

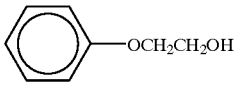

F-17

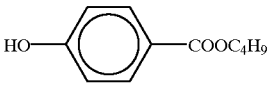

F-18

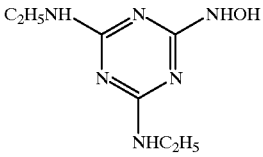

The thus prepared photographic material was cut to a size of 24 mm in width and 160 cm in length, and two perforations of 2 mm square at an interval of 5.8 mm were provided 0.7 mm inside from one side width direction in the length direction of the photographic material. The sample provided with this set of two perforations at intervals of 32 mm was prepared and encased in the film cartridge made of plastics as explained in FIG. 1 to FIG. 7 in U.S. Pat. No. 5,296,887.

FM signals were recorded between the above perforations of the sample from the side of the support having the magnetically recording layer using a head capable of in and out of 2,000 turns with head gap of 5 $\mu$m at a feed rate of 1,000 mm/s.

After FM signals were recorded, the emulsion surface was subjected to entire and uniform exposure of 1,000 cms and each process was conducted according to the following method, and each sample was put in the above plastic film cartridge again.

Sample No. 201 cut to a width of 35 mm and photographed with a camera was processed (running process) at a rate of 1 $m^2$ per a day for 15 days as follows.

Each processing was conducted using an automatic processor FP-360B manufactured by Fuji Photo Film Co., Ltd. according to the following step. Further, the processor was modified so that the overflow from the bleaching bath was discharged to the waste solution tank not to flow to the after bath. FP-360B processor carried the evaporation compensating means disclosed in Hatsumei Kyokai Kokai Giho No. 94-4992.

The processing step and the composition of each processing solution are as follows.

Processing Step

| Step | Processing Time | Processing Temperature (°C.) | Replenishment Rate* (ml) | Tank Capacity (liter) |
|---|---|---|---|---|
| Color Development | 3 min 5 sec | 38.0 | 20 | 17 |
| Bleaching | 50 sec | 38.0 | 5 | 5 |
| Fixing (1) | 50 sec | 38.0 | — | 5 |
| Fixing (2) | 50 sec | 38.0 | 8 | 5 |
| Washing | 30 sec | 38.0 | 17 | 3.5 |
| Stabilization (1) | 20 sec | 38.0 | — | 3 |
| Stabilization (2) | 20 sec | 38.0 | 15 | 3 |
| Drying | 1 min 30 sec | 60 | | |

*Replenishment rate: per 1.1 meter of 35 mm wide photographic material (corresponding to a 24 ex. film)

Stabilization was conducted in a countercurrent system from (2) to (1), and the overflow from the washing tank was all introduced into the fixing tank (2). Fixation was also conducted in a countercurrent system and fixing tanks were connected by countercurrent piping from (2) to (1). Further, the amount of carryover of the developing solution into the bleaching step, the amount of carryover of the bleaching solution to the fixing step, and the amount of carryover of the fixing solution to the washing step were 2.5 ml, 2.0 ml and 2.0 ml per 1.1 meter of 35 mm wide photographic material, respectively. Further, the crossover time was 6 seconds in each case, and this time is included in the processing time of the previous step.

Open areas of the above processor were 100 $cm^2$ with the color developing solution, 120 $cm^2$ with the bleaching solution and about 100 $cm^2$ with each of other processing solutions.

The composition of each processing solution is described below.

Color Developing Solution

| | Tank Solution (g) | Replenisher (g) |
|---|---|---|
| Diethylenetriaminepentaacetic Acid | 2.0 | 2.0 |
| 1-Hydroxyethylidene-1,1-diphosphonic Acid | 2.0 | 2.0 |
| Sodium Sulfite | 3.9 | 5.3 |
| Potassium Carbonate | 37.5 | 39.0 |
| Potassium Bromide | 1.4 | 0.4 |
| Potassium Iodide | 1.3 mg | — |
| Disodium N,N-Bis(sulfonatoethyl)hydroxylamine | 2.0 | 2.0 |
| Hydroxylamine Sulfate | 2.4 | 3.3 |
| 2-Methyl-4-[N-ethyl-N-(β-hydroxy ethyl)amino]aniline Sulfate | 4.5 | 6.4 |
| Water to make | 1.0 l | 1.0 l |
| pH (adjusted with potassium hydroxide and sulfuric acid) | 10.05 | 10.18 |

Bleaching Solution

| | Tank Solution (g) | Replenisher (g) |
|---|---|---|
| Ammonium 1,3-Diaminopropanetetraacetato Ferrate Monohydrate | 118 | 180 |
| Ammonium Bromide | 80 | 115 |
| Ammonium Nitrate | 14 | 21 |
| Succinic Acid | 40 | 60 |
| Maleic Acid | 33 | 50 |
| Water to make | 1.0l | 1.0l |
| pH (adjusted with aqueous ammonia) | 4.4 | 4.0 |

Fixing Solution

| | Tank Solution (g) | Replenisher (g) |
|---|---|---|
| Ammonium Methanesulfinate | 10 | 30 |
| Ammonium Methanethiosulfonate | 4 | 12 |
| Aqueous Ammonium Thiosulfate Solution (700 g/liter) | 280 ml | 840 ml |
| Imidazole | 7 | 20 |
| Ethylenediaminetetraacetic Acid | 15 | 45 |
| Water to make | 1.0 l | 1.0 l |
| pH (adjusted with aqueous ammonia and acetic acid) | 7.4 | 7.45 |

Washing Water

City water was passed through a mixed bed column packed with an H-type strongly acidic cation exchange resin (Amberlite IR-120B of Rohm & Haas) and an OH-type strongly basic anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 150 mg/liter of sodium sulfate were added thereto. The pH of this washing water was in the range of from 6.5 to 7.5.

Stabilizing Solution (replenisher equals tank solution)

| | (unit: g) |
|---|---|
| Sodium p-Toluenesulfinate | 0.03 |
| Polyoxyethylene-p-monononylphenyl Ether (average polymerization degree: 10) | 0.2 |
| Disodium Ethylenediaminetetraacetate | 0.05 |
| 1,2,4-Triazole | 1.3 |
| 1,4-Bis(1,2,4-triazol-1-ylmethyl)-piperazine | 0.75 |
| 1,2-Benzisothiazolin-3-one | 0.10 |
| Water to make | 1.0 l |
| pH | 8.5 |

Sample No. 202 was prepared in the same manner as the preparation of Sample No. 201 except that compound (S1-16) according to the present invention was added to the fourth, ninth, and twelfth layers of Sample No. 201 in an amount of 0.04 g/$m^2$, respectively. Further, Sample No. 203 was prepared in the same manner as the preparation of Sample No. 202 except that compound (S1-20) was used in place of (S1-16) which was used in Sample No. 202.

The thus-prepared Sample Nos. 202 and 203 were exposed, then placed under the condition of 60° C., 60% RH for two days, and further, allowed to stand at room temperature for one day. The samples underwent this set of procedure for three times, that is, nine days, and development processed with a running solution prepared using the above Sample No. 201. The fluctuation in photographic properties of Sample Nos. 202 and 203 was much the same and preferred even compared with samples which were development processed immediately after exposure.

EXAMPLE 3

In the preparation of emulsified substance containing the coupler in Example 1, each of the compounds represented by formulae (S1) and (S2) according to the present invention was dissolved with the magenta coupler with the proportion of each compound being 0.3 mol to 1 mol of the magenta coupler and emulsion dispersed. Emulsified substances shown in Table 5 below were thus obtained. The same names of emulsified substances in Tables 1 and 5 are the same emulsified substances.

TABLE 5

| Name of Emulsified Substance | Compound Added |
|---|---|
| B-8 | (S1-3) |
| B-9 | (S1-5) |
| B-10 | (S1-7) |
| B-13 | (S1-17) |
| B-14 | (S1-20) |
| B-16 | (S2-1) |
| B-17 | (S2-2) |
| B-18 | (S2-4) |

Emulsion B was mixed with each emulsified substance shown in Table 5 and stirred at 40° C. to thereby obtain a finished emulsion. Each emulsified substance aged for 2 hours was coated on a cellulose triacetate film support in the same coating condition as in Example 1.

These samples were allowed to stand under the condition of 40° C., 70% RH for 14 hours. Subsequently, the samples were subjected to exposure for 1/100 seconds through a gelatin filter SC-50, a product of Fuji Photo Film Co., Ltd., and continuous wedge.

Samples were processed according to the following step using Nega Processor FP-350, a product of Fuji Photo Film Co., Ltd., until the accumulated replenishment amount of the processing solution reached 3 times of the capacity of the mother liquid tank.

Processing Step

| Step | Processing Time | Processing Temperature (°C.) | Replenishment* Amount (ml) |
|---|---|---|---|
| Color Development | 3 min 15 sec | 38 | 45 |
| Bleaching | 1 min 00 sec | 38 | 20 The overflow from the bleaching tank was all introduced into the blixing tank. |
| Blixing | 3 min 15 sec | 38 | 30 |
| Washing (1) | 40 sec | 35 | countercurrent system from (2) to (1) |
| Washing (2) | 1 min 00 sec | 35 | 30 |
| Stabilization | 40 sec | 38 | 20 |
| Drying | 1 min 15 sec | 55 | |

*Replenishment rate: per 1.1 meter of 35 mm wide photographic material (corresponding to a 24 ex. film)

The composition of each processing solution is described below.

Color Developing Solution

| | Tank Solution (g) | Replenisher (g) |
|---|---|---|
| Diethylenetriaminepentaacetic Acid | 1.0 | 1.1 |
| 1-Hydroxyethylidene-1,1-diphosphonic Acid | 2.0 | 2.0 |
| Sodium Sulfite | 4.0 | 4.4 |
| Potassium Carbonate | 30.0 | 37.0 |
| Potassium Bromide | 1.4 | 0.7 |
| Potassium Iodide | 1.5 mg | — |
| Hydroxylamine Sulfate | 2.4 | 2.8 |
| 4-[N-Ethyl-N-(β-hydroxyethyl)-amino]-2-methylaniline Sulfate | 4.5 | 5.5 |
| Water to make | 1.0 l | 1.0 l |
| pH (adjusted with potassium hydroxide and sulfuric acid) | 10.05 | 10.10 |

Bleaching Solution (replenisher equals tank solution)

| | (unit: g) |
|---|---|
| Ammonium Ethylenediaminetetraacetato Ferrate Dihydrate | 120.0 |
| Disodium Ethylenediaminetetraacetate | 10.0 |
| Ammonium Bromide | 100.0 |
| Ammonium Nitrate | 10.0 |
| Bleach Accelerator $(CH_3)_2N—CH_2—CH_2—S—S—CH_2—CH_2—N(CH_3)_2.2HCl$ | 0.005mol |
| Aqueous Ammonia (27%) | 15.0 ml |
| Water to make | 1.0 l |
| pH (adjusted with aqueous ammonia and nitric acid) | 6.3 |

Blixing Solution

| | Tank Solution (g) | Replenisher (g) |
|---|---|---|
| Ammonium Ethylenediaminetetra-acetato Ferrate Dihydrate | 50.0 | — |
| Disodium Ethylenediaminetetra-acetate | 5.0 | 2.0 |
| Sodium Sulfite | 12.0 | 20.0 |
| Aqueous Solution of Ammonium Thiosulfate (700 g/liter) | 240.0ml | 400.0ml |
| Aqueous Ammonia (27%) | 6.0ml | — |
| Water to make | 1.0 l | 1.0 l |
| pH (adjusted with aqueous ammonia and acetic acid) | 7.2 | 7.3 |

Washing Water (replenisher equals tank solution)

City water was passed through a mixed bed column packed with an H-type strongly acidic cation exchange resin (Amberlite IR-120B of Rohm & Haas) and an OH-type anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 150 mg/liter of sodium sulfate were added thereto. The pH of this washing water was in the range of from 6.5 to 7.5.

Stabilizing Solution (replenisher equals tank solution)

| | (unit: g) |
|---|---|
| Sodium p-Toluenesulfinate | 0.03 |
| Polyoxyethylene-p-monononylphenyl | 0.2 |

-continued

| | (unit: g) |
|---|---|
| Ether (average polymerization degree: 10) | |
| Disodium Ethylenediaminetetraacetate | 0.05 |
| 1,2,4-Triazole | 1.3 |
| 1,4-Bis(1,2,4-triazol-1-ylmethyl)-piperazine | 0.75 |
| Water to make | 1.0 l |
| pH | 8.5 |

The above samples underwent the same procedure until exposure, and were allowed to stand under the condition of 60° C., 60% RH and 60° C., 5% RH for three days without being development processed immediately. These samples were processed with the foregoing processing solutions and density was measured using a green filter. The fluctuation in photographic properties of each sample due to preservation was evaluated by this experiment. The results obtained are shown in Table 6 below.

TABLE 6

| Sample No. | Name of Emulsified Substance | Effect of Storage Stability Improvement 60° C., 60% RH | Effect of Storage Stability Improvement 60° C., 5% RH |
|---|---|---|---|
| 1 | B-8 | 0.25 | 0.31 |
| 2 | B-9 | 0.21 | 0.25 |
| 3 | B-10 | 0.15 | 0.21 |
| 4 | B-13 | 0.09 | 0.15 |
| 5 | B-14 | 0.04 | 0.11 |
| 6 | B-16 | 0.02 | 0.04 |
| 7 | B-17 | 0.02 | 0.02 |
| 8 | B-18 | 0.03 | 0.07 |

Effect of storage stability improvement was conducted samples which were aged for 2 hours as finished emulsions, and evaluated by the increase of the fog level of the sample which was allowed to stand under the condition of 60° C., 60% RH and 60° C., 5% RH for three days after exposure to the fog level of the sample immediately development processed after exposure. The larger the value, the more is the fog increase.

As can be clearly understood from the results in Table 6, Sample Nos. 6 to 9 to which the compounds represented by formula (S2) were added could efficiently inhibit the fluctuation in photographic properties even when preserved not only in a high temperature and high humidity condition but also in a high temperature and low humidity condition.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having provided thereon a silver halide light-sensitive layer, which silver halide photographic material comprises at least one compound represented by the following formula (S1):

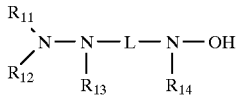

(S1)

wherein $R_{11}$ is an acyl group, an alkoxycarbonyl group, a carbamoyl group, a sulfonyl group, or a sulfamoyl group, $R_{12}$ is a hydrogen atom, $R_{13}$ is a hydrogen atom, $R_{14}$ is a hydrogen atom or an alkyl group, and L is —CO—.

2. A silver halide photographic material comprising a support having provided thereon a silver halide light-sensitive layer which silver halide photographic material comprises at least one compound represented by the following formula (S1):

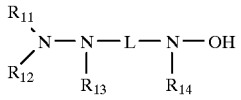

(S1)

wherein $R_{11}$ is an acyl group or a carbamoyl group, $R_{12}$ is a hydrogen atom, $R_{13}$ is a hydrogen atom, $R_{14}$ is a hydrogen atom or an alkyl group, and L is —CO—.

3. The silver halide photographic material as claimed in claim 2, wherein $R_{14}$ is an alkyl group.

4. The silver halide photographic material as claimed in claim 2, wherein $R_{11}$ is a substituted or unsubstituted benzoyl group.

5. A silver halide photographic material comprising a support having provided thereon a silver halide light-sensitive layer, which silver halide photographic material comprises at least one compound represented by the following formula (S2):

(S2)

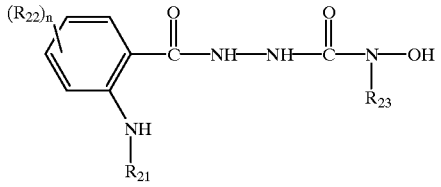

wherein $R_{21}$ represents an acyl group, an alkoxycarbonyl group, a carbamoyl group, a sulfonyl group or a sulfamoyl group; $R_{22}$ represents a substituent; $R_{23}$ represents an alkyl group having from 1 to 6 carbon atoms; and n represents 0 or an integer of from 1 to 4.

6. The silver halide photographic material as claimed in claim 5, wherein n is 0.

7. The silver halide photographic material as claimed in claim 6, wherein $R_{21}$ is an acyl group or a sulfonyl group.

8. The silver halide photographic material as claimed in claim 5, wherein n is 0, $R_{21}$ is an acyl group or a sulfonyl group, and $R_{23}$ is a methyl, ethyl or n-propyl group.

9. The silver halide photographic material as claimed in claim 5, wherein n is 0, $R_{21}$ is an acyl group, and $R_{23}$ is a methyl, ethyl or n-propyl group.

* * * * *